US007647710B2

(12) United States Patent
Ellis, III

(10) Patent No.: US 7,647,710 B2
(45) **Date of Patent: *Jan. 19, 2010**

(54) SHOE SOLE STRUCTURES

(75) Inventor: Frampton E. Ellis, III, Jasper, FL (US)

(73) Assignee: Anatomic Research, Inc., Jasper, FL (US)

( * ) Notice: Subject to any disclaimer, the term of this patent is extended or adjusted under 35 U.S.C. 154(b) by 162 days.

This patent is subject to a terminal disclaimer.

(21) Appl. No.: 11/831,645

(22) Filed: Jul. 31, 2007

(65) Prior Publication Data

US 2008/0022556 A1 Jan. 31, 2008

Related U.S. Application Data

(60) Continuation of application No. 11/738,947, filed on Apr. 23, 2007, now Pat. No. 7,546,699, which is a continuation of application No. 11/179,887, filed on Jul. 12, 2005, now Pat. No. 7,334,356, which is a division of application No. 10/255,254, filed on Sep. 26, 2002, now Pat. No. 6,918,197, which is a division of application No. 08/479,776, filed on Jun. 7, 1995, now Pat. No. 6,487,795.

(51) Int. Cl.
*A43B 13/18* (2006.01)

(52) U.S. Cl. ..... 36/103; 36/28; 36/25 R

(58) Field of Classification Search ..... 36/103, 36/28, 29, 30 R, 31, 45, 102
See application file for complete search history.

(56) References Cited

U.S. PATENT DOCUMENTS

| | | | |
|---|---|---|---|
| 193,914 | A | 8/1877 | Berry |
| 280,791 | A | 7/1883 | Brooks |
| 288,127 | A | 11/1883 | Shepard |
| 500,385 | A | 6/1893 | Hall |

(Continued)

FOREIGN PATENT DOCUMENTS

| | | |
|---|---|---|
| AU | 200963 | 5/1958 |

(Continued)

OTHER PUBLICATIONS

Adidas Catalog 1986.

(Continued)

*Primary Examiner*—Ted Kavanaugh
(74) *Attorney, Agent, or Firm*—Knoble, Yoshida & Dunleavy, LLC

(57) ABSTRACT

Footwear, particularly athletic shoes, that has a sole structure copying support, stability and cushioning structures of the human foot. Still more particularly, this invention relates to the use of the shoe upper portion to envelop one or more portions of the shoe midsole in combination with portions of the shoe sole having at least one concavely rounded portion of the sole outer surface, relative to a portion of the shoe sole located adjacent to the concavely rounded outer surface portion, and at least one convexly rounded portion of the inner surface of the midsole component, relative to a portion of the midsole component located adjacent to the convexly rounded portion of the inner surface of the midsole component, all as viewed in a frontal plane cross-section when the shoe sole is upright and in an unloaded condition.

26 Claims, 34 Drawing Sheets

U.S. PATENT DOCUMENTS

| | | | |
|---|---|---|---|
| 532,429 | A | 1/1895 | Rogers |
| 584,373 | A | 6/1897 | Kuhn |
| 1,283,335 | A | 10/1918 | Shillcock |
| 1,289,106 | A | 12/1918 | Bullock |
| D55,115 | S | 5/1920 | Barney |
| 1,458,446 | A | 6/1923 | Schaeffer |
| 1,622,860 | A | 3/1927 | Cutler |
| 1,639,381 | A | 8/1927 | Manelas |
| 1,701,260 | A | 2/1929 | Fischer |
| 1,735,986 | A | 11/1929 | Wray |
| 1,853,034 | A | 4/1932 | Bradley |
| 2,120,987 | A | 6/1938 | Murray |
| 2,147,197 | A | 2/1939 | Glidden |
| 2,155,166 | A | 4/1939 | Kraft |
| 2,162,912 | A | 6/1939 | Craver |
| 2,170,652 | A | 8/1939 | Brennan |
| 2,179,942 | A | 11/1939 | Lyne |
| D119,894 | S | 4/1940 | Sherman |
| 2,201,300 | A | 5/1940 | Prue |
| 2,206,860 | A | 7/1940 | Sperry |
| D122,131 | S | 8/1940 | Sannar |
| D128,817 | S | 8/1941 | Esterson |
| 2,251,468 | A | 8/1941 | Smith |
| 2,328,242 | A | 8/1943 | Witherill |
| 2,345,831 | A | 4/1944 | Pierson |
| 2,433,329 | A | 12/1947 | Adler et al. |
| 2,434,770 | A | 1/1948 | Lutey |
| 2,470,200 | A | 5/1949 | Wallach |
| 2,627,676 | A | 2/1953 | Hack |
| 2,718,715 | A | 9/1955 | Spilman |
| 2,814,133 | A | 11/1957 | Herbst |
| 3,005,272 | A | 10/1961 | Shelare et al. |
| 3,087,261 | A | 4/1963 | Russell |
| 3,100,354 | A | 8/1963 | Lombard et al. |
| 3,110,971 | A | 11/1963 | Chang |
| 3,305,947 | A | 2/1967 | Kalsoy |
| 3,308,560 | A | 3/1967 | Jones |
| 3,416,174 | A | 12/1968 | Novitske |
| 3,512,274 | A | 5/1970 | McGrath |
| 3,535,799 | A | 10/1970 | Onituska |
| 3,806,974 | A | 4/1974 | DiPaolo |
| 3,824,716 | A | 7/1974 | DiPaolo |
| 3,834,046 | A | 9/1974 | Fowler |
| 3,863,366 | A | 2/1975 | Auberry et al. |
| 3,958,291 | A | 5/1976 | Spier |
| 3,964,181 | A | 6/1976 | Holcombe, Jr. |
| 3,997,984 | A | 12/1976 | Hayward |
| 4,003,145 | A | 1/1977 | Liebscher et al. |
| 4,030,213 | A | 6/1977 | Daswick |
| 4,043,058 | A | 8/1977 | Hollister et al. |
| 4,059,910 | A | 11/1977 | Bryden |
| 4,068,395 | A | 1/1978 | Senter |
| 4,083,125 | A | 4/1978 | Benseler et al. |
| 4,096,649 | A | 6/1978 | Saurwein |
| 4,098,011 | A | 7/1978 | Bowerman et al. |
| 4,128,950 | A | 12/1978 | Bowerman et al. |
| 4,128,951 | A | 12/1978 | Tansill |
| 4,141,158 | A | 2/1979 | Benseler et al. |
| 4,145,785 | A | 3/1979 | Lacey |
| 4,149,324 | A | 4/1979 | Lesser et al. |
| 4,161,828 | A | 7/1979 | Benseler et al. |
| 4,161,829 | A | 7/1979 | Wayser |
| 4,170,078 | A | 10/1979 | Moss |
| 4,183,156 | A | 1/1980 | Rudy |
| 4,194,310 | A | 3/1980 | Bowerman |
| 256,180 | A | 8/1980 | Turner |
| 256,400 | A | 8/1980 | Famolare, Jr. |
| 4,217,705 | A | 8/1980 | Donzis |
| 4,219,945 | A | 9/1980 | Rudy |
| 4,223,457 | A | 9/1980 | Borgeas |
| 4,227,320 | A | 10/1980 | Borgeas |
| 4,235,026 | A | 11/1980 | Plagenhoef |
| 4,237,627 | A | 12/1980 | Turner |
| 4,240,214 | A | 12/1980 | Sigle et al. |
| 4,241,523 | A | 12/1980 | Daswick |
| 4,245,406 | A | 1/1981 | Landay et al. |
| 4,250,638 | A | 2/1981 | Linnemann |
| 4,258,480 | A | 3/1981 | Famolare, Jr. |
| 4,259,792 | A | 4/1981 | Halberstadt |
| 4,262,433 | A | 4/1981 | Hagg et al. |
| 4,263,728 | A | 4/1981 | Frecentese |
| 4,266,349 | A | 5/1981 | Schmohl |
| 4,268,980 | A | 5/1981 | Gudas |
| 4,271,606 | A | 6/1981 | Rudy |
| 4,272,858 | A | 6/1981 | Hlustik |
| 4,274,211 | A | 6/1981 | Funck |
| 4,297,797 | A | 11/1981 | Meyers |
| 4,302,892 | A | 12/1981 | Adamik |
| 4,305,212 | A | 12/1981 | Coomer |
| 4,308,671 | A | 1/1982 | Bretschneider |
| 4,309,832 | A | 1/1982 | Hunt |
| 4,316,332 | A | 2/1982 | Giese et al. |
| 4,316,335 | A | 2/1982 | Giese et al. |
| 4,319,412 | A | 3/1982 | Muller et al. |
| 264,017 | A | 4/1982 | Turner |
| 4,322,895 | A | 4/1982 | Hockerson |
| 265,019 | A | 6/1982 | Vermonet |
| 4,335,529 | A | 6/1982 | Badalamenti |
| 4,340,626 | A | 7/1982 | Rudy |
| 4,342,161 | A | 8/1982 | Schmohl |
| 4,348,821 | A | 9/1982 | Daswick |
| 4,354,319 | A | 10/1982 | Block et al. |
| 4,361,971 | A | 12/1982 | Bowerman |
| 4,366,634 | A | 1/1983 | Giese et al. |
| 4,370,817 | A | 2/1983 | Ratanangsu |
| 4,372,059 | A | 2/1983 | Ambrose |
| 4,398,357 | A | 8/1983 | Batra |
| 4,399,620 | A | 8/1983 | Funck |
| 272,294 | A | 1/1984 | Watanabe |
| 4,449,306 | A | 5/1984 | Cavanagh |
| 4,451,994 | A | 6/1984 | Sjöswärd |
| 4,454,662 | A | 6/1984 | Stubblefield |
| 4,455,765 | A | 6/1984 | Bergmans |
| 4,468,870 | A | 9/1984 | Sternberg |
| 4,484,397 | A | 11/1984 | Curley, Jr. |
| 4,494,321 | A | 1/1985 | Lawlor |
| 4,505,055 | A | 3/1985 | Bergmans |
| 4,506,462 | A | 3/1985 | Cavanaugh |
| 4,521,979 | A | 6/1985 | Blaser |
| 4,527,345 | A | 7/1985 | Lopez |
| 280,568 | A | 9/1985 | Stubblefield |
| 4,542,598 | A | 9/1985 | Misevich et al. |
| 4,546,559 | A | 10/1985 | Dassler |
| 4,547,979 | A | 10/1985 | Harada |
| 4,557,059 | A | 12/1985 | Misevich et al. |
| 4,559,723 | A | 12/1985 | Hamy et al. |
| 4,559,724 | A | 12/1985 | Norton |
| 4,561,195 | A | 12/1985 | Onoda et al. |
| 4,570,362 | A | 2/1986 | Vermonet |
| 4,577,417 | A | 3/1986 | Cole |
| 4,578,882 | A | 4/1986 | Talarico, II |
| 4,580,359 | A | 4/1986 | Kurrash et al. |
| 4,624,061 | A | 11/1986 | Wezel et al. |
| 4,624,062 | A | 11/1986 | Autry et al. |
| 4,638,577 | A | 1/1987 | Riggs |
| 4,641,438 | A | 2/1987 | Laird et al. |
| 4,642,917 | A | 2/1987 | Ungar |
| 4,651,445 | A | 3/1987 | Hannibal |
| D289,341 | S | 4/1987 | Turner |
| 4,654,983 | A | 4/1987 | Graham |
| 4,667,423 | A | 5/1987 | Autry |
| 4,670,995 | A | 6/1987 | Huang |
| 4,676,010 | A | 6/1987 | Cheskin |
| 4,694,591 | A | 9/1987 | Banich et al. |

| | | | |
|---|---|---|---|
| 4,697,361 | A | 10/1987 | Ganter et al. |
| D293,275 | S | 12/1987 | Bua |
| 4,715,133 | A | 12/1987 | Hatjes et al. |
| 4,724,622 | A | 2/1988 | Mills |
| D294,425 | S | 3/1988 | Le |
| 4,727,660 | A | 3/1988 | Bernhard |
| 4,730,402 | A | 3/1988 | Norton et al. |
| 4,731,939 | A | 3/1988 | Parracho et al. |
| 4,747,220 | A | 5/1988 | Autry et al. |
| D296,149 | S | 6/1988 | Diaz |
| D296,152 | S | 6/1988 | Selbiger |
| 4,748,753 | A | 6/1988 | Ju |
| 4,754,561 | A | 7/1988 | DuFour |
| 4,756,098 | A | 7/1988 | Boggia |
| 4,757,620 | A | 7/1988 | Tiitola |
| 4,759,136 | A | 7/1988 | Stewart et al. |
| 4,768,295 | A | 9/1988 | Ito |
| 4,769,926 | A | 9/1988 | Meyers |
| 4,777,738 | A | 10/1988 | Giese |
| D298,684 | S | 11/1988 | Pitchford |
| 4,783,910 | A | 11/1988 | Boys |
| 4,785,557 | A | 11/1988 | Kelley et al. |
| 4,817,304 | A | 4/1989 | Parker et al. |
| 4,827,631 | A | 5/1989 | Thorton |
| 4,833,795 | A | 5/1989 | Diaz |
| 4,837,949 | A | 6/1989 | Dufour |
| D302,900 | S | 8/1989 | Kolman et al. |
| 4,854,057 | A | 8/1989 | Misevich et al. |
| 4,858,340 | A | 8/1989 | Pasternak |
| 4,864,737 | A | 9/1989 | Marrello |
| 4,866,861 | A | 9/1989 | Noone |
| 4,876,807 | A | 10/1989 | Tiitola et al. |
| 4,890,398 | A | 1/1990 | Thomasson |
| 4,894,932 | A | 1/1990 | Harada |
| 4,894,933 | A | 1/1990 | Tonkel et al. |
| 4,897,936 | A | 2/1990 | Fuerst |
| 4,906,502 | A | 3/1990 | Rudy |
| 4,922,631 | A | 5/1990 | Anderie |
| 4,934,070 | A | 6/1990 | Mauger |
| 4,934,073 | A | 6/1990 | Robinson |
| D310,131 | S | 8/1990 | Hase |
| D310,132 | S | 8/1990 | Hase |
| 4,947,560 | A | 8/1990 | Fuerst et al. |
| 4,949,476 | A | 8/1990 | Anderie |
| D310,906 | S | 10/1990 | Hase |
| 4,982,737 | A | 1/1991 | Guttmann |
| 4,989,349 | A | 2/1991 | Ellis, III |
| D315,634 | S | 3/1991 | Yung-Mao |
| 5,010,662 | A | 4/1991 | Dabuzhsky et al. |
| 5,012,597 | A | 5/1991 | Thomasson |
| 5,014,449 | A | 5/1991 | Richard et al. |
| 5,024,007 | A | 6/1991 | DuFour |
| 5,025,573 | A | 6/1991 | Giese et al. |
| 5,048,203 | A | 9/1991 | Kling |
| D320,302 | S | 10/1991 | Kiyosawa |
| 5,052,130 | A | 10/1991 | Barry et al. |
| 5,077,916 | A | 1/1992 | Beneteau |
| 5,079,856 | A | 1/1992 | Treulsen |
| 5,092,060 | A | 3/1992 | Frachery et al. |
| D327,164 | S | 6/1992 | Hatfield |
| D327,165 | S | 6/1992 | Hatfield |
| 5,131,173 | A | 7/1992 | Anderie |
| D328,968 | S | 9/1992 | Tinker |
| D329,528 | S | 9/1992 | Hatfield |
| D329,739 | S | 9/1992 | Hatfield |
| D330,972 | S | 11/1992 | Hatfield et al. |
| D332,344 | S | 1/1993 | Hatfield et al. |
| D332,692 | S | 1/1993 | Hatfield et al. |
| 5,191,727 | A | 3/1993 | Barry et al. |
| 5,224,280 | A | 7/1993 | Preman et al. |
| 5,224,810 | A | 7/1993 | Pitkin |
| 5,237,758 | A | 8/1993 | Zachman |
| 5,247,742 | A | 9/1993 | Kilgore |
| D347,105 | S | 5/1994 | Johnson |
| 5,369,896 | A | 12/1994 | Frachey et al. |
| 5,371,819 | A | 12/1994 | Szegda |
| D372,114 | S | 7/1996 | Turner et al. |
| 5,543,194 | A | 8/1996 | Rudy |
| 5,544,429 | A | 8/1996 | Ellis, III |
| 5,572,805 | A | 11/1996 | Giese et al. |
| D388,594 | S | 1/1998 | Turner et al. |
| D409,362 | S | 5/1999 | Turner et al. |
| D409,826 | S | 5/1999 | Turner et al. |
| D410,138 | S | 5/1999 | Turner et al. |
| 5,909,948 | A | 6/1999 | Ellis, III |
| 6,115,941 | A | 9/2000 | Ellis, III |
| 6,115,945 | A | 9/2000 | Ellis, III |
| 6,163,982 | A | 12/2000 | Ellis, III |
| D444,293 | S | 7/2001 | Turner et al. |
| 6,295,744 | B1 * | 10/2001 | Ellis, III ..... 36/114 |
| 6,308,439 | B1 | 10/2001 | Ellis |
| D450,916 | S | 11/2001 | Turner et al. |
| 6,360,453 | B1 | 3/2002 | Ellis |
| 6,487,795 | B1 | 12/2002 | Ellis |
| 6,584,706 | B1 | 7/2003 | Ellis |
| 6,591,519 | B1 | 7/2003 | Ellis |
| 6,629,376 | B1 | 10/2003 | Ellis |
| 6,662,470 | B2 | 12/2003 | Ellis |
| 6,668,470 | B2 | 12/2003 | Ellis |
| 6,675,498 | B1 | 1/2004 | Ellis |
| 6,675,499 | B2 | 1/2004 | Ellis |
| 6,708,424 | B1 | 3/2004 | Ellis |
| 6,729,046 | B2 | 5/2004 | Ellis |
| 6,763,616 | B2 * | 7/2004 | Ellis, III ..... 36/102 |
| 6,789,331 | B1 | 9/2004 | Ellis |
| 6,810,606 | B1 | 11/2004 | Ellis |
| 6,918,197 | B2 | 7/2005 | Ellis |
| 7,127,834 | B2 | 10/2006 | Ellis |
| 7,168,185 | B2 | 1/2007 | Ellis |
| 7,334,356 | B2 * | 2/2008 | Ellis, III ..... 36/103 |

FOREIGN PATENT DOCUMENTS

| | | | |
|---|---|---|---|
| CA | 1138194 | | 12/1982 |
| CA | 1176458 | | 10/1984 |
| DE | 23257 | | 5/1956 |
| DE | 1888119 | | 12/1963 |
| DE | 1918131 | | 6/1965 |
| DE | 1918132 | | 6/1965 |
| DE | 1287477 | | 1/1969 |
| DE | 1290844 | | 3/1969 |
| DE | 2036062 | | 7/1970 |
| DE | 1948620 | | 5/1971 |
| DE | 1685293 | | 7/1971 |
| DE | 1685260 | | 10/1971 |
| DE | 2045430 | | 3/1972 |
| DE | 2522127 | | 11/1976 |
| DE | 2525613 | | 12/1976 |
| DE | 2602310 | | 7/1977 |
| DE | 2613312 | | 10/1977 |
| DE | 2706645 | | 8/1978 |
| DE | 2654116 | | 1/1979 |
| DE | 2737765 | | 3/1979 |
| DE | 2805426 | | 8/1979 |
| DE | 3021936 | | 4/1981 |
| DE | 3024587 | A1 | 1/1982 |
| DE | 8219616.8 | | 9/1982 |
| DE | 3113295 | | 10/1982 |
| DE | 3245182 | | 5/1983 |
| DE | 3317462 | | 10/1983 |
| DE | 3347343 | | 7/1985 |
| DE | 8530136.1 | | 2/1988 |
| DE | 3629245 | | 3/1988 |
| EP | 0048965 | | 4/1982 |
| EP | 0083449 | A1 | 12/1982 |
| EP | 0130816 | | 1/1985 |

| | | |
|---|---|---|
| EP | 0185781 | 7/1986 |
| EP | 0207063 | 10/1986 |
| EP | 0206511 | 12/1986 |
| EP | 0213257 | 3/1987 |
| EP | 0215974 | 4/1987 |
| EP | 0238995 | 9/1987 |
| EP | 0260777 | 3/1988 |
| EP | 0301331 | 2/1989 |
| EP | 0329391 | 8/1989 |
| EP | 0410087 | 1/1991 |
| FR | 602501 | 3/1926 |
| FR | 925961 | 9/1947 |
| FR | 1004472 | 3/1952 |
| FR | 1245672 | 10/1960 |
| FR | 1323455 | 2/1963 |
| FR | 2006270 | 11/1972 |
| FR | 2261721 | 9/1975 |
| FR | 2511850 | 3/1983 |
| FR | 2622411 | 5/1989 |
| GB | 16143 | 2/1892 |
| GB | 9591 | 4/1913 |
| GB | 764956 | 1/1957 |
| GB | 807305 | 1/1959 |
| GB | 1504615 | 3/1978 |
| GB | 2 023 405 | 1/1980 |
| GB | 2 039 717 | 8/1980 |
| GB | 2076633 | 12/1981 |
| GB | 2133668 | 8/1984 |
| GB | 2 136 670 | 9/1984 |
| JP | 39-15597 | 8/1964 |
| JP | 45-5154 | 3/1970 |
| JP | 50-71132 | 11/1975 |
| JP | 57-139333 | 8/1982 |
| JP | 59-23525 | 7/1984 |
| JP | 61-55810 | 4/1986 |
| JP | 1129505 | 6/1986 |
| JP | 61-167810 | 10/1986 |
| JP | 1-195803 | 8/1989 |
| JP | 2136505 | 5/1990 |
| JP | 2279103 | 11/1990 |
| JP | 3-85102 | 4/1991 |
| JP | 3086101 | 4/1991 |
| JP | 4-279102 | 10/1992 |
| JP | 5-123204 | 5/1993 |
| NZ | 189890 | 9/1981 |
| WO | WO 87/07480 | 12/1987 |
| WO | WO 87/07481 | 12/1987 |
| WO | WO 88/08263 | 11/1988 |
| WO | WO 89/06500 | 7/1989 |
| WO | WO 90/00358 | 1/1990 |
| WO | WO 91/00698 | 1/1991 |
| WO | WO 91/03180 | 3/1991 |
| WO | WO 91/04683 | 4/1991 |
| WO | WO 91/05491 | 5/1991 |
| WO | WO 91/10377 | 7/1991 |
| WO | WO 91/11124 | 8/1991 |
| WO | WO 91/11924 | 8/1991 |
| WO | WO 91/19429 | 12/1991 |
| WO | WO 92/07483 | 5/1992 |
| WO | WO 92/18024 | 10/1992 |
| WO | WO 93/13928 | 7/1993 |
| WO | WO 94/03080 | 2/1994 |
| WO | WO 97/00029 | 1/1997 |
| WO | WO 00/54616 | 9/2000 |
| WO | WO 00/64293 A1 | 11/2000 |
| WO | WO 01/80678 A2 | 11/2001 |

OTHER PUBLICATIONS

Adidas Catalog 1988.
Adidas Catalog 1989.
Adidas Catalog 1990.
Adidas Catalog 1991.
Adidas Catalog, Spring 1987.
Adidas' Second Supplemental Responses to Interrogatory No. 1, Nov. 14, 2002.
Adidas shoe, Model "Buffalo" 1985.
Adidas shoe, Model "London", 1986.
Adidas shoe, Model "Marathon 86" 1985.
Adidas shoe, Model "Skin Racer", 1988.
Adidas shoe, Model "Tolio H" 1985.
Adidas shoe, Model "Torsion Grand Slam Indoor," 1989.
Adidas shoe, Model <<Boston Super>> 1985.
Adidas shoe, Model <<Fire>> 1985.
Adidas shoe, Model <<Indoor Pro>> 1987.
Adidas shoe, Model <<Kingscup Indoor>> 1986.
Adidas shoe, Model <<Marathon>> 1986.
Adidas shoe, Model <<Questar>>, 1986.
Adidas shoe, Model <<Tauern>> 1986.
Adidas shoe, Model <<Tennis Comfort>>, 1988.
Adidas shoe, Model <<Torsion Special HI>> 1989.
Adidas shoe, Model <<Torsion ZX9020S>> 1989.
Adidas shoe, Model <<Water Competition>> 1980.
Adidas shoe, Model, <<Indoor Pro>> 1987.
Adidas Spring Catalog 1989.
Areblad et al. <<Three-Dimensional Measurement of Rearfoot Motion During Running>> *Journal of Biomechanics*, vol. 23, pp. 933-940 (1990).
AVIA Catalog 1986.
Avia Fall Catalog, 1988.
Brooks Catalog 1986.
Cavanaugh et al., "Biomechanics of Distance Running," Human Kinetics Books, pp. 155-164, 1990.
Clark Shoe Designed by Sven Coomer 1991.
Fineagan, "Comparison of the Effects of a Running Shoe and A Racing Flat on the Lower Extremity Biochemical Alignment of Runners," *Journal of the American Physical Therapy Association*, vol. 68, No. 5, p. 806 (1988).
Fixx, *The Complete Book of Running*, pp. 134-137, 1977.
Footwear Journal, Nike Advertisement, Aug. 1, 1987.
Footwear News, vol. 44, No. 37, Nike Advertisement (1988).
Footwear News, Special Supplement, Feb. 8, 1988.
Footwear News, vol. 45, No. 5, Nike Advertisement 1989.
Frederick, *Sports Shoes and Playing Surfaces, Biomechanical Properties*, Entire Book, 1984.
Johnson et al , <<A Biomechanical Approach to the Design of Football Boots>>, *Journal of Biomechanics*, vol. 9, pp. 581-585 (1976).
Komi et al., "Interaction Between Man and Shoe in Running: Considerations for More Comprehensive Measurement Approach," *International Journal of Sports Medicine*, vol. 8, pp. 196-202 1987.
Kronos Catalog, 1988.
K-Swiss Catalog, Fall 1991.
Leuthi et al., <<Influence of Shoe Construction on Lower Extremity Kinematics and Load During Lateral Movements In Tennis>>, *International Journal of Sport Biomechanics*, vol. 2, pp. 166-174, 1986.
Nawoczenside et al., <<Effect of Rocker Sole Design on Plantar Forefoot Pressures>> *Journal of the American Podiatric Medical Association*, vol. 79, No. 9, pp. 455-460, 1988.
Nigg et al., "Influence of Heel Flare and Midsole Constructions on Pronation" *International Journal of Sport Biomechanics*, vol. 4, No. 3, pp. 205-219 (1987).
Nigg et al., <<The Influence of Lateral Heel Flare of Running Shoes on Protraction and Impact Forces>>, *Medicine and Science in Sports and Exercise*, vol. 19, No. 3, pp. 294-302, 1987.
Nigg et al., *Biomechanics of Running Shoes*, entire book, 1986.
Nigg, <<Biomechanical Analysis of Ankle and foor Movement>> *Medicine and Sport Science*, vol. 23, pp. 22-29 1987.
Nike Catalog, Footwear Fall, 1988.
Nike Fall Catalog 1987, pp. 50-51.
Nike Shoe, men's cross-training Model "Air Trainer SC" 1989.
Nike shoe, men's cross-training Model <<Air Trainer TW>> 1989.
Nike shoe, Model "Air Force" 190 1978, 1988.
Nike shoe, Model "Air" 190 1553, 1988.
Nike shoe, Model <<Air Flow>> 190 718, 1988.
Nike shoe, Model <<Air Revolution>> 190 15075, 1988.
Nike shoe, Model <<Air>>, #13213, 1988.

Nike shoe, Model <<Air>>, #4183, 1988.
Nike shoe, Model <<High Jump 88>>, 1988.
Nike shoe, Model <<Leather Cortex®>>, 1988.
Nike shoe, Model <<Zoom Street Leather>> 1988.
Nike Spring Catalog 1989 pp. 62-63.
Palamarchuk et al., "In shoe Casting Techniques for Specialized Sport Shoes," *Journal of the America, Podiatric Medical Associate*, vol. 79, No. 9, pp. 462-465, 1989.
Pine Cross-Sport 1989.
Puma basketball shoe, *The Complete Handbook of Athletic Footwear*, pp. 315, 1987.
Romika Catalog, Summer 1978.
Runner's World, "Shoe Review" Nov. 1988 pp. 46-74.
Runner'World, "Spring Shoe Survey," pp. 45-74.
Runner's World, Apr. 1988.
Runner's World, Oct. 1986.
Saucony Spot-bilt Catalog 1988.
Saucony Spot-bilt Catalog Supplement, Spring 1985.
Saucony Spot-bilt shoe, *The Complete Handbook of Athletic Footwear*, pp. 332, 1987.
Segesser et al., "Surfing Shoe," *The Shoe in Support*, 1989, (Translation of a book published in Germany in 1987), pp. 106-110.
Sporting Goods Business, Aug. 1987.
Sports Illustrated, Nike Advertisement, Aug. 8, 1988.
Sports Illustrated, Special Preview Issue, The Summer Olympics <<Seoul '88>> Reebok Advertisement.
*The Complete Handbook of Athletic Footwear*, Entire Boook, 1987.
Vagenas et al., "Influence of Hell Flare and Midsole Construction on Pronation" *International Journal of Sport Biomechanics*, vol. 4, No. 4, pp. 342-357 (1988).
Valiant et al., <<A Study of Landing from a Jump Implications for the Design of a Basketball Shoe>>, *Scientific Program of IX International Congress of Biomechanics*, 1983.
Williams et al., <<The Mechanics of Foot Action During the GoldSwing and Implications for Shoe Design>>, *Medicine and Science in Sports and Exercise*, vol. 15, No. 3, pp. 247-255, 19833.
World Professional Squash Association Pro Tour Program, 1982-1983.
Williams, Walking on Air, *Case Alumnus*, vol. LXVII, No. 6, Fall 1989, pp. 4-8.
Brooks advertisement in *Runner's World* etc., Jun. 1989, pp. 56+.
Cavanaugh et al., Biological Aspects of Modeling Shoe/Foot Interaction During Running, *Sports Shoes and Playing Surfaces*, 1984, pp. 24-25, 32-35, 46.
Blechschmidt, The Structure of the Calcaneal Padding, *Foot & Ankle* vol. 2, No. 5, Mar. 1982, pp. 260-283.
Cavanaugh "The Running Shoe Book," 201 1980, pp. 176-180, Anderson World, Inc., Mountain View, CA.
Executive Summary with Seven Figures, Nov. 16, 1993.
German Description of adidas badminton shoe, pre-1989(?), 1 page.
The Reebok Lineup, Fall 1987, 2 pages.
Related US specification available upon request: U.S. Appl. No. 09/908,688, filed Jul. 20, 2001.
Related US specification available upon request: U.S. Appl. No. 08/477,640, filed Jun. 7, 1995.
Related US specification available upon request: U.S. Appl. No. 09/648,792, filed Aug. 28, 2000.
Related US specification available upon request: U.S. Appl. No. 08/376,661, filed Jan. 23, 1995.
Related US specification available upon request: U.S. Appl. No. 09/710,952, filed Nov. 14, 2000.
Related US specification available upon request: U.S. Appl. No. 09/780,450, filed Feb. 12, 2001.
Related US specification available upon request: U.S. Appl. No. 09/790,626, filed Feb. 23, 2001.
Related US specification available upon request: U.S. Appl. No. 09/734,905, filed Dec. 13, 2000.
Related US specification available upon request: U.S. Appl. No. 09/785,200, filed Feb. 20, 2001.
Related US specification available upon request: U.S. Appl. No. 09/907,598, filed Jul. 19, 2001.
Related US specification available upon request: U.S. Appl. No. 09/794,943, filed Oct. 12, 2001.
Related US specification available upon request: U.S. Appl. No. 09/974,786, filed Oct. 12, 2001.
Related US specification available upon request: U.S. Appl. No. 08/452,490, filed May 30, 1995.
Related US specification available upon request: U.S. Appl. No. 08/473,974, filed Jun. 7, 1995.
Related US specification available upon request: U.S. Appl. No. 08/482,838, filed Jun. 7, 1995.
Related US specification available upon request: U.S. Appl. No. 08/033,468, filed Mar. 18, 1993.
Related US specification available upon request: U.S. Appl. No. 08/462,531, filed Jun. 5, 1995.
Related US specification available upon request: U.S. Appl. No. 08/473,212, filed Jun. 7, 1995.
Related US application available upon request: U.S. Appl. No. 11/831,645, filed Jul. 31, 2007.
Related US application available upon request: U.S. Appl. No. 11/738,947, filed Apr. 23, 2007.
Related US application available upon request: U.S. Appl. No. 11/179,887, filed Jul. 12, 2005.

* cited by examiner

UNLOADED, UPRIGHT
159
27
167
163
29
160
158
LOW PRESSURE
29
168
160

LOADED MODERATELY, UPRIGHT
158
159
27
163
167
29
TENSION
43
TENSION
COMPRESSION PRESSURE (MEDIUM)
168

LOADED HEAVILY, UPRIGHT
159
27
158
163
163
TENSION
TENSION
43
29
COMPRESSION PRESSURE (HIGH)
160
29

LOADED HEAVILY, 20° LATERAL TILT
167
158
27
20°
159
163
29
TENSION
43
TENSION
29
168
COMPRESSION PRESSURE (HIGH)

SURFACE SHOWN FLAT

SHOE SOLE STRUCTURES

RELATED APPLICATIONS

This application is a divisional of U.S. patent application Ser. No. 08/479,776, filed on Jun. 7, 1995, now pending, which, in turn, is a continuation of U.S. patent application Ser. No. 07/926,523 filed on Aug. 10, 1992, now abandoned, which, in turn, is a continuation-in-part of U.S. patent application Ser. No. 07/463,302, filed on Jan. 10, 1990, now abandoned.

BACKGROUND OF THE INVENTION

This invention relates generally to the structure of footwear. More specifically, this invention relates to the structure of athletic shoe soles that copy the underlying support, stability and cushioning structures of the human foot. Still more particularly, this invention relates to the use of relatively inelastic and flexible fiber within the material of the shoe sole to provide both flexibility and firmness under load-bearing pressure. It also relates to the use of sipes, particularly those that roughly parallel the foot sole of the wearer in frontal plane cross sections, contained within the shoe sole under the load-bearing structures of the wearer's foot to provide the firmness and flexibility to deform to flatten under weight-bearing loads in parallel with the wearer's foot sole. Finally, it relates to providing additional shoe sole width to support those areas identified as mandatory to maintaining the naturally firm lateral and medial support of the wearer's foot sole during extreme sideways motion while load-bearing.

This application is built upon the applicant's earlier U.S. Applications, especially Including Ser. No. 07/463,302, filed Jan. 10, 1990. That earlier application showed that natural stability is provided by attaching a completely flexible but relatively inelastic shoe sole upper directly to the bottom sole, enveloping the sides of the midsole, instead of attaching it to the top surface of the shoe sole. Doing so puts the flexible side of the shoe upper under tension in reaction to destabilizing sideways forces on the shoe causing it to tilt. That tension force is balanced and in equilibrium because the bottom sole is firmly anchored by body weight, so the destabilizing sideways motion is neutralized by the tension in the flexible sides of the shoe upper. Still more particularly, this invention relates to support and cushioning which is provided by shoe sole compartments filled with a pressure-transmitting medium like liquid, gas, or gel. Unlike similar existing systems, direct physical contact occurs between the upper surface and the lower surface of the compartments, providing firm, stable support. Cushioning is provided by the transmitting medium progressively causing tension in the flexible and relatively inelastic sides of the shoe sole. The compartments providing support and cushioning are similar in structure to the fat pads of the foot, which simultaneously provide both firm support and progressive cushioning.

Existing cushioning systems cannot provide both firm support and progressive cushioning without also obstructing the natural pronation and supination motion of the foot, because the overall conception on which they are based is inherently flawed. The two most commercially successful proprietary systems are Nike Air, based on U.S. Pat. Nos. 4,219,945 issued Sep. 2, 1980, 4,183,156 issued Sep. 15, 1980, 4,271,606 issued Jun. 9, 1981, and 4,340,626 issued Jul. 20, 1982; and Asics Gel, based on U.S. Pat. No. 4,768,295 issued Sep. 6, 1988. Both of these cushioning systems and all of the other less popular ones have two essential flaws.

First, all such systems suspend the upper surface of the shoe sole directly under the important structural elements of the foot, particularly the critical the heel bone, known as the calcaneus, in order to cushion it. That is, to provide good cushioning and energy return, all such systems support the foot's bone structures in buoyant manner, as if floating on a water bed or bouncing on a trampoline. None provide firm, direct structural support to those foot support structures; the shoe sole surface above the cushioning system never comes in contact with the lower shoe sole surface under routine loads, like normal weight-bearing. In existing cushioning systems, firm structural support directly under the calcaneus and progressive cushioning are mutually incompatible. In marked contrast, it is obvious with the simplest tests that the barefoot is provided by very firm direct structural support by the fat pads underneath the bones contacting the sole, while at the same time it is effectively cushioned, though this property is underdeveloped in habitually shoe shod feet.

Second, because such existing proprietary cushioning systems do not provide adequate control of foot motion or stability, they are generally augmented with rigid structures on the sides of the shoe uppers and the shoe soles, like heel counters and motion control devices, in order to provide control and stability. Unfortunately, these rigid structures seriously obstruct natural pronation and supination motion and actually increase lateral instability, as noted in the applicant's U.S. application Ser. Nos. 07/219,387, filed on Jul. 15, 1988; 07/239,667, filed on Sep. 2, 1988; 07/400,714, filed on Aug. 30, 1989; 07/416,478, filed on Oct. 3, 1989; 07/424,509, filed on Oct. 20, 1989; 07/463,302, filed on Jan. 10, 1990; 07/469,313, filed on Jan. 24, 1990; 07/478,579, filed Feb. 8, 1990; 07/539,870, filed Jun. 18, 1990; 07/608,748, filed Nov. 5, 1990; 07/680,134, filed Apr. 3, 1991; 07/686,598, filed Apr. 17, 1991; and 07/783,145, filed Oct. 28, 1991, as well as in PCT and foreign national applications based on the preceding applications. The purpose of the inventions disclosed in these applications was primarily to provide a neutral design that allows for natural foot and ankle biomechanics as close as possible to that between the foot and the ground, and to avoid the serious interference with natural foot and ankle biomechanics inherent in existing shoes.

In marked contrast to the rigid-sided proprietary designs discussed above, the barefoot provides stability at it sides by putting those sides, which are flexible and relatively inelastic, under extreme tension caused by the pressure of the compressed fat pads; they thereby become temporarily rigid when outside forces make that rigidity appropriate, producing none of the destabilizing lever arm torque problems of the permanently rigid sides of existing designs.

The applicant's new invention simply attempts, as closely as possible, to replicate the naturally effective structures of the foot that provide stability, support, and cushioning.

This application is also built on the applicant's earlier U.S. application Ser. No. 07/539,870, filed Jun. 18, 1990. That earlier application related to the use of deformation sipes such as slits or channels in the shoe sole to provide it with sufficient flexibility to parallel the frontal plane deformation of the foot sole, which creates a stable base that is wide and flat even when tilted sideways in natural pronation and supination motion.

The applicant has introduced into the art the use of sipes to provide natural deformation paralleling the human foot in U.S. application Ser. No. 07/424,509, filed Oct. 20, 1989, and Ser. No. 07/478,579, filed Feb. 8, 1990. It is the object of this invention to elaborate upon those earlier applications to apply their general principles to other shoe sole structures, including those introduced in other earlier applications.

By way of introduction, the prior two applications elaborated almost exclusively on the use of sipes such as slits or channels that are preferably about perpendicular to the horizontal plane and about parallel to the sagittal plane, which coincides roughly with the long axis of the shoe; in addition, the sipes originated generally from the bottom of the shoe sole. The '870 application elaborated on use of sipes that instead originate generally from either or both sides of the shoe sole and are preferably about perpendicular to the sagittal plane and about parallel to the horizontal plane; that approach was introduced in the '509 application. The '870 application focused on sipes originating generally from either or both sides of the shoe sole, rather than from the bottom or top (or both) of the shoe sole, or contained entirely within the shoe sole.

The applicant's prior application on the sipe invention and the elaborations in this application are modifications of the inventions disclosed and claimed in the earlier applications and develop the application of the concept of the theoretically ideal stability plane to other shoe structures. Accordingly, it is a general object of the new invention to elaborate upon the application of the principle of the theoretically ideal stability plane to other shoe structures.

Accordingly, it is a general object of this invention to elaborate upon the application of the principle of the natural basis for the support, stability and cushioning of the barefoot to shoe structures.

It is still another object of this invention to provide a footwear using relatively inelastic and flexible fiber within the material of the shoe sole to provide both flexibility and firmness under load-bearing pressure.

It is still another object of this invention to provide footwear that uses sipes, particularly those that roughly parallel the foot sole of the wearer in frontal plane cross sections, contained within the shoe sole under load-bearing foot structures to provide the firmness and flexibility to deform to flatten under weight-bearing loads in parallel with the wearer's foot sole.

It is another object of this invention to provide additional shoe sole width to support those areas identified as most critical to maintaining the naturally firm lateral and medial support of the wearer's foot sole during extreme sideways motion while load-bearing.

These and other objects of the invention will become apparent from a detailed description of the invention which follows taken with the accompanying drawings.

BRIEF DESCRIPTION OF THE DRAWINGS

FIGS. 1-10 are from the applicant's U.S. application Ser. No. 07/463,302, filed 10 Jan. 1990, with several minor technical corrections.

FIG. 1 is a perspective view of a typical athletic shoe for running known to the prior art to which the invention is applicable.

FIG. 2 illustrates in a close-up frontal plane cross section of the heel at the ankle joint the typical shoe of existing art, undeformed by body weight, when tilted sideways on the bottom edge.

FIG. 3 shows, in the same close-up cross section as FIG. 2, the applicant's prior invention of a naturally contoured shoe sole design, also tilted out.

FIG. 4 shows a rear view of a barefoot heel tilted laterally 20 degrees.

FIG. 5 shows, in a frontal plane cross section at the ankle joint area of the heel, the applicant's new invention of tension stabilized sides applied to his prior naturally contoured shoe sole.

FIG. 6 shows, in a frontal plane cross section close-up, the FIG. 5 design when tilted to its edge, but undeformed by load.

FIG. 7 shows, in frontal plane cross section at the ankle joint area of the heel, the FIG. 5 design when tilted to its edge and naturally deformed by body weight, though constant shoe sole thickness is maintained undeformed.

FIG. 8 is a sequential series of frontal plane cross sections of the barefoot heel at the ankle joint area.

FIG. 9 is the applicant's new shoe sole design in a sequential series of frontal plane cross sections of the heel at the ankle joint area that corresponds exactly to the FIG. 8 series above.

FIG. 10 is two perspective views and a close-up view of the structure of fibrous connective tissue of the groups of fat cells of the human heel

FIG. 11A is a modification of FIG. 5A, FIG. 11B is FIG. 6 modified, and FIG. 11C is FIG. 7 modified.

FIG. 16D shows a similar approach applied to the applicant's fully contoured design.

FIG. 17 shows other conventional shoe soles with other variations of horizontal plane deformation slits.

FIG. 28A shows the range in the calcaneal or heel area, where the range is determined by the subtalar ankle joint. FIG. 28B shows the much greater range of sideways motion in the forefoot.

FIG. 29A-D is a modification of FIG. 7 of the '667 application, with the left side of the figures showing the required range of motion for each area. FIG. 29E is FIG. 20 of the '667 application.

FIG. 32A shows a shoe sole with an otherwise conventional periphery 35 to which has been added the single most critical stability correction 96*a* to support the head of the fifth metatarsal.

FIG. 32B shows a shoe sole similar to FIG. 32A, but with the, only additional shoe sole portion being a stability correction 97 to support the base of the fifth metatarsal 16.

FIG. 32C shows a shoe sole similar to FIGS. 32A&B, but combining both stability corrections 96*a* and 97, with the dashed line surrounding the fifth distal phalange 14 representing an optional additional support.

FIG. 32D shows a shoe sole similar to FIGS. 32A-C, but with a single stability correction 96*a* that supports both the head of the fifth metatarsal 15 and the fifth distal phalange 14.

FIG. 32E show the single most important correction on the medial side (or inside) of the shoe sole: a stability correction 96*b* at the head of the first metatarsal 10; FIGS. 32A-D have shown lateral corrections.

FIG. 32F shows a show sole similar to FIG. 32E, but with an additional stability correction 98 at the head of the first distal phalange 13.

FIG. 32G shows a shoe sole combining the additional stability corrections 96*a*, 96*b*, and 98 shown in FIGS. 32D&F, supporting the first and fifth metatarsal heads and distal phalange heads.

FIG. 32H shows a shoe sole with symmetrical stability additions 96*a* and 96*b*.

FIGS. 32I&J show perspective views of typical examples of the extreme case, women's high heel pumps. FIG. 32I shows a conventional high heel pump without modification. FIG. 32J shows the same shoe with an additional stability correction 96*a*.

FIG. 32K shows a shoe sole similar to that in FIG. 32H, but with the head of the fifth distal phalange 14 unsupported by the additional stability correction 96*a*.

FIGS. 33 through 43 are from the applicant's earlier U.S. application Ser. No. 07/539,870 filed 18 Jun. 1990.

FIG. 33 shows, in frontal plane cross section at the heel portion of a shoe, a conventional athletic shoe with rigid heel counter and reinforcing motion control device and a conventional shoe sole. FIG. 33 shows that shoe when tilted 20 degrees outward, at the normal limit of ankle inversion.

FIG. 34 shows, in frontal plane cross section at the heel, the human foot when tilted 20 degrees outward, at the normal limit of ankle inversion.

FIG. 35 shows, in frontal plane cross section at the heel portion, the applicant's prior invention in U.S. application Ser. No. 07/424,509, filed Oct. 20, 1989, of a conventional shoe sole with sipes in the form of deformation slits aligned in the vertical plane along the long axis of the shoe sole.

FIG. 36 is a view similar to FIG. 35, but with the shoe tilted 20 degrees outward, at the normal limit of ankle inversion, showing that the conventional shoe sole, as modified according to U.S. application Ser. No. 07/424,509, filed Oct. 20, 1989, can deform in a manner paralleling the wearer's foot, providing a wide and stable base of support in the frontal plane.

FIG. 37 is a view repeating FIG. 9B of U.S. Application No. '509 showing deformation slits applied to the applicant's prior naturally contoured sides invention, with additional slits on roughly the horizontal plane to aid natural deformation of the contoured side.

FIG. 39 is a frontal plane cross section at the heel of a conventional shoe of the right foot utilizing horizontal plane deformation slits and tilted outward about 20 degrees to the normal limit of ankle motion.

FIG. 40 is a frontal plane cross section at the heel of a conventional shoe with horizontal plane sipes in the form of slits that have been enlarged to channels, which contain an elastic supportive material.

FIG. 41 shows, in frontal plane cross section at the heel portion of a shoe, the applicant's prior invention of a shoe sole with naturally contoured sides based on a theoretically ideal stability plane.

FIG. 42 shows, again in frontal plane cross section, the most general case of the applicant's prior invention, a fully contoured shoe sole that follows the natural contour of the bottom of the foot as well as its sides, also based on the theoretically ideal stability plane.

FIG. 43 shows, in frontal plane cross section at the heel, the use of a high density (d') midsole material on the naturally contoured sides and a low density (d) midsole material everywhere else to reduce side width.

DETAILED DESCRIPTION OF THE PREFERRED EMBODIMENTS

Figure 1:
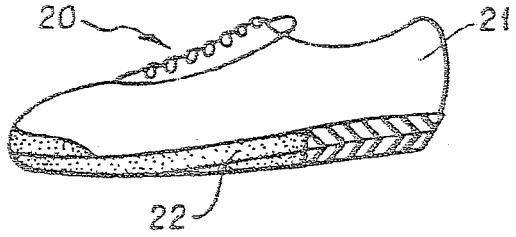
FIG. 1 (PRIOR ART)

FIG. 1 shows a perspective view of a shoe, such as a typical athletic shoe specifically for running, according to the prior art, wherein the running shoe 20 includes an upper portion 21 and a sole 22.

Figure 2:
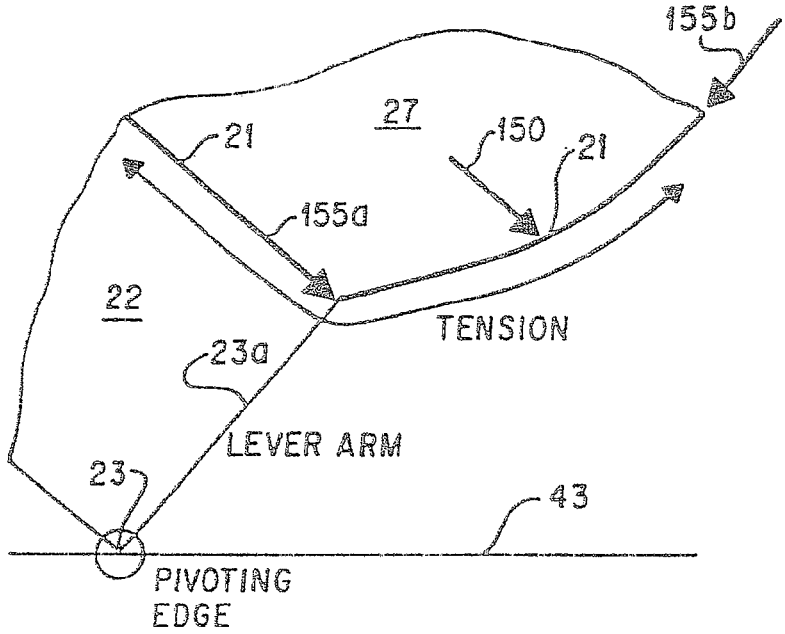
FIG. 2 PRIOR ART

FIG. 2 illustrates, in a close-up cross section of a typical shoe of existing art (undeformed by body weight) on the ground 43 when tilted on the bottom outside edge 23 of the shoe sole 22, that an inherent stability problem remains in existing designs, even when the abnormal torque producing rigid heel counter and other motion devices are removed, as illustrated in FIG. 5 of U.S. application Ser. No. 07/400,714, filed on Aug. 30, 1989. The problem is that the remaining shoe upper 21 (shown in the thickened and darkened line), while providing no lever arm extension, since it is flexible instead of rigid, nonetheless creates unnatural destabilizing torque on the shoe sole. The torque is due to the tension force 155*a* along the top surface of the shoe sole 22 caused by a compression force 150 (a composite of the force of gravity on the body and a sideways motion force) to the side by the foot 27, due simply to the shoe being tilted to the side, for example. The resulting destabilizing force acts to pull the shoe sole in rotation around a lever arm 23*a* that is the width of the shoe sole at the edge. Roughly speaking, the force of the foot on the shoe upper pulls the shoe over on its side when the shoe is tilted sideways. The compression force 150 also creates a tension force 155*b*, which is the mirror image of tension force 155*a*

Figure 3:
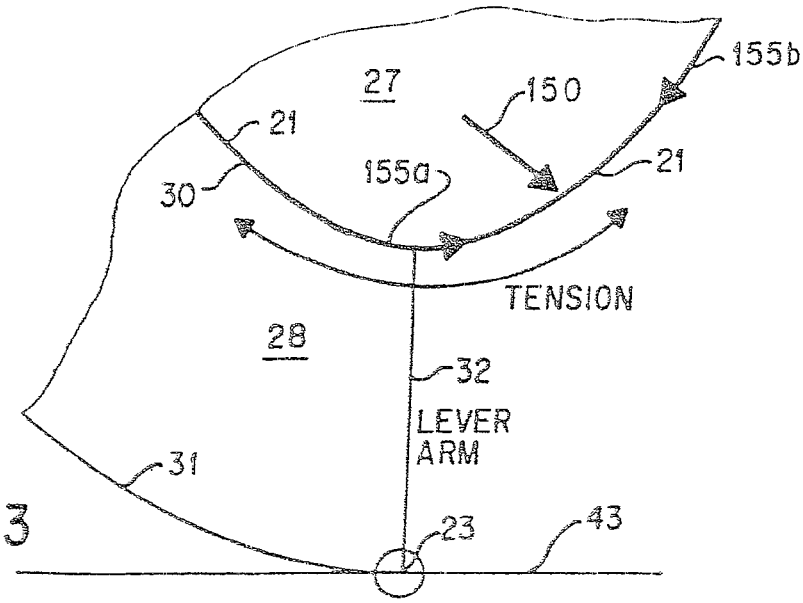

FIG. 3 shows, in a close-up cross section of a naturally contoured design shoe sole 28, described in U.S. application Ser. No. 07/239,667, filed on Sep. 2, 1988, (also shown undeformed by body weight) when tilted on the bottom edge, that the same inherent stability problem remains in the naturally contoured shoe sole design, though to a reduced degree. The problem is less since the direction of the force vector 155 along the lower surface of the shoe upper 21 is parallel to the ground 43 at the outer sole edge 32 edge, instead of angled toward the ground as in a conventional design like that shown in FIG. 2, so the resulting torque produced by lever arm created by the outer sole edge 32 would be less, and the contoured shoe sole 28 provides direct structural support when tilted, unlike conventional designs.

Figure 4:
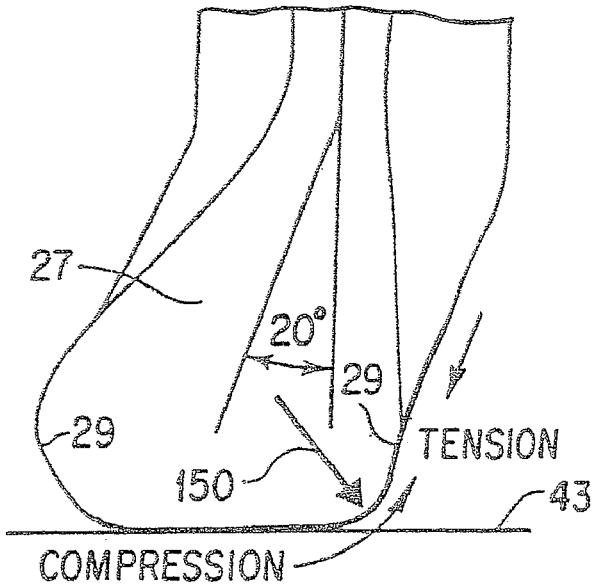

FIG. 4 shows (in a rear view) that, in contrast, the barefoot is naturally stable because, when deformed by body weight and tilted to its natural lateral limit of about 20 degrees, it does, not create any destabilizing torque due to tension force. Even though tension paralleling that on the shoe upper is created on the outer surface 29, both bottom and sides, of the bare foot by the compression force of weight-bearing, no destabilizing torque is created because the lower surface under tension (ie the foot's bottom sole, shown in the darkened line) is resting directly in contact with the ground. Consequently, there is no unnatural lever arm artificially created against which to pull. The weight of the body firmly anchors the outer surface of the foot underneath the foot so that even considerable pressure against the outer surface 29 of the side of the foot results in no destabilizing motion. When the foot is tilted, the supporting structures of the foot, like the calcaneus, slide against the side of the strong but flexible outer surface of the foot and create very substantial pressure on that outer surface at the sides of the foot. But that pressure is precisely resisted and balanced by tension along the outer surface of the foot, resulting in a stable equilibrium.

Figure 5A:
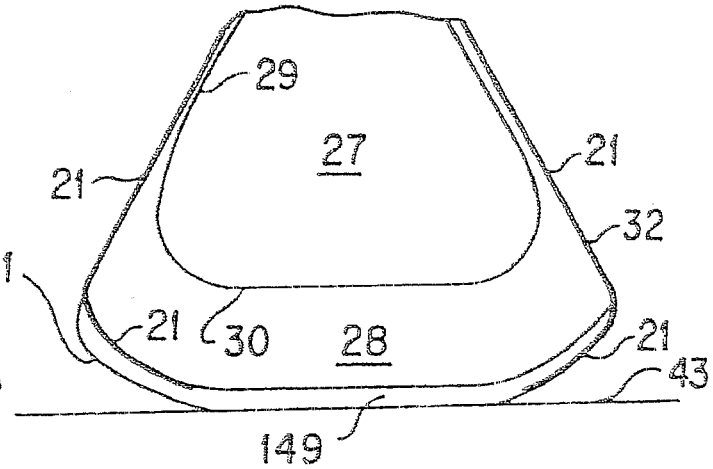
Figure 5B:
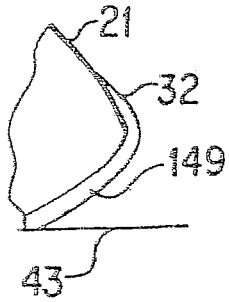

FIG. 5 shows, in cross section of the upright heel deformed by body weight, the principle of the tension stabilized sides of the barefoot applied to the naturally contoured shoe sole design; the same principle can be applied to conventional shoes, but is not shown. The key change from the existing art of shoes is that the sides of the shoe upper 21 (shown as darkened lines) must wrap around the outside edges 32 of the shoe sole 28, instead of attaching underneath the foot to the upper surface 30 of the shoe sole, as done conventionally. The shoe upper sides can overlap and be attached to either the inner (shown on the left) or outer surface (shown on the right) of the bottom sole, since those sides are not unusually load-bearing, as shown; or the bottom sole, optimally thin and tapering as shown, can extend upward around the outside edges 32 of the shoe sole to overlap and attach to the shoe upper sides (shown FIG. 5B); their optimal position coincides with the Theoretically Ideal Stability Plane, so that the tension force on the shoe sides is transmitted directly all the way down to the bottom shoe, which anchors it on the ground with virtually no intervening artificial lever arm. For shoes with only one sole layer, the attachment of the shoe upper sides should be at or near the lower or bottom surface of the shoe sole.

The design shown in FIG. 5 is based on a fundamentally different conception: that the shoe upper is integrated into the shoe sole, instead of attached on top of it, and the shoe sole is treated as a natural extension of the foot sole, not attached to it separately.

The fabric (or other flexible material, like leather) of the shoe uppers would preferably be non-stretch or relatively so, so as not to be deformed excessively by the tension place upon its sides when compressed as the foot and shoe tilt. The fabric can be reinforced in areas of particularly high tension, like the essential structural support and propulsion elements defined in the applicant's earlier applications (the base and lateral tuberosity of the calcaneus, the base of the fifth metatarsal, the heads of the metatarsals, and the first distal phalange; the reinforcement can take many forms, such as like that of corners of the jib sail of a racing sailboat or more simple straps. As closely as possible, it should have the same performance characteristics as the heavily calloused skin of the sole of an habitually bare foot. The relative density of the shoe sole is preferred as indicated in FIG. 9 of U.S. application Ser. No. 07/400,714, filed on Aug. 30, 1989, with the softest density nearest the foot sole, so that the conforming sides of the shoe sole do not provide a rigid destabilizing lever arm.

The change from existing art of the tension stabilized sides shown in FIG. 5 is that the shoe upper is directly integrated functionally with the shoe sole, instead of simply being attached on top of it. The advantage of the tension stabilized sides design is that it provides natural stability as close to that of the barefoot as possible, and does so economically, with the minimum shoe sole side width possible.

Figure 6:
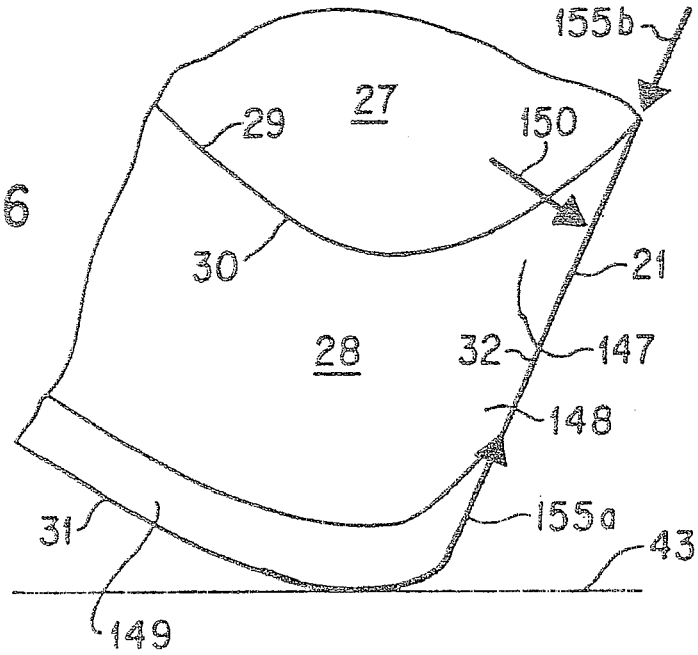

The result is a shoe sole that is naturally stabilized in the same way that the barefoot is stabilized, as seen in FIG. 6, which shows a close-up cross section of a naturally contoured design shoe sole 28 (undeformed by body weight) when tilted to the edge. The same destabilizing force against the side of the shoe shown in FIG. 2 is now stably resisted by offsetting tension in the surface of the shoe upper 21 extended down the side of the shoe sole so that it is anchored by the weight of the body when the shoe and foot are tilted.

In order to avoid creating unnatural torque on the shoe sole, the shoe uppers may be joined or bonded only to the bottom sole, not the midsole, so that pressure shown on the side of the shoe upper produces side tension only and not the destabilizing torque from pulling similar to that described in FIG. 2. However, to avoid unnatural torque, the upper areas 147 of the shoe midsole, which forms a sharp corner, should be composed of relatively soft midsole material; in this case, bonding the shoe uppers to the midsole would not create very much destabilizing torque. The bottom sole is preferably thin, at least on the stability sides, so that its attachment overlap with the shoe upper sides coincide as close as possible to the Theoretically Ideal Stability Plane, so that force is transmitted on the outer shoe sole surface to the ground.

In summary, the FIG. 5 design is for a shoe construction, including: a shoe upper that is composed of material that is flexible and relatively inelastic at least where the shoe upper contacts the areas of the structural bone elements of the human foot, and a shoe sole that has relatively flexible sides; and at least a portion of the sides of the shoe upper being attached directly to the bottom sole, while enveloping on the outside the other sole portions of said shoe sole. This construction can either be applied to convention shoe sole structures or to the applicant's prior shoe sole inventions, such as the naturally contoured shoe sole conforming to the theoretically ideal stability plane.

Figure 7:
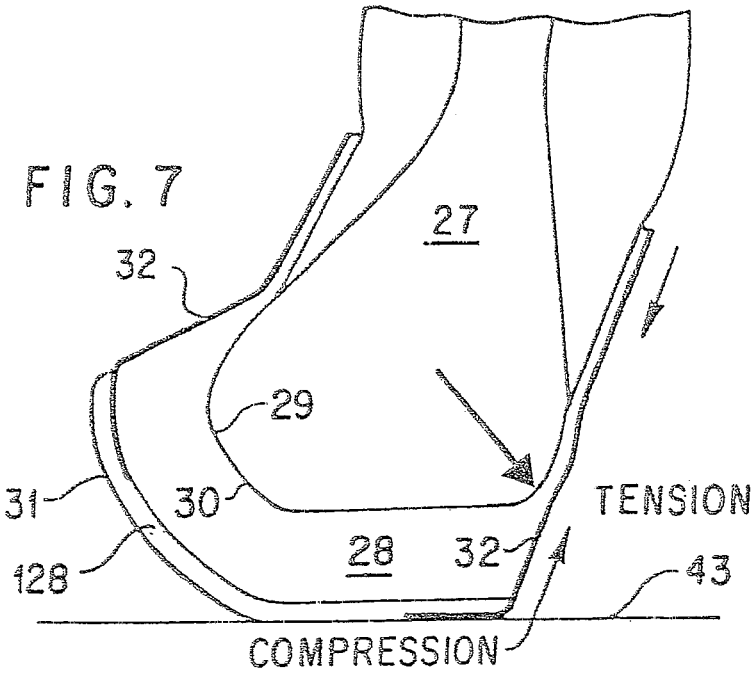

FIG. 7 shows, in cross section at the heel, the tension stabilized sides concept applied to naturally contoured design shoe sole when the shoe and foot are tilted out fully and naturally deformed by body weight (although constant shoe sole thickness is shown undeformed). The figure shows that the shape and stability function of the shoe sole and shoe uppers mirror almost exactly that of the human foot.

Figure 8A:
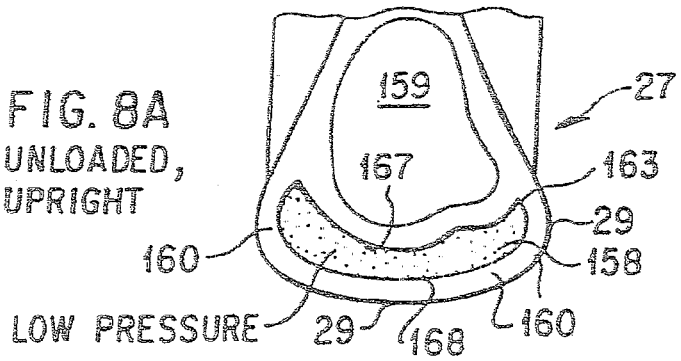
FIG. 8A is unloaded and upright.

FIGS. 8A-8D show the natural cushioning of the human barefoot, in cross sections at the heel. FIG. 8A shows the bare heel upright and unloaded, with little pressure on the subcalcaneal fat pad 158, which is evenly distributed between the calcaneus 159, which is the heel bone, and the bottom sole 160 of the foot.

Figure 8B:
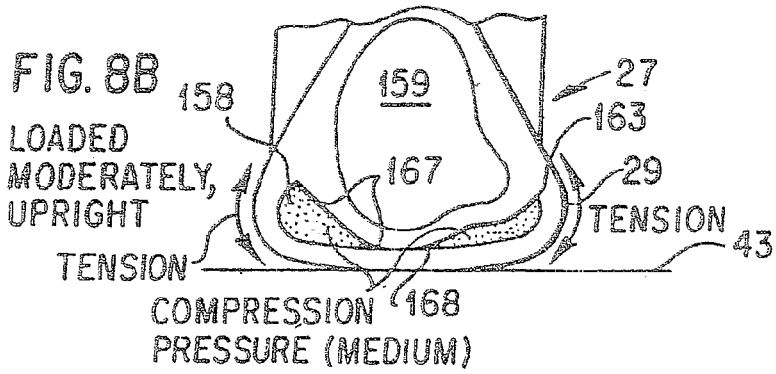
FIG. 8B is moderately loaded by full body weight and upright.

FIG. 8B shows the bare heel upright but under the moderate pressure of full body weight. The compression of the calcaneus against the subcalcaneal fat pad produces evenly balanced pressure within the subcalcaneal fat pad because it is contained and surrounded by a relatively unstretchable fibrous capsule, the bottom sole of the foot. Underneath the foot, where the bottom sole is in direct contact with the ground, the pressure caused by the calcaneus on the compressed subcalcaneal fat pad is transmitted directly to the ground. Simultaneously, substantial tension is created on the sides of the bottom sole of the foot because of the surrounding relatively tough fibrous capsule. That combination of applicant's prior shoe sole inventions, such as the naturally contoured shoe sole conforming to the theoretically ideal stability plane.

FIG. 7 shows, in cross section at the heel, the tension stabilized sides concept applied to naturally contoured design shoe sole when the shoe and foot are tilted out fully and naturally deformed by body weight (although constant shoe sole thickness is shown undeformed). The figure shows that the shape and stability function of the shoe sole and shoe uppers mirror almost exactly that of the human foot.

FIGS. 8A-8D show the natural cushioning of the human barefoot, in cross sections at the heel. FIG. 8A shows the bare heel upright and unloaded, with little pressure on the subcalcaneal fat pad 158, which is evenly distributed between the calcaneus 159, which is the heel bone, and the bottom sole 160 of the foot.

FIG. 8B shows the bare heel upright but under the moderate pressure of full body weight. The compression of the calcaneus against the subcalcaneal fat pad produces evenly balanced pressure within the subcalcaneal fat pad because it is contained and surrounded by a relatively unstretchable fibrous capsule, the bottom sole of the foot. Underneath the foot, where the bottom sole is in direct contact with the ground, the pressure caused by the calcaneus on the compressed subcalcaneal fat pad is transmitted directly to the ground. Simultaneously, substantial tension is created on the sides of the bottom sole of the foot because of the surrounding relatively tough fibrous capsule. That combination of bottom pressure and side tension is the foot's natural shock absorption system for support structures like the calcaneus and the other bones of the foot that come in contact with the ground.

Of equal functional importance is that lower surface 167 of those support structures of the foot like the calcaneus and other bones make firm contact with the upper surface 168 of the foot's bottom sole underneath, with relatively little uncompressed fat pad intervening. In effect, the support structures of the foot land on the ground and are firmly supported; they are not suspended on top of springy material in a buoyant manner analogous to a water bed or pneumatic tire, like the existing proprietary shoe sole cushioning systems like Nike Air or Asics Gel. This simultaneously firm and yet cushioned support provided by the foot sole must have a significantly beneficial impact on energy efficiency, also called energy return, and is not paralleled by existing shoe designs to provide cushioning, all of which provide shock absorption cushioning during the landing and support phases of locomotion at the expense of firm support during the take-off phase.

Figure 8C:
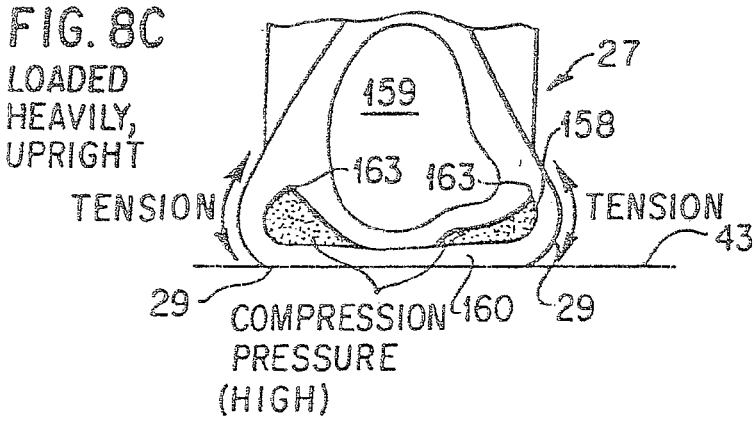
FIG. 8C is heavily loaded at peak landing force while running and upright.

The incredible and unique feature of, the foot's natural system is that, once the calcaneus is in fairly direct contact with the bottom sole and therefore providing firm support and stability, increased pressure produces a more rigid fibrous capsule that protects the calcaneus and greater tension at the sides to absorb shock. So, in a sense, even when the foot's suspension system would seem in a conventional way to have bottomed out under normal body weight pressure, it continues to react with a mechanism to protect and cushion the foot even under very much more extreme pressure. This is seen in FIG. 8C, which shows the human heel under the heavy pressure of roughly three times body weight force of landing during routine running. This can be easily verified: when one stands barefoot on a hard floor, the heel feels very firmly supported and yet can be lifted and virtually slammed onto the floor with little increase in the feeling of firmness; the heel simply becomes harder as the pressure increases.

In addition, it should be noted that this system allows the relatively narrow base of the calcaneus to pivot from side to side freely in normal pronation/supination motion, without any obstructing torsion on it, despite the very much greater width of compressed foot sole providing protection and cushioning; this is crucially important in maintaining natural alignment of joints above the ankle joint such as the knee, hip and back, particularly in the horizontal plane, so that the entire body is properly adjusted to absorb shock correctly. In contrast, existing shoe sole designs, which are generally relatively wide to provide stability, produce unnatural frontal plane torsion on the calcaneus, restricting its natural motion, and causing misalignment of the joints operating above it, resulting in the overuse injuries unusually common with such shoes. Instead of flexible sides that harden under tension caused by pressure like that of the foot, existing shoe sole designs are forced by lack of other alternatives to use relatively rigid sides in an attempt to provide sufficient stability to offset the otherwise uncontrollable buoyancy and lack of firm support of air or gel cushions.

Figure 8D:
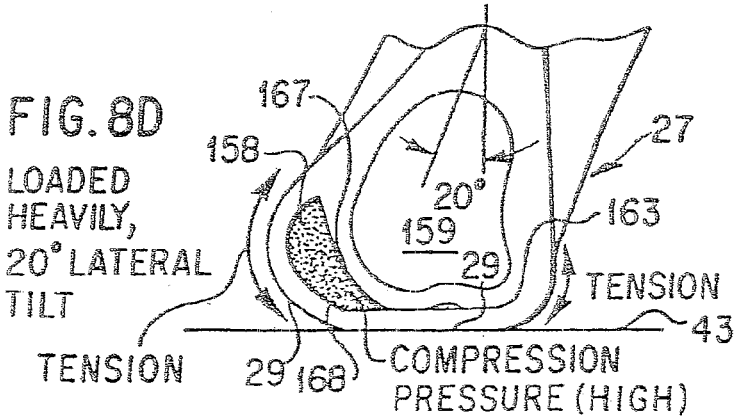
FIG. 8D is heavily loaded and tilted out laterally to its about 20 degree maximum.

FIG. 8D shows the barefoot deformed under full body weight and tilted laterally to the roughly 20 degree limit of normal range. Again it is clear that the natural system provides both firm lateral support and stability by providing relatively direct contact with the ground, while at the same time providing a cushioning mechanism through side tension and subcalcaneal fat pad pressure.

FIGS. 9A-9D show, also in cross sections at the heel, a naturally contoured shoe sole design that parallels as closely as possible the overall natural cushioning and stability system of the barefoot described in FIG. 8, including a cushioning compartment 161 under support structures of the foot containing a pressure-transmitting medium like gas, gel, or liquid, like the subcalcaneal fat pad under the calcaneus and other bones of the foot, consequently, FIGS. 9A-D directly correspond to FIGS. 8A-D. The optimal pressure-transmitting medium is that which most closely approximates the fat pads of the foot; silicone gel is probably most optimal of materials currently readily available, but future improvements are probable; since it transmits pressure indirectly, in that it compresses in volume under pressure, gas is significantly less optimal. The gas, gel, or liquid, or any other effective material, can be further encapsulated itself, in addition to the sides of the shoe sole, to control leakage and maintain uniformity, as is common conventionally, and can be subdivided into any practical number of encapsulated areas within a compartment, again as is common conventionally. The relative thickness of the cushioning compartment 161 can vary, as can the bottom sole 149 and the upper midsole 147, and can be consistent or differ in various areas of the shoe sole; the optimal relative sizes should be those that approximate most closely those of the average human foot, which suggests both smaller upper and lower soles and a larger cushioning compartment than shown in FIG. 9. However, for ease of manufacturing and other reasons, the cushioning compartment can also be very thin, including as thin as a simple sipe or horizontal slit, or a single boundary layer, such as a portion or most of that layer between the bottom sole and the midsole. And the cushioning compartments or pads 161 can be placed anywhere from directly underneath the foot, like an insole, to directly above the bottom sole. Optimally, the amount of compression created by a given load in any cushioning compartment 161 should be tuned to approximate as closely as possible the compression under the corresponding fat pad of the foot.

The function of the subcalcaneal fat pad is not met satisfactorily with existing proprietary cushioning systems, even those featuring gas, gel or liquid as a pressure transmitting medium. In contrast to those artificial systems, the new design shown is FIG. 9 conforms to the natural contour of the foot and to the natural method of transmitting bottom pressure into side tension in the flexible but relatively non-stretching (the actual optimal elasticity will require empirical studies) sides of the shoe sole.

Existing cushioning systems like Nike Air or Asics Gel do not bottom out under moderate loads and rarely if ever do so under extreme loads; the upper surface of the cushioning device remains suspended above the lower surface. In contrast, the new design in FIG. 9 provides firm support to foot support structures by providing for actual contact between the lower surface 165 of the upper midsole 147 and the upper surface 166 of the bottom sole 149 when fully loaded under moderate body weight pressure, as indicated in FIG. 9B, or under maximum normal peak landing force during running, as indicated in FIG. 9C, just as the human foot does in FIGS. 8B and 8C. The greater the downward force transmitted through the foot to the shoe, the greater the compression pressure in the cushioning compartment 161 and the greater the resulting tension of the shoe sole sides.

Figure 9A:
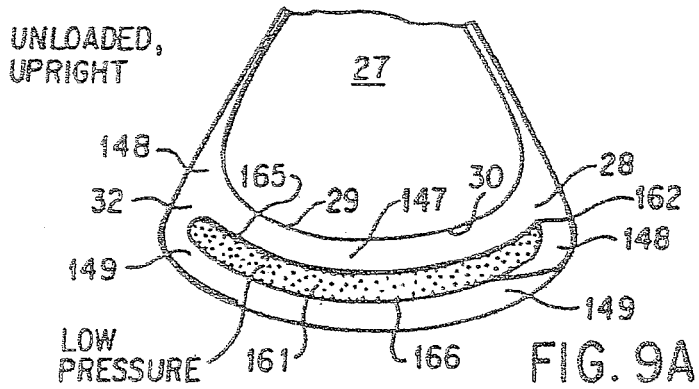
Figure 9B:
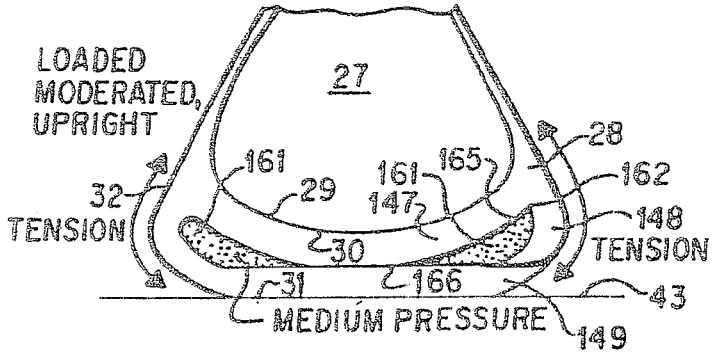
Figure 9C:
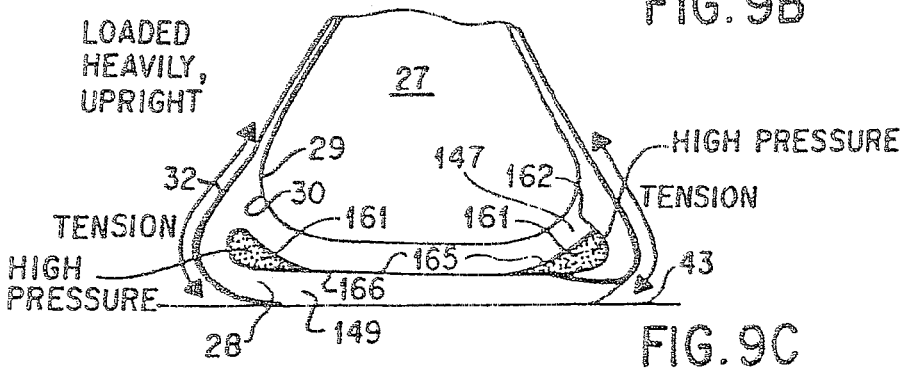
Figure 9D:
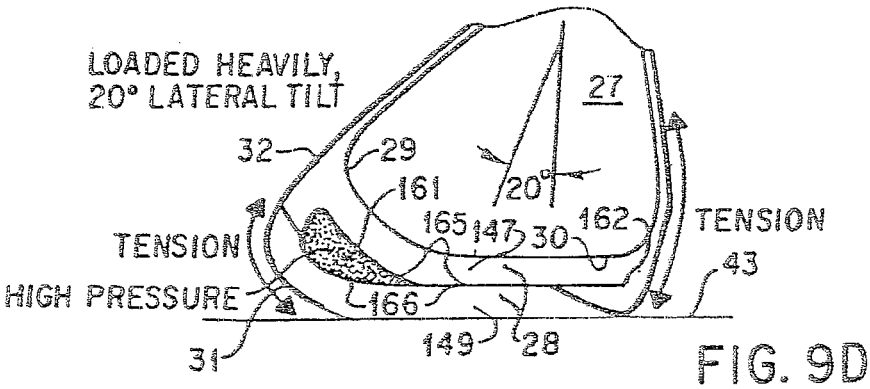

FIG. 9D shows the sane shoe sole design when fully loaded and tilted to the natural 20 degree lateral limit, like FIG. 8D. FIG. 9D shows that an added stability benefit of the natural cushioning system for shoe soles is that the effective thickness of the shoe sole is reduced by compression on the side so that the potential destabilizing lever arm represented by the shoe sole thickness is also reduced, so foot and ankle stability is increased. Another benefit of the FIG. 9 design is that the upper midsole shoe surface can move in any horizontal direction, either sideways or front to back in order to absorb shearing forces; that shearing motion is controlled by tension in the sides. Note that the right side of FIGS. 9A-D is modified to provide a natural crease or upward taper 162, which allows complete side compression without binding or bunching between the upper and lower shoe sole layers 147, 148, and 149; the shoe sole crease 162 parallels exactly a similar crease or taper 163 in the human foot.

Another possible variation of joining shoe upper to shoe bottom sole is on the right (lateral) side of FIGS. 9A-D, which makes use of the fact that it is optimal for the tension absorbing shoe sole sides, whether shoe upper or bottom sole, to coincide with the Theoretically Ideal Stability Plane along the side of the shoe sole beyond that point reached when the shoe is tilted to the foot's natural limit, so that no destabilizing shoe sole lever arm is created when the shoe is tilted fully, as in FIG. 9D. The joint may be moved up slightly so that the fabric side does not come in contact with the ground, or it may be cover with a coating to provide both traction and fabric protection.

It should be noted that the FIG. 9 design provides a structural basis for the shoe sole to conform very easily to the natural shape of the human foot and to parallel easily the natural deformation flattening. of the foot during load-bearing motion on the ground. This is true even if the shoe sole is made like a conventional sole except for the FIG. 9 design, although relatively rigid structures such as heel counters and motion control devices are not preferred, since they would interfere with the capability of the shoe sole to deform in parallel with the natural deformation under load of the wearer's foot sole. Though not optimal, such a conventional flat shoe made like FIG. 9 would provide the essential features of the new invention resulting, in significantly improved cushioning and stability. The FIG. 9 design could also be applied to intermediate-shaped shoe soles that neither conform to the flat ground or the naturally contoured foot. In addition, the FIG. 9 design can be applied to the applicant's other designs, such as those described in U.S. application Ser. No. 07/416,478, filed on Oct. 3, 1989.

In summary, the FIG. 9 design shows a shoe construction for a shoe, including: a shoe sole with a compartment or compartments under the structural elements of the human foot, including at least the heel; the compartment or compartments contains a pressure-transmitting medium like liquid, gas, or gel; a portion of the upper surface of the shoe sole compartment firmly contacts the lower surface of said compartment during normal load-bearing; and pressure from the load-bearing is transmitted progressively at least in part to the relatively inelastic sides, top and bottom of the shoe sole compartment or compartments, producing tension.

Figure 10A:
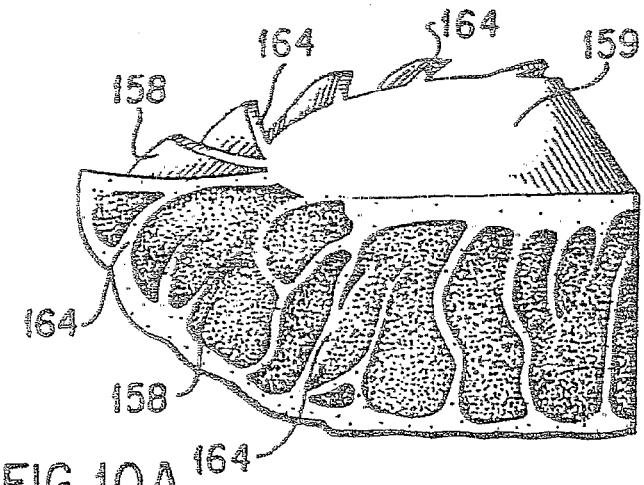
FIG. 10A shows a quartered section of the calcaneus and the fat pad chambers below it.
Figure 10B:
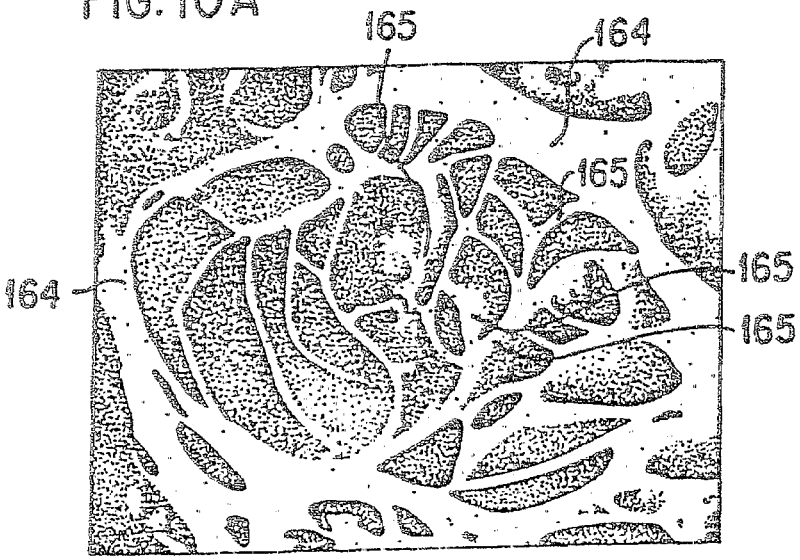
FIG. 10B shows a horizontal plane close-up of the inner structures of an individual chamber.
Figure 10C:
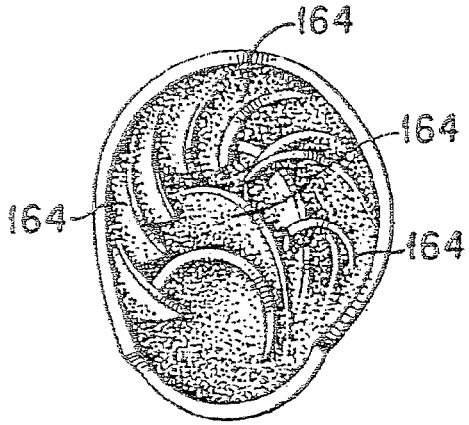
FIG. 10C shows a cross section of the calcaneus and the associated elastic fibrous connective tissue .

While the FIG. 9 design copies in a simplified way the macro structure of the foot, FIGS. 10 A-C focus on a more on the exact detail of the natural structures, including at the micro level. FIGS. 10A and 10C are perspective views of cross sections of the human heel showing the matrix of elastic fibrous connective tissue arranged into chambers 164 holding closely packed fat cells; the chambers are structured as whorls radiating out from the calcaneus. These fibrous-tissue strands are firmly attached to the undersurface of the calcaneus and extend to the subcutaneous tissues. They are usually in the form of the letter U, with the open end of the U pointing toward the calcaneus.

As the most natural, an approximation of this specific chamber structure would appear to be the most optimal as an accurate model for the structure of the shoe sole cushioning compartments 161, at least in an ultimate sense, although the complicated nature of the design will require some time to overcome exact design and construction difficulties; however, the description of the structure of calcaneal padding provided by Erich Blechschmidt in Foot and Ankle, March, 1982, (translated from the original 1933 article in German) is so detailed and comprehensive that copying the same structure as a model in shoe sole design is not difficult technically, once the crucial connection is made that such copying of this natural system is necessary to overcome inherent weaknesses in the design of existing shoes. other arrangements and orientations of the whorls are possible, but would probably be less optimal.

Pursuing this nearly exact design analogy, the lower surface 165 of the upper midsole 147 would correspond to the outer surface 167 of the calcaneus 159 and would be the origin of, the U shaped whorl chambers 164 noted above.

FIG. 10B shows a close-up of the interior structure of the large chambers shown in FIGS. 10A and 10C. It is clear from the fine interior structure and compression characteristics of the mini-chambers 165*a* that those directly under the calcaneus become very hard quite easily, due to the high local pressure on them and the limited degree of their elasticity, so they are able to provide very firm support to the calcaneus or other bones of the foot sole; by being fairly inelastic, the compression forces on those compartments are dissipated to other areas of the network of fat pads under any given support structure of the foot, like the calcaneus. Consequently, if a cushioning compartment 161, such as the compartment under the heel shown in FIG. 9, is subdivided into smaller chambers, like those shown in FIG. 10, then actual contact between the upper surface 165 and the lower surface 166 would no longer be required to provide firm support, so long as those compartments and the pressure-transmitting medium contained in them have material characteristics similar to those of the foot, as described above; the use of gas may not be satisfactory in this approach, since its compressibility may not allow adequate firmness.

In summary, the FIG. 10 design shows a shoe construction including: a shoe sole with a compartments under the structural elements of the human foot, including at least the heel; the compartments containing a pressure-transmitting medium like liquid, gas, or gel; the compartments having a whorled structure like that of the fat pads of the human foot sole; load-bearing pressure being transmitted progressively at least in part to the relatively inelastic sides, top and bottom of the shoe sole compartments, producing tension therein; the elasticity of the material of the compartments and the pressure-transmitting medium are such that normal weight-bearing loads produce sufficient tension within the foot, with different grades of coarseness available, from fine to coarse, corresponding to feet from soft to naturally tough. Using a tube sock design with uniform coarseness, rather than conventional sock design assumed above, would allow the user to rotate the sock on his foot to eliminate any "hot spot" irritation points that might develop. Also, since the toes are most prone to blistering and the heel is most important in shock absorption, the toe area of the sock could be relatively less abrasive than the heel area.

The use of fibers in existing shoe soles is limited to only the outer surface, such as the upper surface of insoles, which is typically woven fabric, and such as the Dellinger Web, which is a net or web of fabric surrounding the outer surface of the midsole (or portions of it, like the heel wedge, sandwiched into the rest of the shoe sole). No existing use of fiber in shoe soles includes use of those fibers within the shoe sole material itself.

In contrast, the use of fibers in the '302 application copies the use of fibers in the human foot and therefore would be, like the foot sole, integrally suspended within the other material of the shoe sole itself; that is, in typical existing athletic shoes, within the polyurethane (PU) or ethylvinylacetate (EVA). In other words, the use of fibers in the '302 application is analogous to fiberglass (but highly flexible). The '302 application was intended to encompass broadly any use of fiber suspended within shoe sole material to reinforce it, providing strength and flexibility; particularly the use of such fiber in the midsole and bottom sole, since use there copies the U shaped use of fiber in the human foot sole. The orientation of the fiber within the human foot sole structure is strictly determined by the shape of that structure, since the fibers would be lie within the intricate planar structures.

The '302 application specifies copying the specific structure of the foot sole as definitively described by Erich Blechschmidt in FOOT AND ANKLE, March, 1982. Like the human fiber, such shoe sole fiber should preferably be flexible and relatively inelastic.

FIGS. 11A-D shows the use of flexible and relatively inelastic fiber in the form of strands, woven or unwoven (such as pressed sheets), embedded in midsole and bottom sole material. Optimally, the fiber strands parallel (at least roughly) the plane surface of the wearer's foot sole in the naturally contoured design in FIGS. 11A-C and parallel the flat ground in FIG. 11D, which shows a section of conventional, uncontoured shoe sole. Fiber orientations at an angle to this parallel position will still provide improvement over conventional soles without fiber reinforcement, particularly if the angle is relatively small; however, very large angles or omni-directionality of the fibers will result in increased rigidity or increased softness.

Figure 11A:
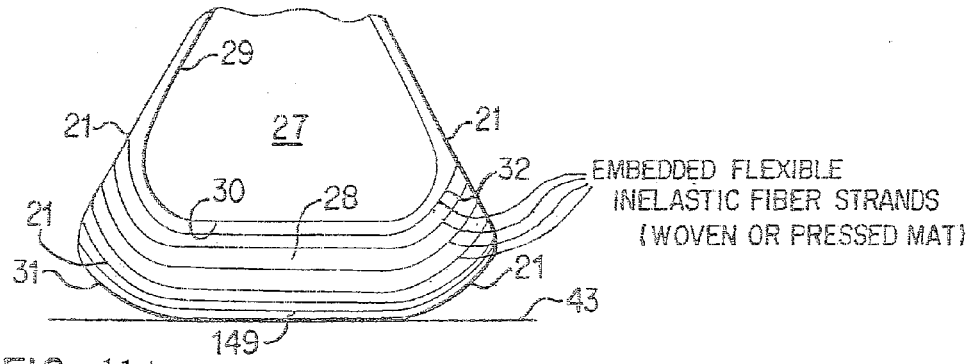
FIGS. 11A-D show the use of flexible and relatively inelastic fiber in the form of strands, woven or unwoven (such as pressed sheets), embedded in midsole and bottom sole material.
Figure 11B:
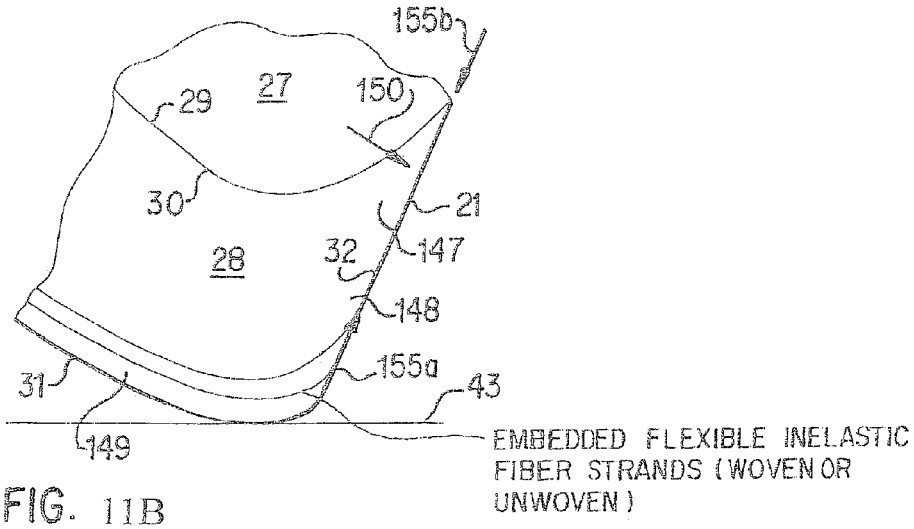
Figure 11C:
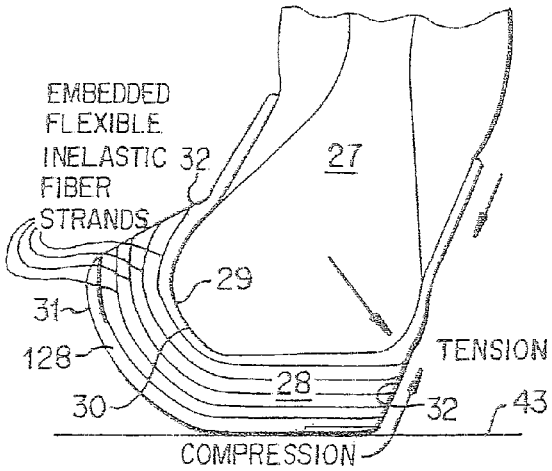
Figure 11D:
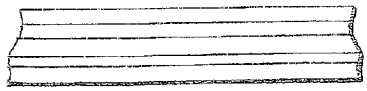

This preferred orientation of the fiber strands, parallel to the plane of the wearer's foot sole, allows for the shoe sole to deform to flatten in parallel with the natural flattening of the foot sole under pressure. At the same time, the tensile strength of the fibers resist the downward pressure of body weight that would normally squeeze the shoe sole material to the sides, so that the side walls of the shoe sole will not bulge out (or will do so less so). The result is a shoe sole material that is both flexible and firm. This unique combination of functional traits is in marked contrast to conventional shoe sole materials in which increased flexibility unavoidably causes increased softness and increased firmness also increases rigidity. FIG. 11A is a modification of FIG. 5A, FIG. 11B is FIG. 6 modified, FIG. 11C is FIG. 7 modified, and FIG. 11D is entirely new. The position of the fibers shown would be the same even if the shoe sole material is made of one uniform material or of other layers than those shown here.

The use of the fiber strands, particularly when woven, provides protection against penetration by sharp objects, much like the fiber in radial automobile tires. The fiber can be of any size, either individually or in combination to form strands; and of any material with the properties of relative inelasticity (to resist tension forces) and flexibility. The strands of fiber can be short or long, continuous or discontinuous. The fibers facilitate the capability of any shoe sole using then to be flexible but hard under pressure, like the foot sole.

It should also be noted that the fibers used in both the cover of insoles and the Dellinger Web is knit or loosely braided rather than woven, which is not preferred, since such fiber strands are designed to stretch under tensile pressure so that their ability to resist sideways deformation would be greatly reduced compared to non-knit fiber strands that are individually (or in twisted groups of yarn) woven or pressed into sheets.

Figure 12A:
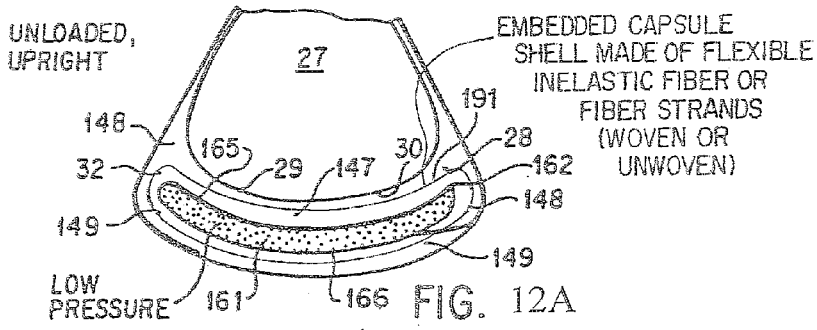
FIGS. 12A-D are FIGS. 9A-D modified to show the use of flexible inelastic fiber or fiber strands, woven or unwoven (such as pressed) to make an embedded capsule shell that surrounds the cushioning compartment 161 containing a pressure-transmitting medium like gas, gel, or liquid.
Figure 12B:
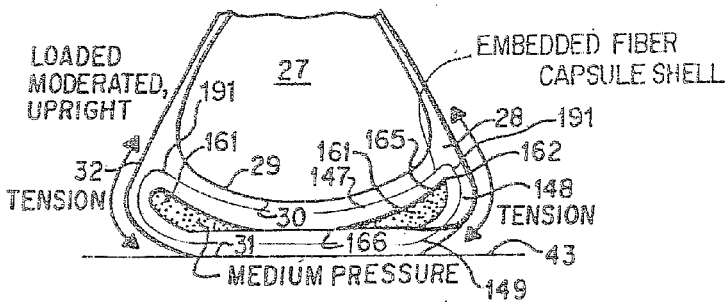
Figure 12C:
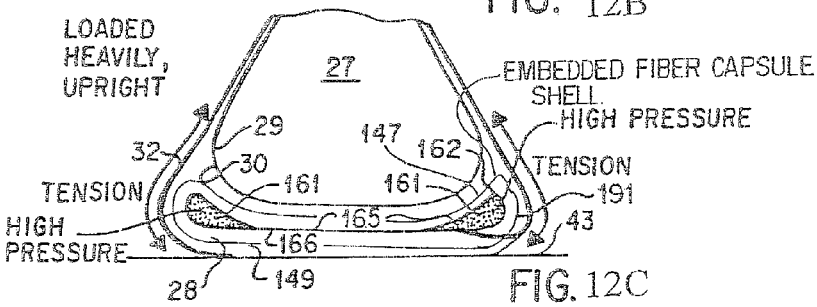
Figure 12D:
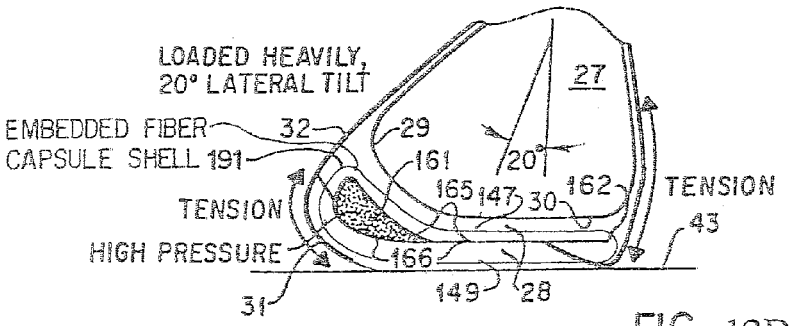
Figure 12E:
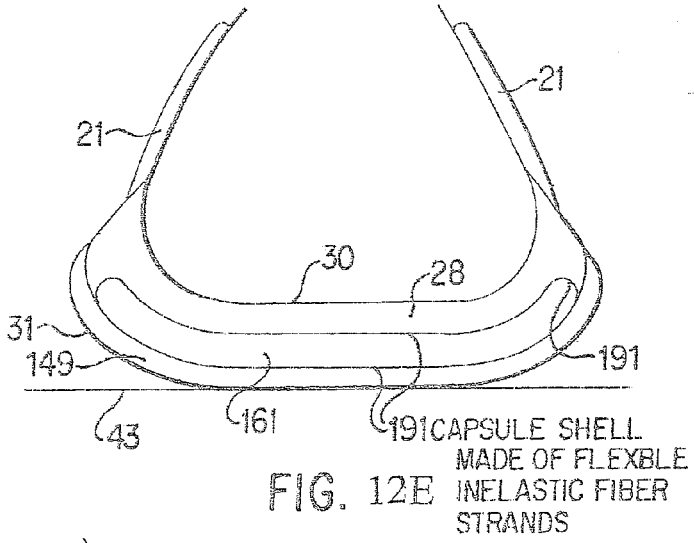
FIG. 12 E shows the use of a fibrous capsule shell that directly envelopes the surface of a cushioning compartment and FIG. 12F shows an upper surface and lower surface containing the cushioning compartment.

FIGS. 12A-D are FIGS. 9A-D modified to show the use of flexible inelastic fiber or fiber strands, woven or unwoven (such as pressed) to make an embedded capsule shell that surrounds the cushioning compartment 161 containing a pressure-transmitting medium like gas, gel, or liquid. The fibrous capsule shell could also directly envelope the surface of the cushioning compartment, which is easier to construct, especially during assembly. FIG. 12E is a new figure showing a fibrous capsule shell 191 that directly envelopes the surface of a cushioning compartment 161; the shoe sole structure is not fully contoured, like FIG. 12A, but naturally contoured, like FIG. 10 of the '870 application, which has a flat middle portion corresponding to the flattened portion of a wearer's load-bearing foot sole.

Figure 12F:
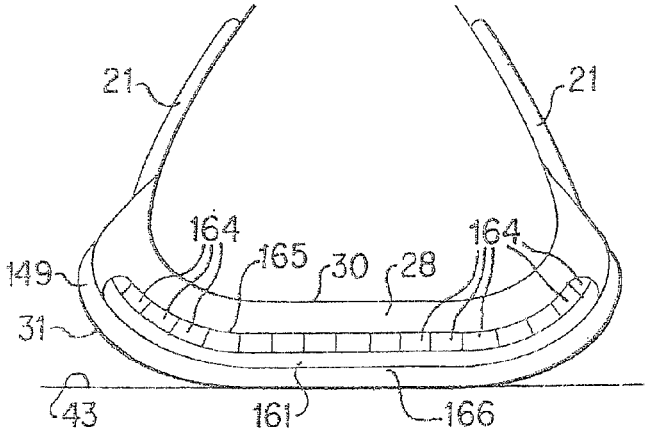

FIG. 12F shows a unique combination of the FIGS. 9&10 design of the applicant's '302 application. The upper surface 165 and lower surface 166 contain the cushioning compartment 161, which is subdivided into two parts. The lower half of the cushioning compartment 161 is both structured and functions like the compartment shown in FIG. 9 of the '302 application. The upper half is similar to FIG. 10 of the '302 application but subdivided into chambers 164 that are more geometrically regular so that construction is simpler; the structure of the chambers 164 can be of honeycombed in structure. The advantage of this design is that it copies more closely than the FIG. 9 design the actual structure of the wearer's foot sole, while being much more simple to construct than the FIG. 10 design. Like the wearer's foot sole, the FIG. 12F design would be relative soft and flexible in the lower half of the chamber 161, but firmer and more protective in the upper half, where the mini-chambers 164 would stiffen quickly under load-bearing pressure. Other multi-level arrangements are also possible.

Figure 13E:
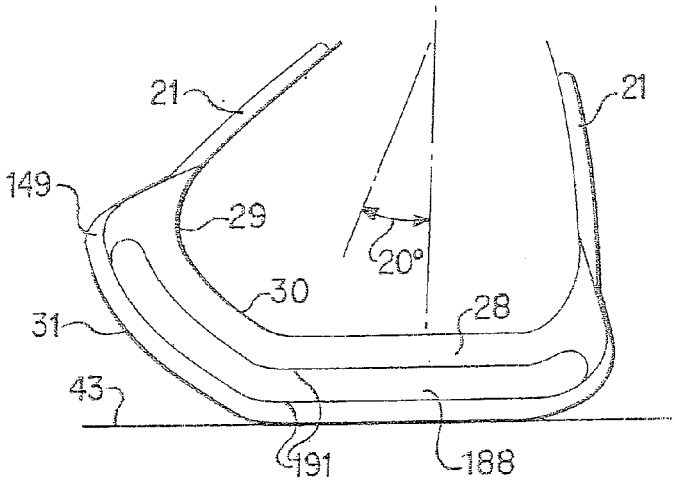
FIG. 13E is a new figure showing a frontal plane cross section of a fibrous capsule shell 191 that directly envelopes the surface of the midsole section 188.
Figure 13B:
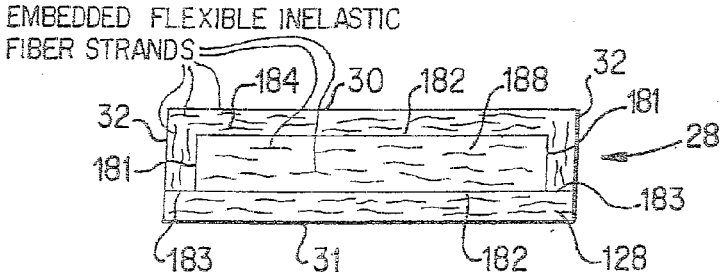
FIGS. 13A-D are FIGS. 9A-D of the '870 application similarly modified to show the use of embedded flexible inelastic fiber or fiber strands, woven or unwoven, in various embodiments similar those shown in FIGS. 11A-D.
Figure 13C:
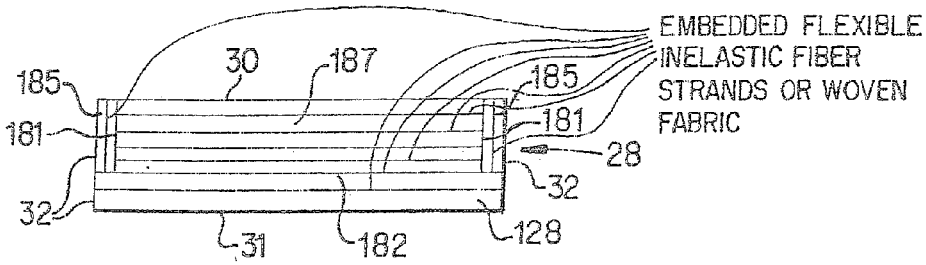
Figure 13A:
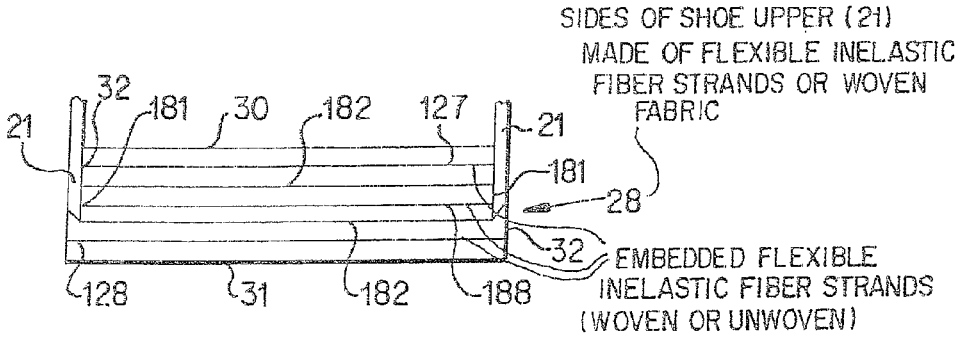
Figure 13D:
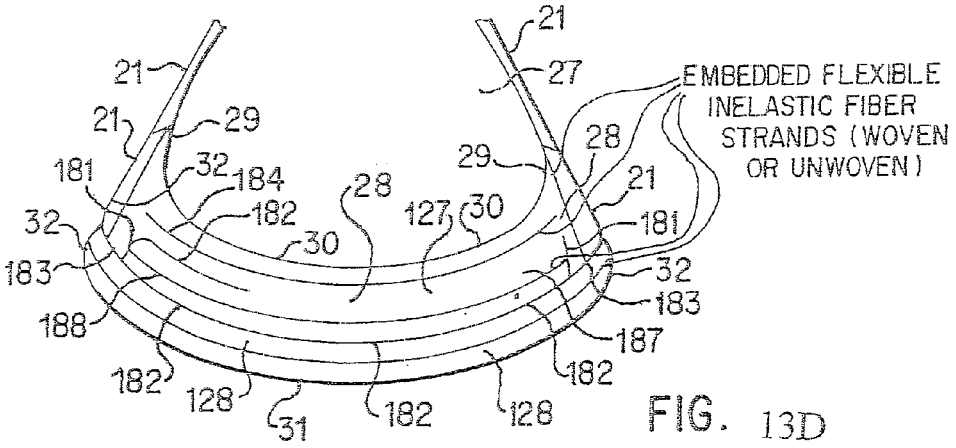

FIGS. 13A-D are FIGS. 9A-D of the '870 application similarly modified to show the use of embedded flexible inelastic fiber or fiber strands, woven or unwoven, in various embodiments similar those shown in FIGS. 11A-D. FIG. 13E is a new figure showing a frontal plane cross section of a fibrous capsule shell 191 that directly envelopes the surface of the midsole section 188.

Figure 14A:
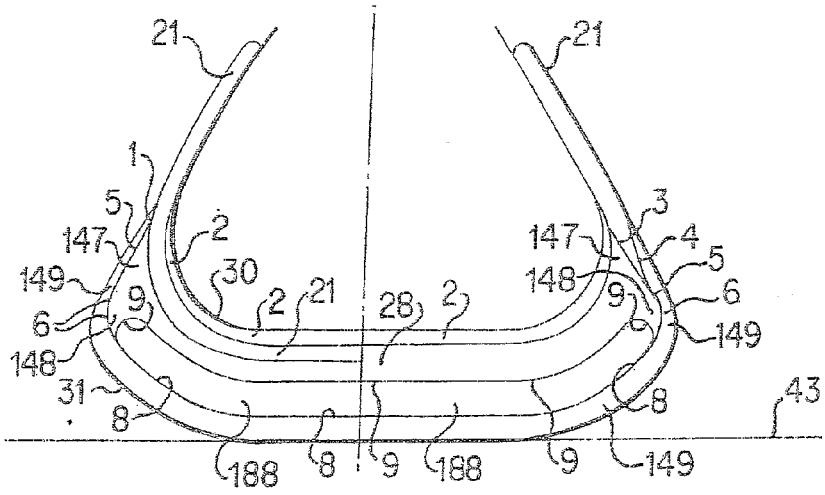
FIGS. 14A-B show, in frontal plane cross section at the heel area, shoe sole structures like FIGS. 5A-B, but in more detail and with the bottom sole 149 extending relatively farther up the side of the midsole.
Figure 14B:
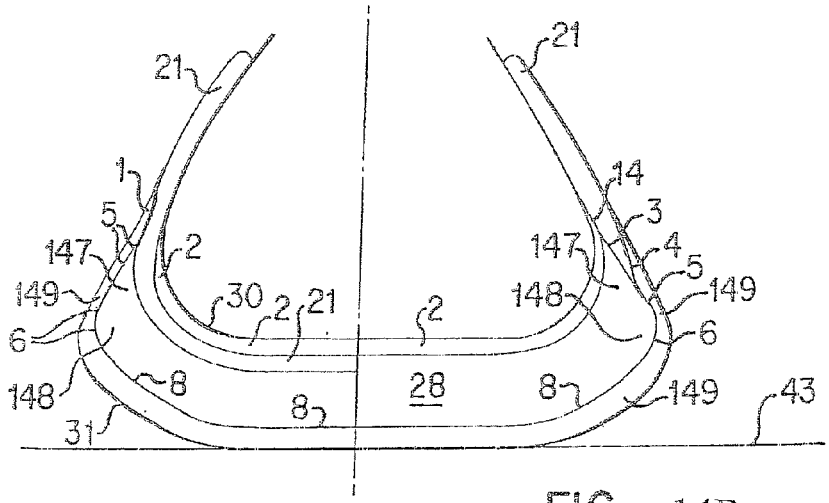

FIGS. 14A-B show, in frontal plane cross section at the heel area, shoe sole structures like FIGS. 5A-B, but in more detail and with the bottom sole 149 extending relatively farther up the side of the midsole.

The right side of FIGS. 14A-B show the preferred embodiment, which is a relatively thin and tapering portion of the bottom sole extending up most of the midsole and is attached to the midsole and to the shoe upper 21, which is also attached preferably first to the upper midsole 147 where both meet at 3 and then attached to the bottom sole where both meet at 4. The bottom sole is also attached to the upper midsole 147 where they join at 5 and to the lower midsole 148 at 6.

The left side of FIGS. 14A-B show a more conventional attachment arrangement, where the shoe sole is attached to a fully lasted shoe upper 21. The bottom sole 149 is attached to: the lower midsole 148 where their surfaces coincide at 6, the upper midsole 147 at 5, and the shoe upper 21 at 7.

FIG. 14A shows a shoe sole like FIG. 9D of the '870 application, but with a completely encapsulated section 188 like FIGS. 9A&B of that application; the encapsulated section 188 is shown bounded by the bottom sole 149 at line 8 and by the rest of the midsole 147 and 148 at line 9. FIG. 14A shows more detail than prior figures, including an insole (also called sockliner) 2, which is contoured to the shape of the wearer's foot sole, just like the rest of the shoe sole, so that the foot sole is supported throughout its entire range of sideways motion, from maximum supination to maximum pronation.

The insole 2 overlaps the shoe upper 21 at 14; this approach ensures that the load-bearing surface of the wearer's foot sole does not come in contact with any seams which could cause abrasions. Although only the heel section is shown in this figure, the same insole structure would preferably be used elsewhere, particularly the forefoot; preferably, the insole would coincide with the entire load-bearing surface of the wearer's foot sole, including the front surface of the toes, to provide support for front-to-back motion as well as sideways motion.

The FIG. 14 design, like the FIG. 9 designs of both the '302 and '870 applications, provides firm flexibility by encapsulating fully or partially, roughly the middle section of the relatively thick heel of the shoe sole (or of other areas of the sole, such as any or all of the essential support elements of the foot, including the base of the fifth metatarsal, the heads of the metatarsals, and the first distal phalange). The outer surfaces of that encapsulated section or sections are allowed to move relatively freely by not gluing the encapsulated section to the surrounding shoe sole.

Firmness in the FIG. 14 design is provided by the high pressure created under multiples of body weight loads during locomotion within the encapsulated section or sections, making it relatively hard under extreme pressure, roughly like the heel of the foot. Unlike conventional shoe soles, which are relatively inflexible and thereby create local point pressures, particularly at the outside edge of the shoe sole, the FIG. 14 design tends to distribute pressure evenly throughout the encapsulated section, so the natural biomechanics of the wearer's foot sole are maintained and shearing forces are more effectively dealt with.

In the FIG. 14A design, firm flexibility is provided by providing by encapsulating roughly the middle section of the relatively thick heel of the shoe sole or other areas of the sole, while allowing the outer surfaces of that section to move relatively freely by not conventionally gluing the encapsulated section to the surrounding shoe sole. Firmness is provided by the high pressure created under body weight loads within the encapsulated section, making it relatively hard under extreme pressure, roughly like the heel of the foot, because it is surrounded by flexible but relatively inelastic materials, particularly the bottom sole 149 (and connecting to the shoe sole upper, which also can be constructed by flexible and relatively inelastic material. The same U structure is thus formed on a macro level by the shoe sole that is constructed on a micro level in the human foot sole, as described definitively by Erich Blechschmidt in Foot and Ankle, March, 1982.

In summary, the FIG. 14A design shows a shoe construction for a shoe, comprising: a shoe sole with at least one compartment under the structural elements of the human foot; the compartment containing a pressure-transmitting medium composed of an independent section of midsole material that is not firmly attached to the shoe sole surrounding it; pressure from normal load-bearing is transmitted progressively at least in part to the relatively inelastic sides, top and bottom of said shoe sole compartment, producing tension. The FIG. 14A design can be combined with those of FIGS. 11-13 so that the compartment is surrounded by a reinforcing layer of relatively flexible and inelastic fiber.

FIGS. 14A-B shows constant shoe sole thickness in frontal plane cross sections, but that thickness can vary somewhat (up to roughly 25% in some cases) in frontal plane cross sections, as previously specified in the '478 application.

FIG. 14B shows a design just like FIG. 14A, except that the encapsulated section is reduced to only the load-bearing boundary layer between the lower midsole 148 and the bottom sole 149. In simple terms, then, most or all of the upper surface of the bottom sole and the lower surface of the midsole are not attached, or at least not firmly attached, where they coincide at line 8; the bottom sole and midsole are firmly attached only along the non-load-bearing sides of the midsole. This approach is simple and easy. The load-bearing boundary layer 8 like the internal horizontal sipe described in the applicant's U.S. application Ser. No. 07/539,870, filed 16 Jun. 1990.

The sipe area 8 can be unglued, so that relative motion between the two surfaces is controlled only by their structural attachment together at the sides. In addition, the sipe area can be lubricated to facilitate relative motion between surfaces or lubricated a viscous liquid that restricts motion. Or the sipe area 8 can be glued with a semi-elastic or semi-adhesive glue that controls relative motion but still permits some; the semi-elastic or semi-adhesive glue would then serve a shock absorption function as well. Using the broad definition of shoe sole sipes established in earlier applications, the sipe can be a channel filled with flexible material like that shown in FIG. 5 of the applicant's '579 application or can be simply a thinner chamber than that shown in FIG. 9 of the '302 application.

In summary, the FIG. 14B design shows a shoe construction for a shoe, comprising: a shoe upper and a shoe sole that has a bottom portion with sides that are relatively flexible and inelastic; at least a portion of the bottom sole sides firmly attach directly to the shoe upper; shoe upper that is composed of material that is flexible and relatively inelastic at least where the shoe upper is attached to the bottom sole; the attached portions enveloping the other sole portions of the shoe sole; and the shoe sole having at least one horizontal sipe that is contained internally within the shoe sole. The FIG. 14B design can be combined with FIGS. 11-13 to include a shoe sole bottom portion composed of material reinforced with at least one fiber layer that is relatively flexible and inelastic and that is oriented in the horizontal plane.

Figure 15:
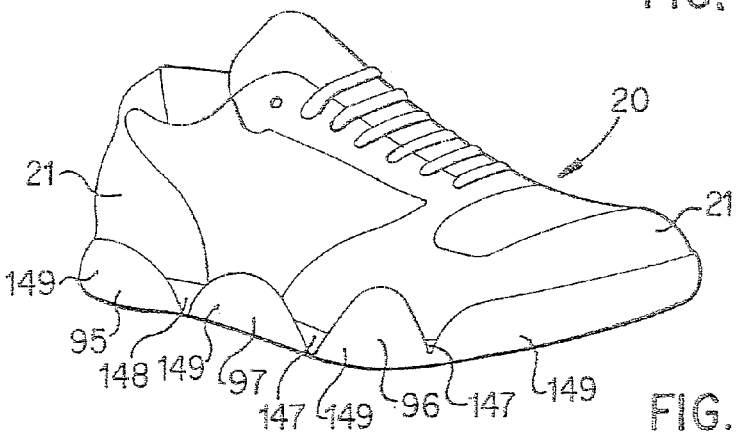
FIG. 15 shows a perspective view (the outside of a right shoe) of a conventional flat shoe 20 with the FIG. 14A design for attachment of the shoe sole bottom to the shoe upper.

The design shown in FIG. 15 is flat, conforming to the shape of the ground like a more conventional shoe sole, but otherwise retains the side structures described in FIGS. 14 A-B and retains the unattached boundary layer between the bottom sole 149 and midsole 148. FIG. 15 shows a perspective view (the outside of a right shoe) of a flat shoe 20 incorporating the FIG. 14A design for the attachment of the bottom sole to the shoe upper. Outwardly the shoe appears to be conventional, with portions of the bottom sole 149 wrapped up around and attached to the sides of the lower midsole 148 and upper midsole 147; the bottom sole 149 also wraps around and is attached to the shoe upper 21, like the structure of FIG. 5B, but applied to a flat conventional shoe sole. The bottom sole 149 is shown wrapping around the shoe midsole and upper at the calcaneus 95, the base of the fifth metatarsal 97, the head of the fifth metatarsal 96, and the toe area. The same bottom sole wrapping approach can of course be used with the applicant's FIG. 5 design and his other contoured shoe sole designs.

FIGS. 16A-D are FIGS. 9A-D from the applicant's U.S. application Ser. No. 07/539,870 filed 18 Jun. 1990 and show a series of conventional shoe sole cross sections in the frontal plane at the heel utilizing both sagittal plane and horizontal plane sipes, and in which some or all of the sipes do not originate from any outer shoe sole surface, but rather are entirely internal. Relative motion between internal surfaces is thereby made possible to facilitate the natural deformation of the shoe sole. The intent of the general invention shown in FIG. 16 is to create a similar but simplified and more conventional version of the some of the basic principles used in the unconventional and highly anthropomorphic invention shown in FIGS. 9 and 10 of the prior application No. '302, so that the resulting functioning is similar.

Figure 16B:
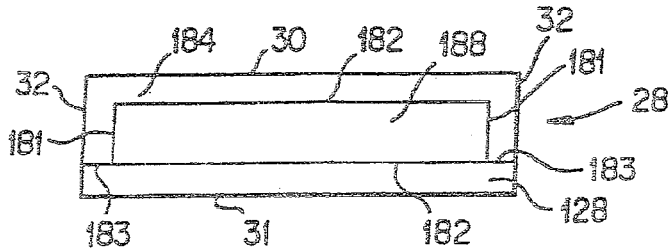
FIGS. 16A-D are FIGS. 9A-D of the applicant's U.S. application Ser. No. 07/539,870 filed 18 June 1990, with several minor technical corrections, and show a series of conventional shoe sole cross-sections in the frontal plane at the heel utilizing both sagittal plane and horizontal plane sipes, and in which some or all of the sipes do not originate from any outer shoe sole surface, but rather are entirely internal.
Figure 16C:
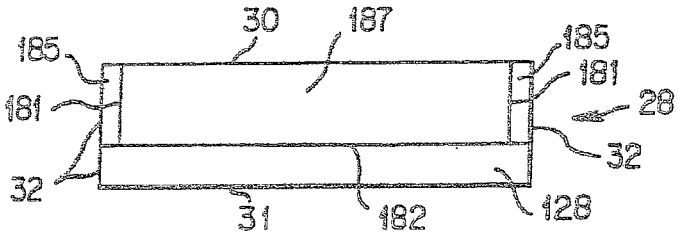
Figure 16A:
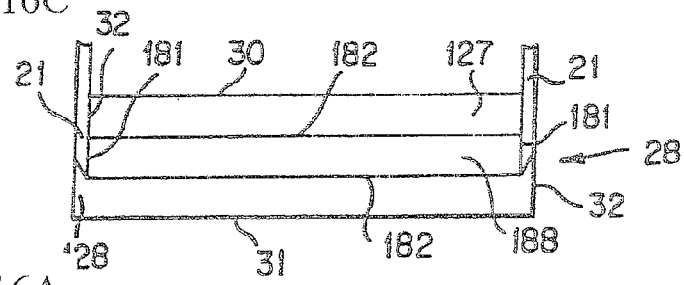
Figure 17:
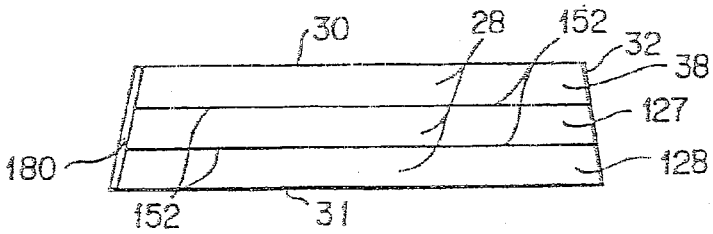
FIG. 17 is FIG. 6C of the '870 application showing a frontal plane cross section at the heel of a conventional shoe with a sole that utilizes both horizontal and sagittal plane slits.

FIG. 16A shows a group of three lamination layers, but unlike FIG. 17 (FIG. 6C of the '870 application) the central layer 188 is not glued to the other surfaces in contact with it; those surfaces are internal deformation slits in the sagittal plane 181 and in the horizontal plane 182, which encapsulate the central layer 188, either completely or partially. The relative motion between lamination layers at the deformation slits 181 and 182 can be enhanced with lubricating agents, either wet like silicone or dry like teflon, of any degree of viscosity; shoe sole materials can be closed cell if necessary to contain the lubricating agent or a non-porous surface coating or layer can be applied. The deformation slits can be enlarged to channels or any other practical geometric shape as sipes defined in the broadest possible terms.

The relative motion can be diminished by the use of roughened surfaces or other conventional methods of increasing the coefficient of friction between lamination layers. If even greater control of the relative motion of the central layer 188 is desired, as few as one or many more points can be glued together anywhere on the internal deformation slits 181 and 182, making them discontinuous; and the glue can be any degree of elastic or inelastic.

In FIG. 16A, the outside structure of the sagittal plane deformation sipes 181 is the shoe upper 21, which is typically flexible and relatively inelastic fabric or leather. In the absence of any connective outer material like the shoe upper shown in FIG. 16A or the elastic edge material 180 of FIG. 17, just the outer edges of the horizontal plane deformation sipes 182 can be glued together.

FIG. 16B shows another conventional shoe sole in frontal plane cross-section at the heel with a combination similar to FIG. 16A of both horizontal and sagittal plane deformation sipes that encapsulate a central section 188. Like FIG. 16A, the FIG. 16B structure allows the relative motion of the central section 188 with its encapsulating outer midsole section 184, which encompasses its sides as well as the top surface, and bottom sole 128, both of which are attached at their common boundaries 183.

This FIG. 16B approach is analogous to that in FIG. 9 of the prior application No. '302 and this application, which is the applicant's fully contoured shoe sole invention with an encapsulated midsole chamber of a pressure-transmitting medium like silicone; in this conventional shoe sole case, however, the pressure-transmitting medium is a more conventional section of typical shoe cushioning material like PV or EVA, which also provides cushioning.

FIG. 16C is also another conventional shoe sole in frontal plane cross section at the heel with a combination similar to FIGS. 16A and 16B of both horizontal and sagittal plane deformation sipes. However, instead of encapsulating a central section 188, in FIG. 16C an upper section 187 is partially encapsulated by deformation sipes so that it acts much like the central section 188, but is more stable and more closely analogous to the actual structure of the human foot.

That structure was applied to shoe sole structure in FIG. 10 of prior application No. '302 and this application; the upper section 187 would be analogous to the integrated mass of fatty pads, which are U shaped and attached to the calcaneus or heel bone; similarly, the shape of the deformation sipes is U shaped in FIG. 16C and the upper section 187 is attached to the heel by the shoe upper, so it should function in a similar fashion to the aggregate action of the fatty pads. The major benefit of the FIG. 16C invention is that the approach is so much simpler and therefore easier and faster to implement than the highly complicated anthropomorphic design shown FIG. 10 of '302 and this application.

An additional note on FIG. 16C: the midsole sides 185 are like the side portion of the encapsulating midsole 184 in FIG. 16B.

Figure 16D:
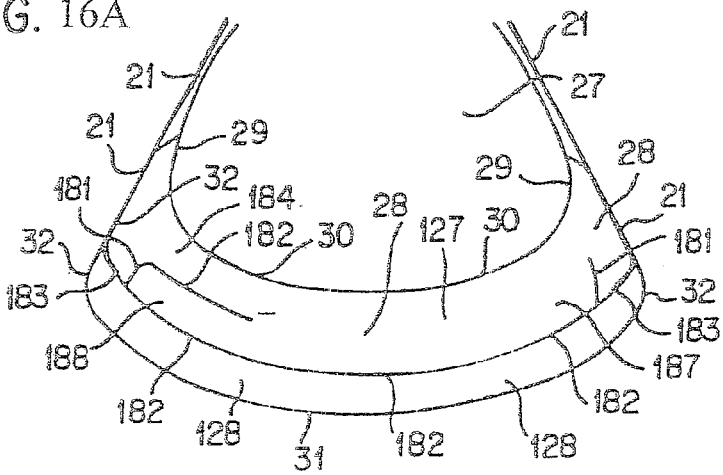

FIG. 16D shows in a frontal plane cross section at the heel a similar approach applied to the applicant's fully contoured design. FIG. 16D is like FIG. 9A of prior application No. '302 and this application, with the exception of the encapsulating chamber and a different variation of the attachment of the shoe upper to the bottom sole.

The left side of FIG. 16D shows a variation of the encapsulation of a central section 188 shown in FIG. 16B, but the encapsulation is only partial, with a center upper section of the central section 188 either attached or continuous with the upper midsole equivalent of 184 in FIG. 16B.

The right side of FIG. 16D shows a structure of deformation sipes like that of FIG. 16C, with the upper midsole section 187 provided with the capability of moving relative to both the bottom sole and the side of the midsole. The FIG. 16D structure varies from that of FIG. 16C also in that the deformation sipe 181 in roughly the sagittal plane is partial only and does not extend to the upper surface 30 of the midsole 127, as does FIG. 16C.

FIG. 17 is FIG. 6C of the '870 application and shows, in frontal plane cross section at the heel, a similar conventional shoe sole structure horizontal plane deformation sipes 152 extending all the way from one side of the shoe sole to the other side, either coinciding with lamination layers—heel wedge 38, midsole 127, and bottom sole 128—in older methods of athletic shoe sole construction or molded in during the more modern injection molding process. The point of the FIG. 17 design is that, if the laminated layers which are conventionally glued together in a rigidly fixed position can instead undergo sliding motion relative to each other, then they become flexible enough to conform to the ever changing shape of the foot sole in motion while at the same time continuing to provide about the same degree of necessary direct structural support.

Such separated lamination layers would be held together only at the outside edge by a layer of elastic material or fabric 180 bonded to the lamination layers 38, 127 and 128, as shown on the left side of FIG. 17. The elasticity of the edge layer 180 should be sufficient to avoid inhibiting significantly the sliding motion between the lamination layers. The elastic edge layer 180 can also be used with horizontal deformation slits 152 that do not extend completely across the shoe sole, like those of FIGS. 6A and 6B of the '870 application, and would be useful in keeping the outer edge together, keeping it from flapping down and catching on objects, thus avoiding tripping. The elastic layer 180 can be connected directly to the shoe upper, preferably overlapping it.

Figure 18:
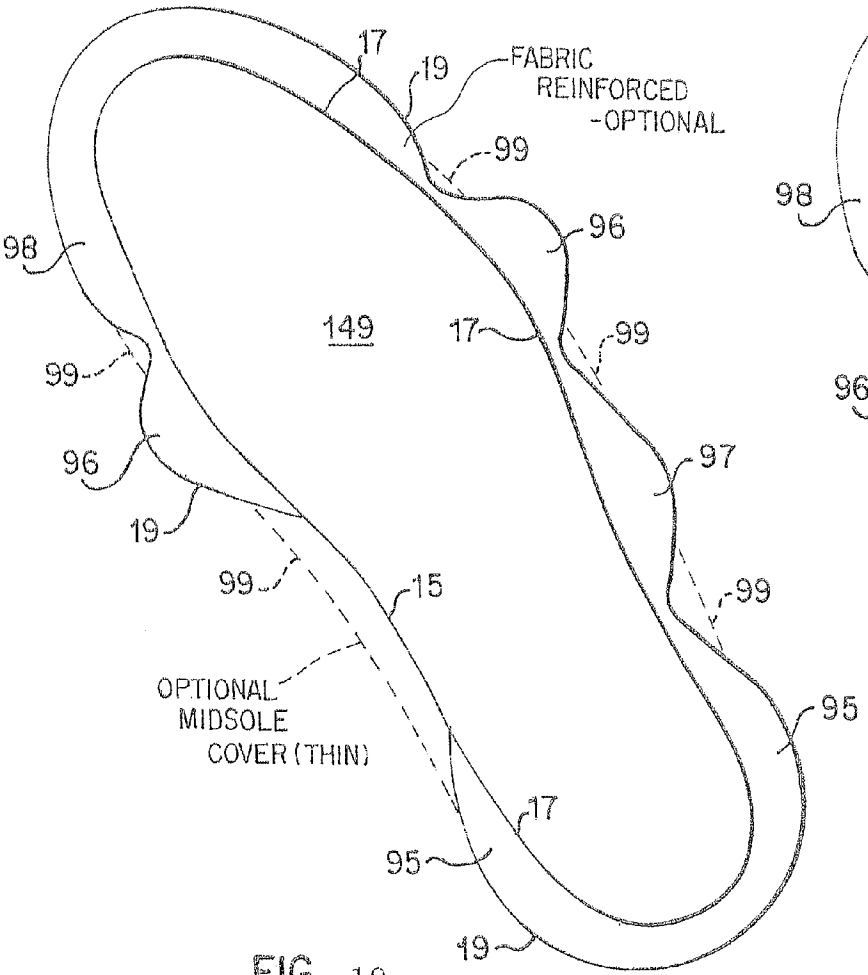
FIG. 18 shows the upper surface of the bottom sole 149 (unattached) of the right shoe shown in perspective in FIG. 15.

The deformation slit structures shown in conventional shoe soles in FIG. 18 can also be applied to the applicant's quadrant sides, naturally contoured sides and fully contoured sides inventions, including those with greater or lesser side thickness, as well as to other shoe sole structures in his other prior applications already cited.

If the elastic edge layer 180 is not used, or in conjunction with its use, the lamination layers can be attached with a glue or other connecting material of sufficient elasticity to allow the shoe sole to deformation naturally like the foot.

FIG. 18 shows the upper surface of the bottom sole 149 (unattached) of the right shoe shown in perspective in FIG. 15. The bottom sole can be conventional, with a flat section surrounded by the border 17 and with sides that attach to the sides of the midsole in the calcaneus (heel) area 95, the base of the fifth metatarsal 97, the heads of the first and fifth metatarsal 96, and the toe area 98. The outer periphery of the bottom sole 148 is indicated by line 19. As stated before, the material of the bottom sole can be fabric reinforced. The sides can be continuous, as shown by the dashed lines 99, or with other areas enlarged or decreased, or merged; preferably, the sides will be, as shown, to support the essential structural support and propulsion elements, which were defined in the applicant's '667 application as the base and lateral tuberosity of the calcaneus 95, the heads of the metatarsals 96, and the base of the fifth metatarsal 97, and the head of the first distal phalange 98.

The bottom sole 149 of FIG. 18 can also be part of the applicant's naturally contoured shoe sole 28, wherein the border of the flat section would be the peripheral extent 36 of the load-bearing portion of the upright foot sole of the wearer and the sides of the shoe sole are contoured as defined in the applicant's '667 and '478 applications. The bottom sole 149 of FIG. 18 can also be used in the fully contoured versions described in FIG. 14 of the '667 application.

Figure 19:
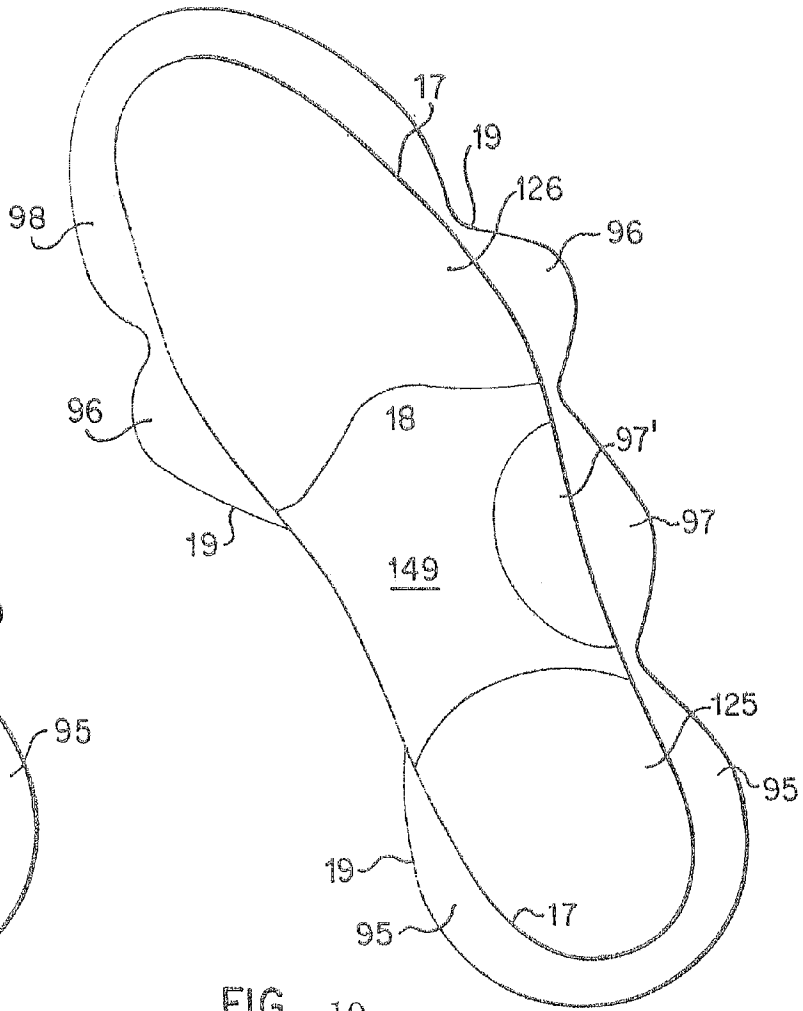
FIG. 19 shows the FIG. 18 bottom sole structure 149 with forefoot support area 126, the heel support area 125, and the base of the fifth metatarsal support area 97. Those areas would be unglued or not firmly attached as indicated in the FIG. 14 design shown preceding, while the sides and the other areas of the bottom sole upper surface would be glued or firmly attached to the midsole and shoe upper.

FIG. 19 shows the FIG. 18 bottom sole structure 149 with forefoot support area 126, the heel support area 125, and the base of the fifth metatarsal support area 97. Those areas would be unglued or not firmly attached as indicated in the FIG. 14 design shown preceding which uses sipes, while the sides and the other areas of the bottom sole upper surface would be glued or firmly attached to the midsole and shoe upper. Note that the general area indicated by 18, where metatarsal pads are typically positioned to support the second metatarsal, would be glued or firmly attached to provided extra support in that area similar to well supported conventional shoe soles and that the whole glued or firmly attached instep area functions much like a semi-rigid shank in a well supported conventional shoe sole. Note also that sipes can be slits or channels filled with flexible material and have been broadly defined in prior applications. A major advantage of the FIG. 19 design, and those of subsequent FIGS. 20-27, is that the shock-absorbing cushioning effect of the sole is significantly enhanced, so that less thickness and therefore weight is required.

Figure 20:
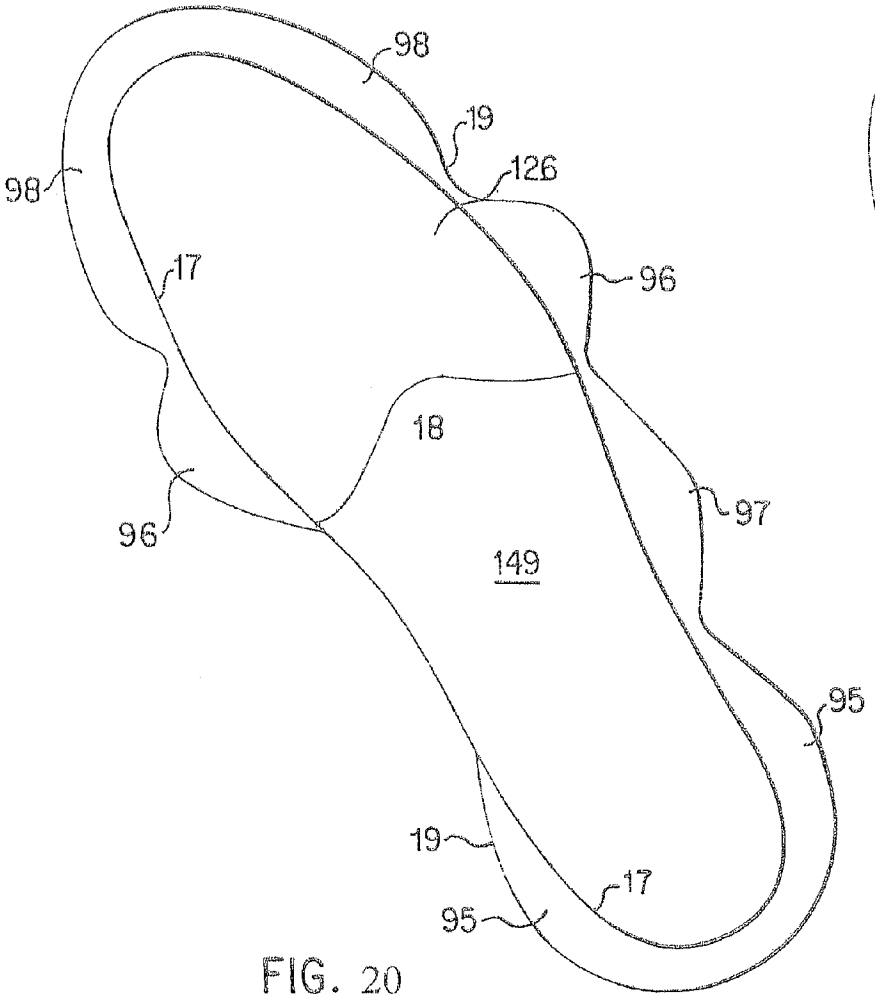
FIG. 20 shows a similar bottom sole structure 149, but with only the forefoot section 126 unglued or not firmly attached, with all (or at least most) the other portions glued or firmly attached.

FIG. 20 shows a similar bottom sole structure 149, but with only the forefoot section 126 unglued or not firmly attached, with all (or at least most) the other portions glued or firmly attached.

Figure 21:
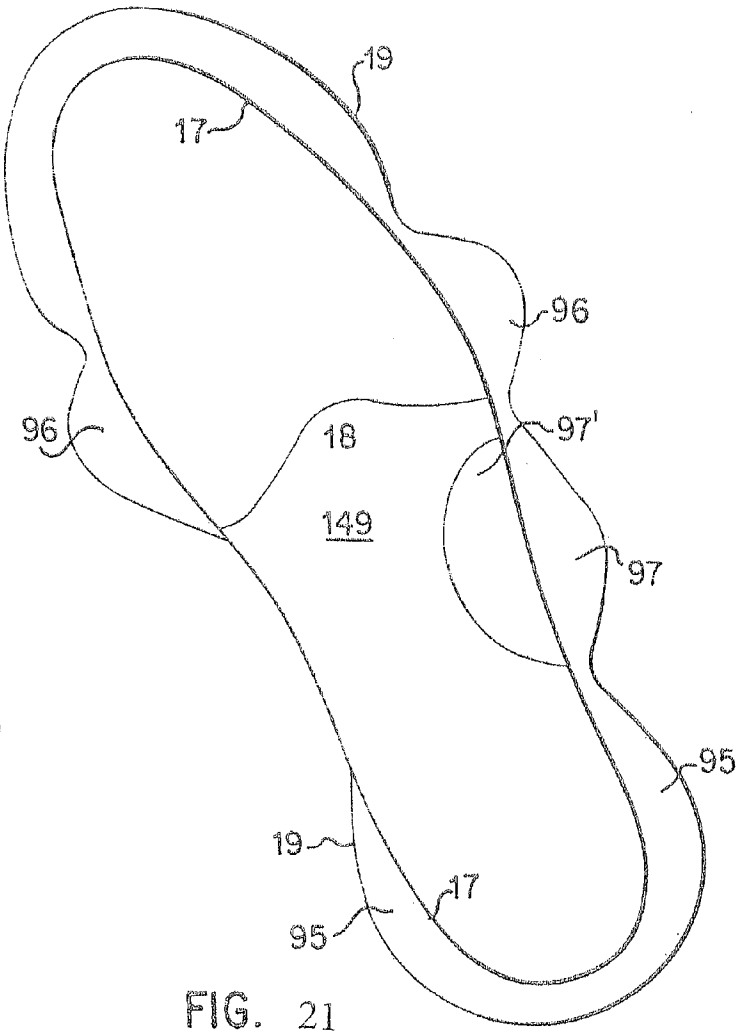
FIG. 21 shows a similar bottom sole structure 149, but with both the fore foot section 126 and the base of the fifth metatarsal section 97 unglued or not firmly attached, with all other portions (or at least most) glued or firmly attached.

FIG. 21 shows a similar bottom sole structure 149, but with both the fore foot section 126 and the base of the fifth metatarsal section 97 unglued or not firmly attached, with all other portions (or at least most) glued or firmly attached.

Figure 22:
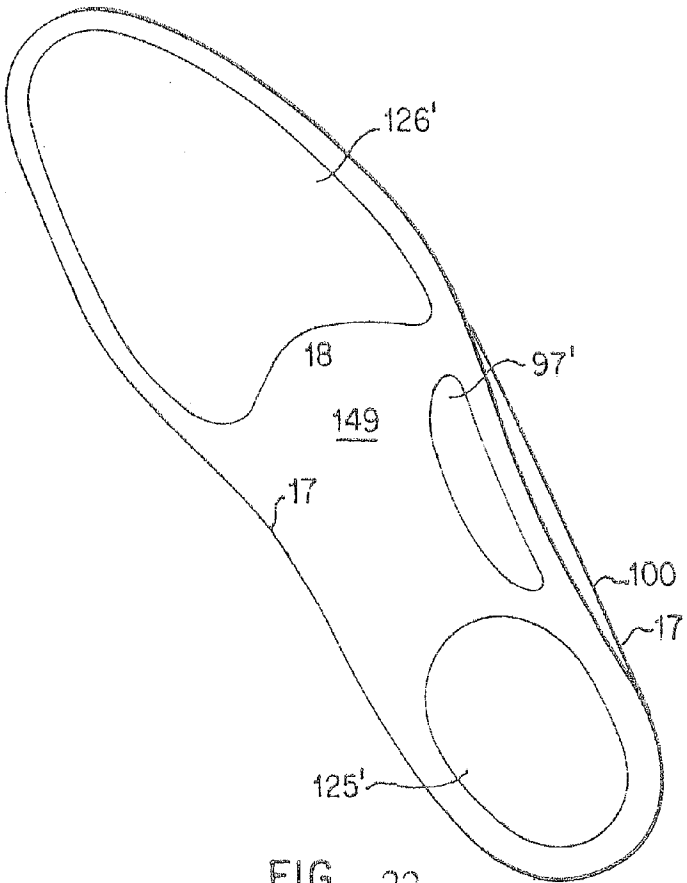
FIG. 22 shows a similar view of a bottom sole structure 149, but with no side sections, so that the design would be like that of FIG. 17.

FIG. 22 shows a similar view of a bottom sole structure 149, but with no side sections, so that the design would be like that of FIG. 17. The areas under the forefoot 126', heel 125', and base of the fifth metatarsal 97' would not be glued or attached firmly, while the other area (or most of it) would be glued or firmly attached. FIG. 22 also shows a modification of the outer periphery of the convention shoe sole 17: the typical indentation at the base of the fifth metatarsal is removed, replaced by a fairly straight line 100.

Figure 23:
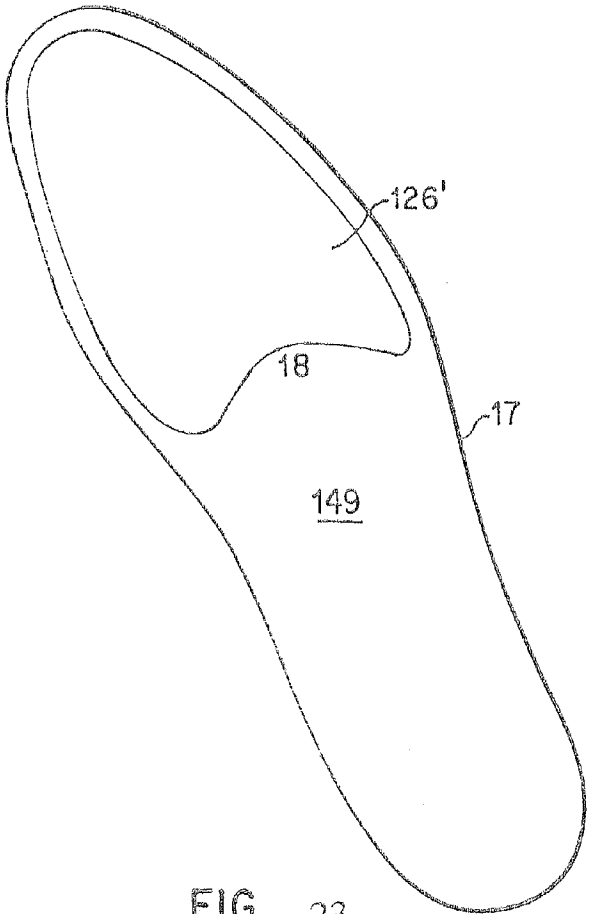
FIG. 23 shows a similar structure to FIG. 22, but with only the section under the forefoot 126 unglued or not firmly attached; the rest of the bottom sole 149 (or most of it) would be glued or firmly attached.

FIG. 23 shows a similar structure to FIG. 22, but with only the section under the forefoot 126 unglued or not firmly attached; the rest of the bottom sole 149 (or most of it) would be glued or firmly attached.

Figure 24:
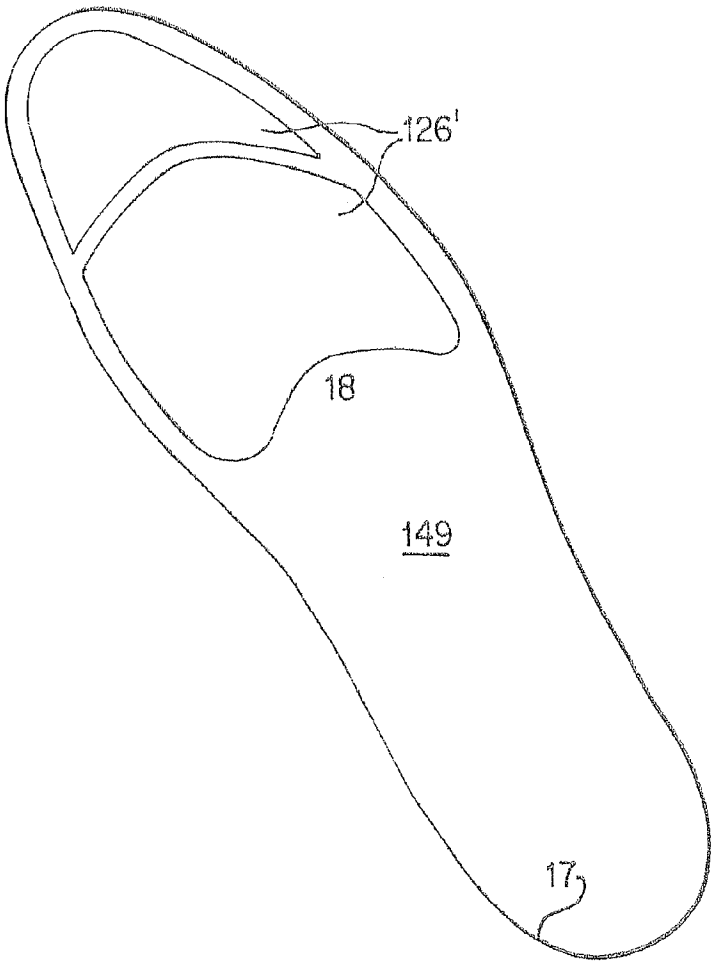
FIG. 24 shows a similar structure to FIG. 23, but with the forefoot area 126 subdivided into an area under the heads of the metatarsals and another area roughly under the heads of the phalanges.

FIG. 24 shows a similar structure to FIG. 23, but with the forefoot area 126 subdivided into an area under the heads of the metatarsals and another area roughly under the heads of the phalanges.

Figure 25:
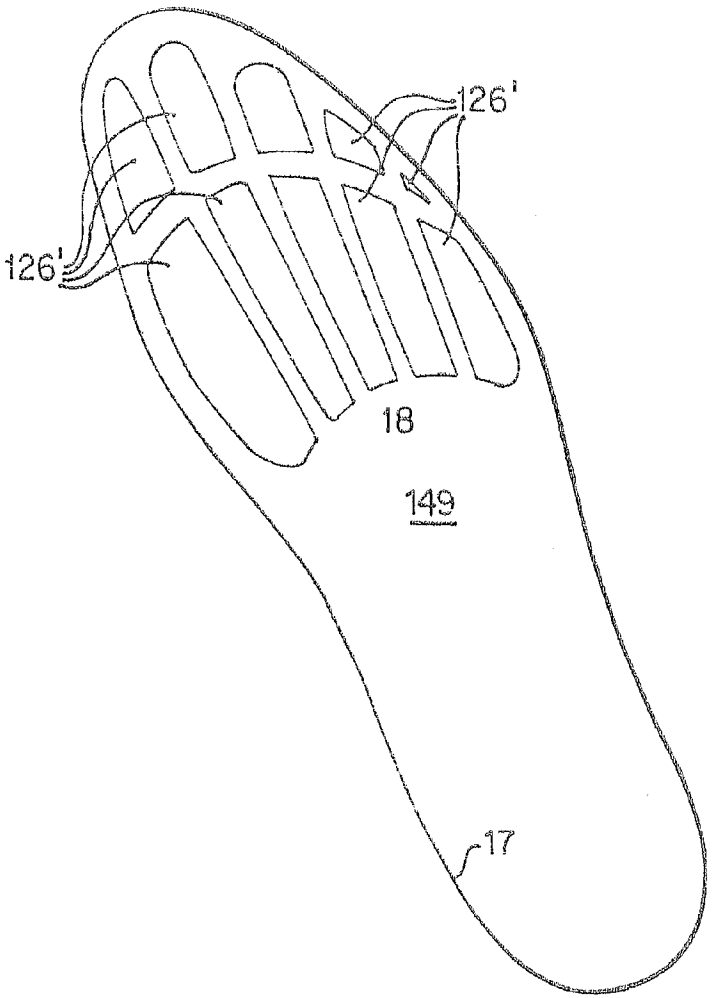
FIG. 25 shows a similar structure to FIG. 24, but with each of the two major forefoot areas further subdivided into individual metatarsal and individual phalange.

FIG. 25 shows a similar structure to FIG. 24, but with each of the two major forefoot areas further subdivided into individual metatarsal and individual phalange. Both this structure and that of FIG. 24 could be used with the FIG. 20 design.

Figure 26:
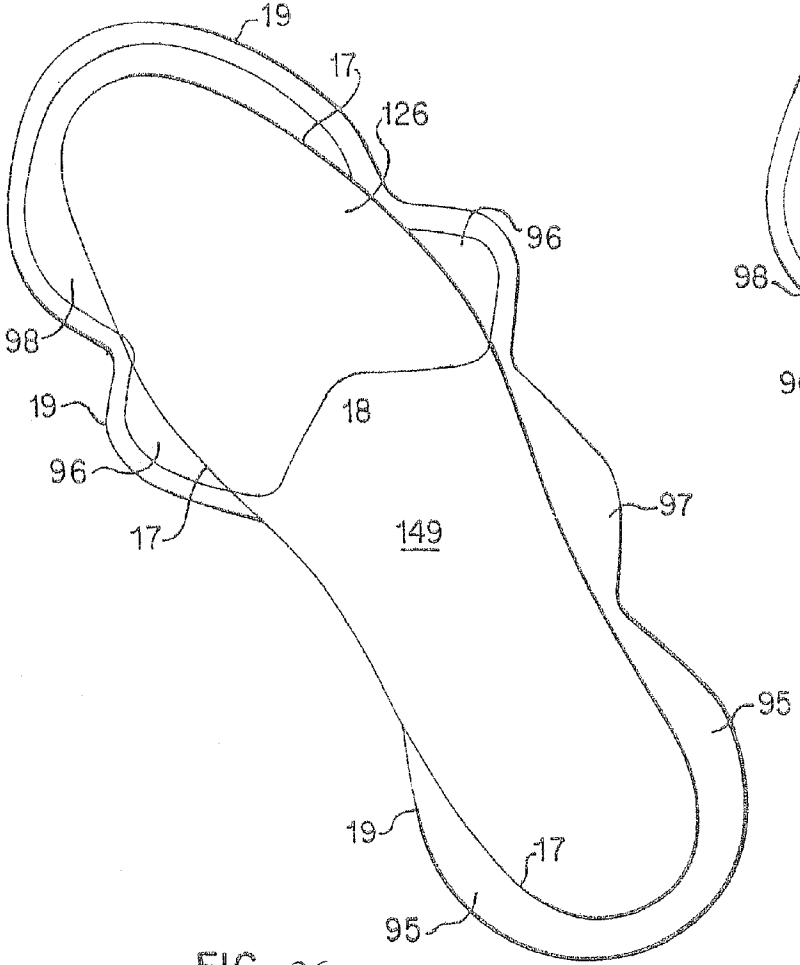
FIG. 26 shows a similar structure to FIG. 20, but with the forefoot area 126 enlarged beyond the border 15 of the flat section of the bottom sole. This structure corresponds to that shown in FIGS. 14A-B.

FIG. 26 shows a similar structure to FIG. 20, but with the forefoot area 126 enlarged beyond the border 17 of the flat section of the bottom sole. This structure corresponds to that shown in FIGS. 14 A-B, which show the unattached section 8 extending out through most of the contoured side. That structure has an important function, which is to facilitate the natural deformation of the shoe sole under weight bearing loads, so that it can flatten in parallel to the flattening of the wearer's foot sole under the same loads. The designs shown in FIGS. 19 and 21 could be modified according to the FIG. 26 structure.

Figure 27:
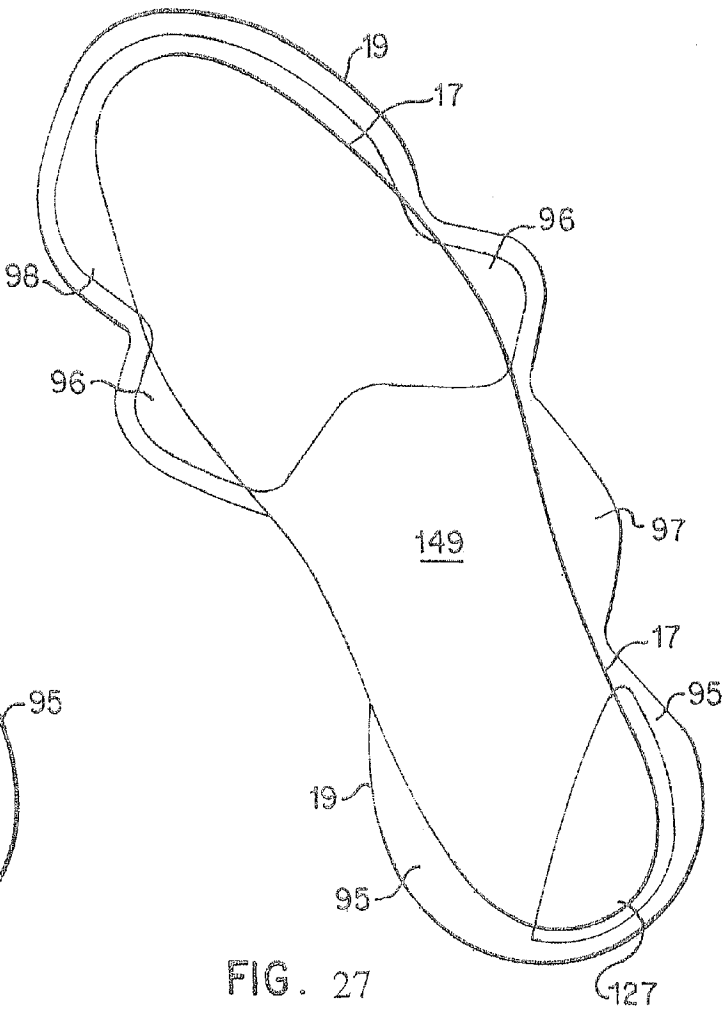
FIG. 27 shows a similar structure to FIG. 26, but with an additional section 127 in the heel area where outer sole wear is typically excessive.

FIG. 27 shows a similar structure to FIG. 26, but with an additional section 127 in the heel area where outer sole wear is typically excessive. It should be noted that many other configurations of glued and unglued areas (or firmly and not firmly attached) are possible that would be improvements over existing shoe sole structures, but are not shown due to their number.

Figure 28A:
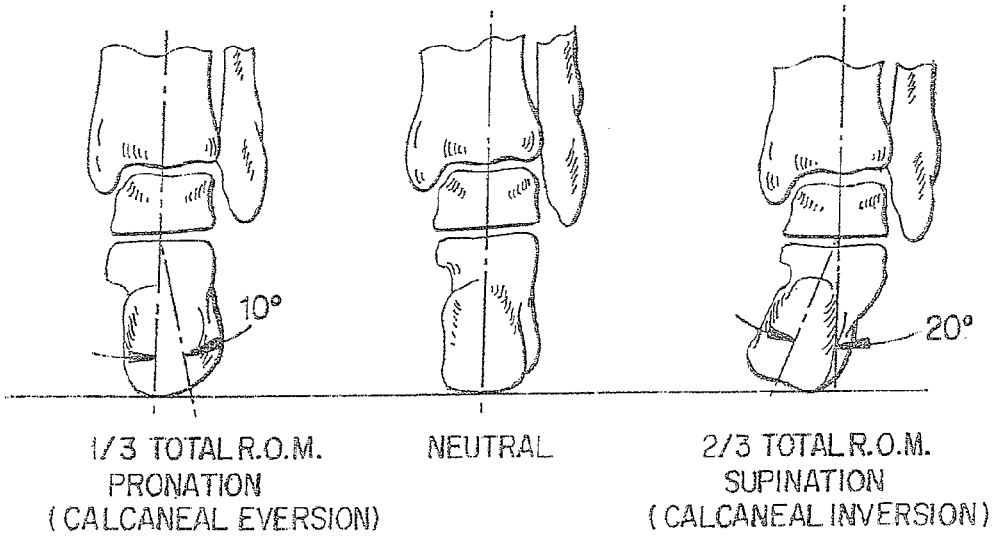
FIGS. 28A-B show the full range of sideways motion of the foot.
Figure 28B:
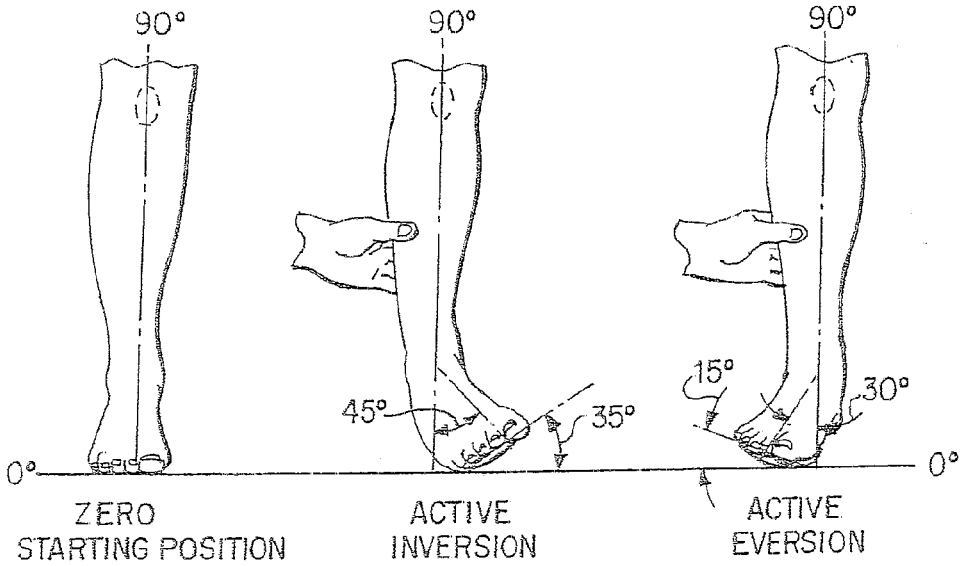

FIGS. 28A-B show the full range of sideways motion of the foot. FIG. 28A shows the range in the calcaneal or heel area, where the range is determined by the subtalar ankle joint. The typical average range is from about 10 degrees of eversion during load-bearing pronation motion to about 20 degrees of inversion during load-bearing supination motion.

FIG. 28B shows the much greater range of sideways motion in the forefoot, where the range is from about 30 degrees eversion during pronation to about 45 degrees inversion during supination.

This large increase in the range of motion from the heel area to the forefoot area indicates that not only does the supporting shoe sole need generally to be relatively wider than is conventional, but that the increase is relatively greater in instep and forefoot area than in the heel area.

Figure 28D:
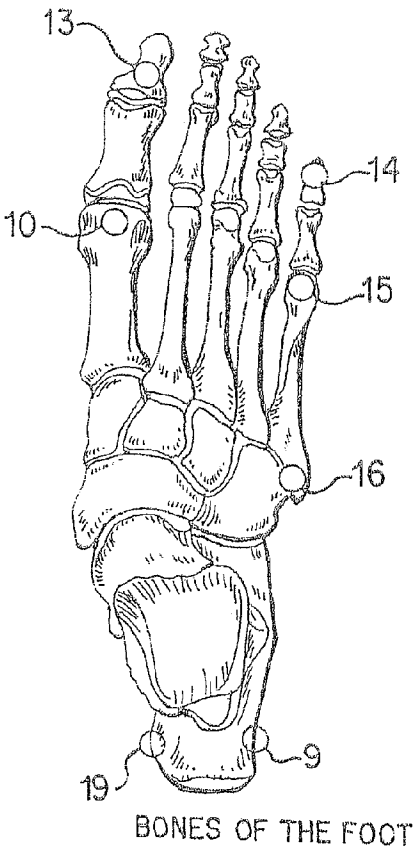
FIG. 28D shows an overhead perspective of the actual bone structures of the foot that are indicated in FIG. 28C.
Figure 28C:
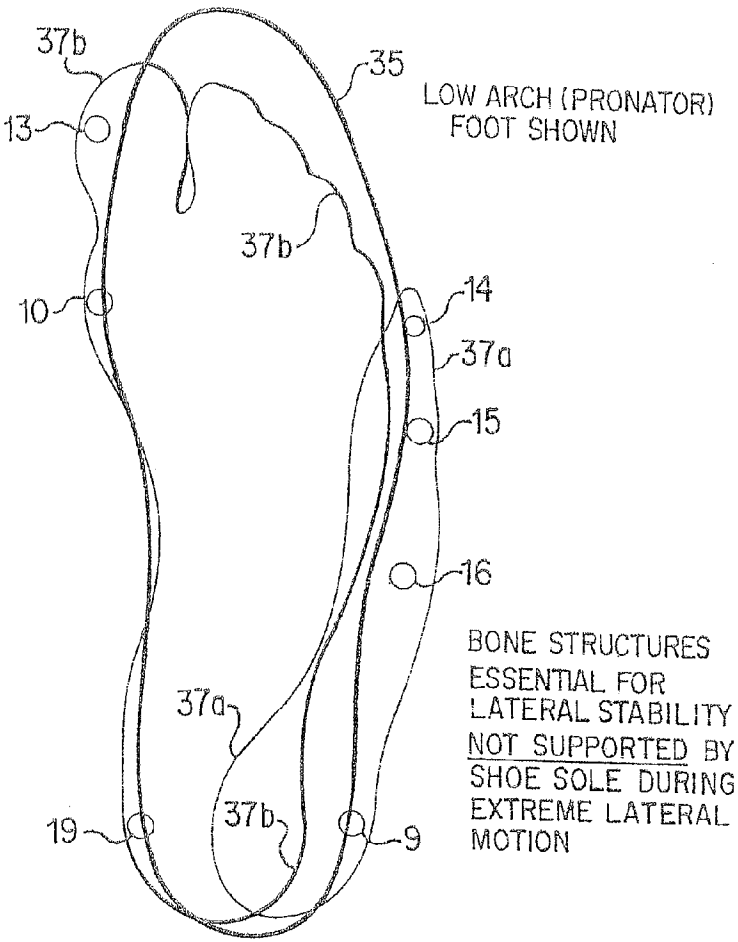
FIG. 28C compares the footprint made by a conventional shoe 35 with the relative positions of the wearer's right foot sole in the maximum supination position 37*a* and the maximum pronation position 37*b*.

FIG. 28C compares the footprint made by a conventional shoe 35 with the relative positions of the wearer's right foot sole in the maximum supination position 37*a* and the maximum pronation position 37*b*. FIG. 28C reinforces the FIG. 29A-B indication that more relative sideways motion occurs in the forefoot and midfoot, than in the heel area.

As shown in FIG. 28C, at the extreme limit of supination and pronation foot motion, the calcaneus 19 and the lateral calcaneal tuberosity 9 roll slightly off the sides of the shoe sole outer boundary 35. However, at the same extreme limit of supination, the base of the fifth metatarsal 16 and the head of the fifth metatarsal 15 and the fifth distal phalange all have rolled completely off the outer boundary 35 of the shoe sole.

FIG. 28D shows an overhead perspective of the actual bone structures of the foot that are indicated in FIG. 28A.

FIG. 29A-D shows the implications of relative difference in range of motions between forefoot, midfoot, and heel areas on the applicant's naturally contoured sides invention introduced in his '667 application filed 2 Sep. 1988. FIGS. 29A-D are a modification of FIG. 7 of the '667 application, with the left side of the figures showing the required range of motion for each area.

Figure 29A:
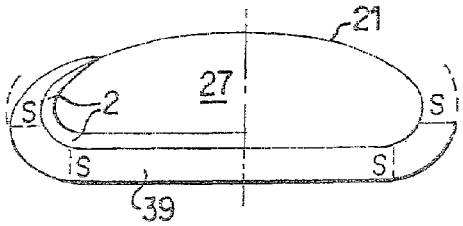
FIG. 29A-E shows the implications of relative difference in range of motions between forefoot, midfoot, and heel areas on the applicant's naturally contoured sides invention introduced in his 1667 application filed 2 Sep. 1988.

FIG. 29A shows a cross section of the forefoot area and therefore on the left side shows the highest contoured sides (compared to the thickness of the shoe sole in the forefoot area) to accommodate the greater forefoot range of motion. The contoured side is sufficiently high to support the entire range of motion of the wearer's foot sole. Note that the sockliner or insole 2 is shown.

Figure 29B:
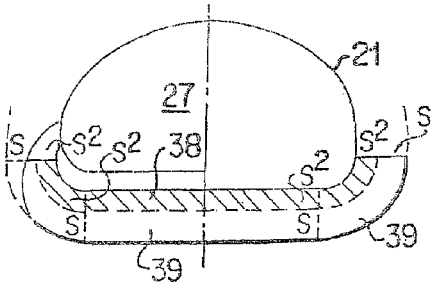
Figure 29C:
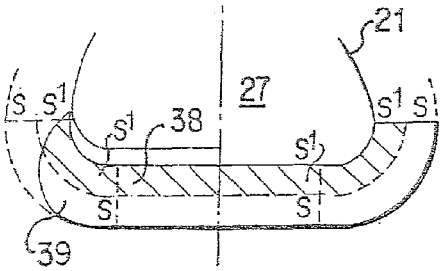
Figure 29D:
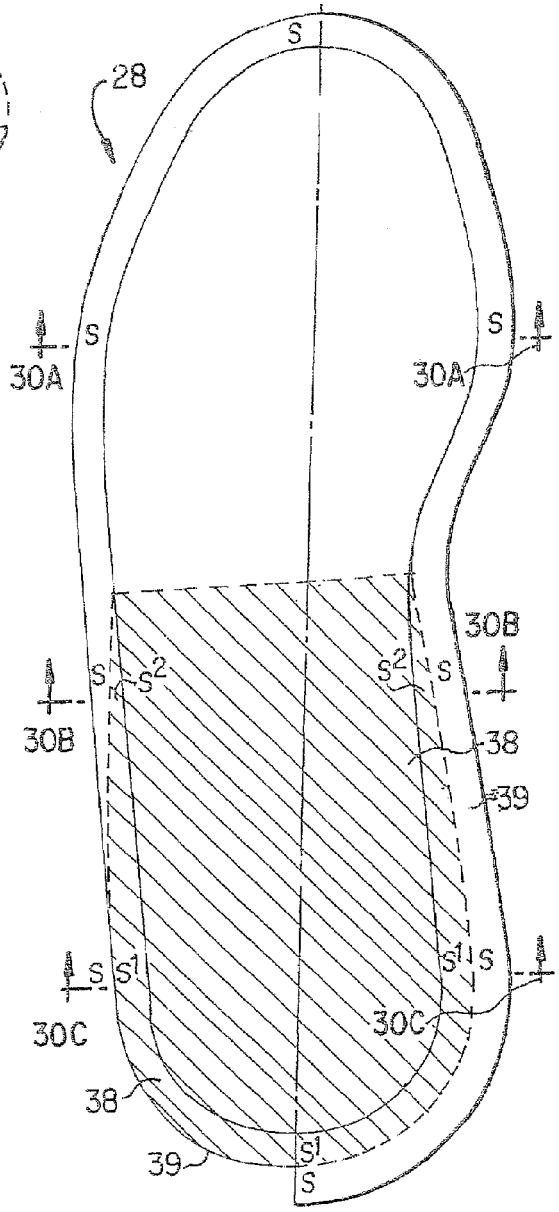

FIG. 29B shows a cross section of the midfoot area at about the base of the fifth metatarsal, which has somewhat less range of motion and therefore the contoured sides are not as high (compared to the thickness of the shoe sole at the midfoot). FIG. 29C shows a cross section of the heel area, where the range of motion is the least, so the height of the contoured sides is relatively least of the three general areas (when compared to the thickness of the shoe sole in the heel area).

Each of the three general areas, forefoot, midfoot and heel, have contoured sides that differ relative to the high of those sides compared to the thickness of the shoe sole in the same area. At the same time, note that the absolute height of the contoured sides is about the same for all three areas and the contours have a similar outward appearance, even though the actual structure differences are quite significant as shown in cross section.

Figure 29E:
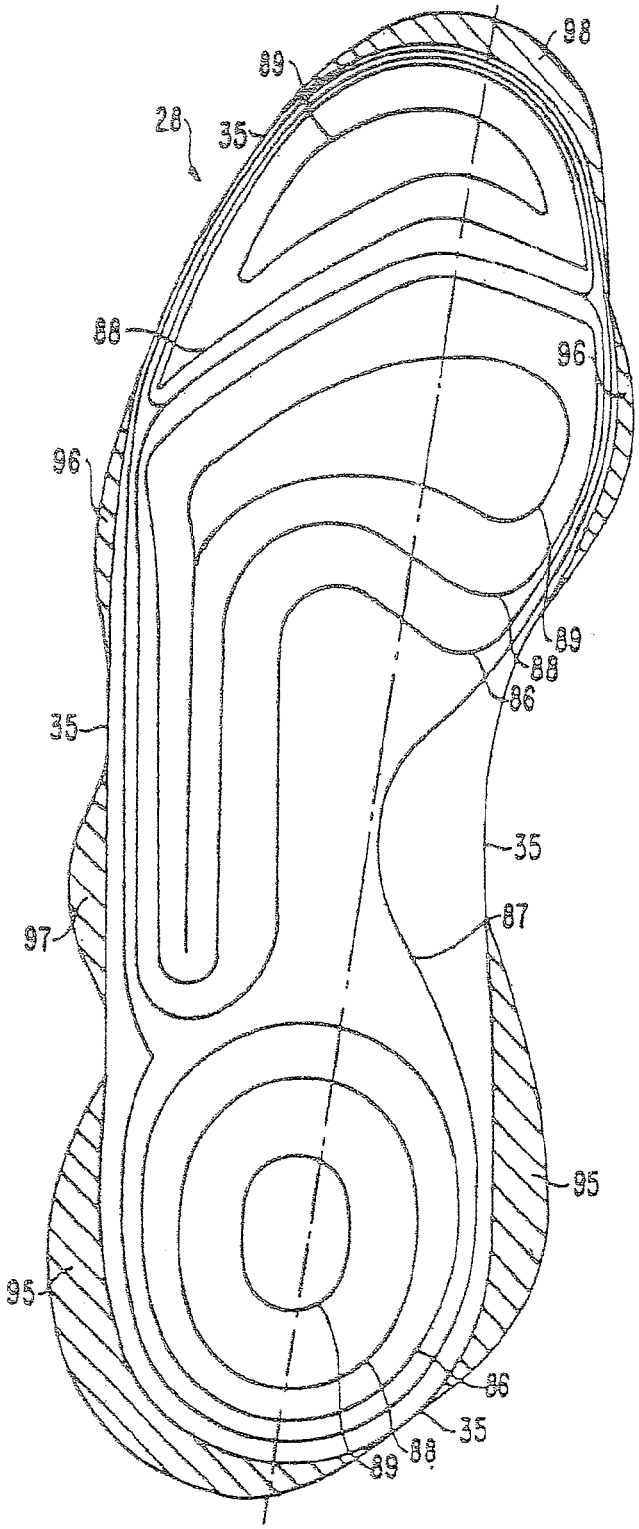

In addition, the contoured sides shown in FIG. 29A-D can be abbreviated to support only those essential structural support and propulsion elements identified in FIG. 20 of the applicant's '667 application, shown here as FIG. 29E. The essential structural support elements are the base and lateral tuberosity of the calcaneus 95, the heads of the metatarsals 96, and the base of the fifth metatarsal. The essential propulsion element is the head of the first distal phalange 98.

Figure 30:
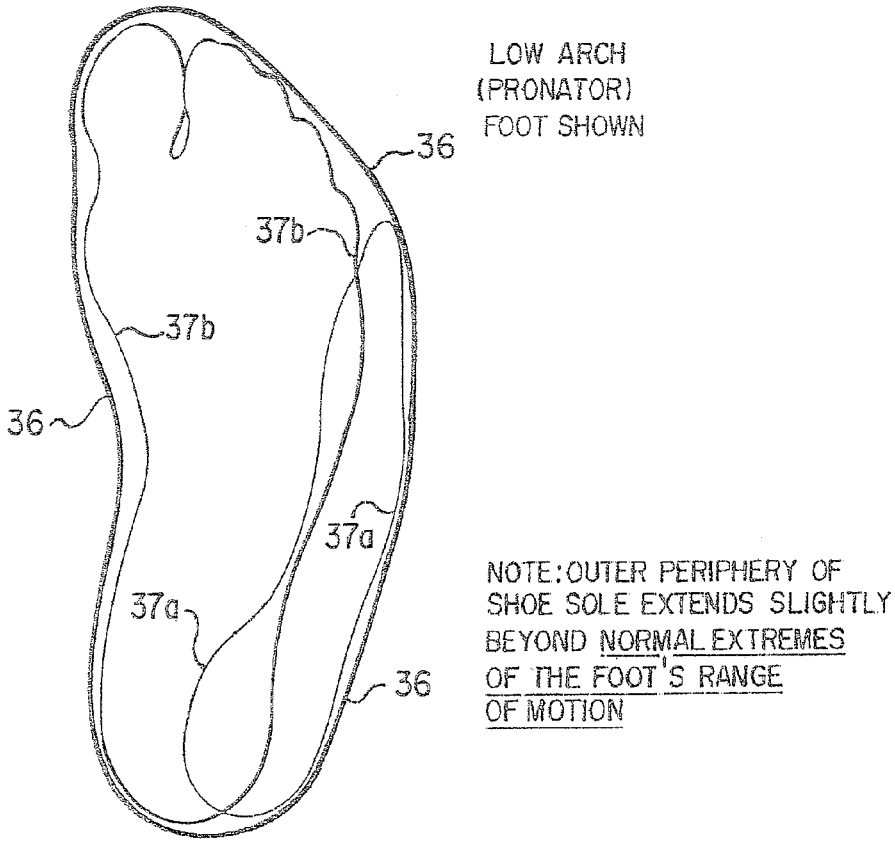
FIG. 30 is similar to FIG. 8 of the applicant's U.S. application Ser. No. 07/608,748, filed Nov. 5, 1990, in that it shows a new invention for a shoe sole that covers the full range of motion of the wearer's right foot sole.

FIG. 30 is similar to FIG. 8 of the applicant's U.S. application Ser. No. 07/608,748, filed Nov. 5, 1990, in that it shows a new invention for a shoe sole that covers the full range of motion of the wearer's right foot sole. However, while covering that full range of motion, it is possible to abbreviate the contoured sides of the shoe sole to only the essential structural and propulsion elements of the foot sole, as previously discussed here, and as originally defined in the applicant's '667 application in the textual specification describing FIG. 20 of that application.

Figure 31:
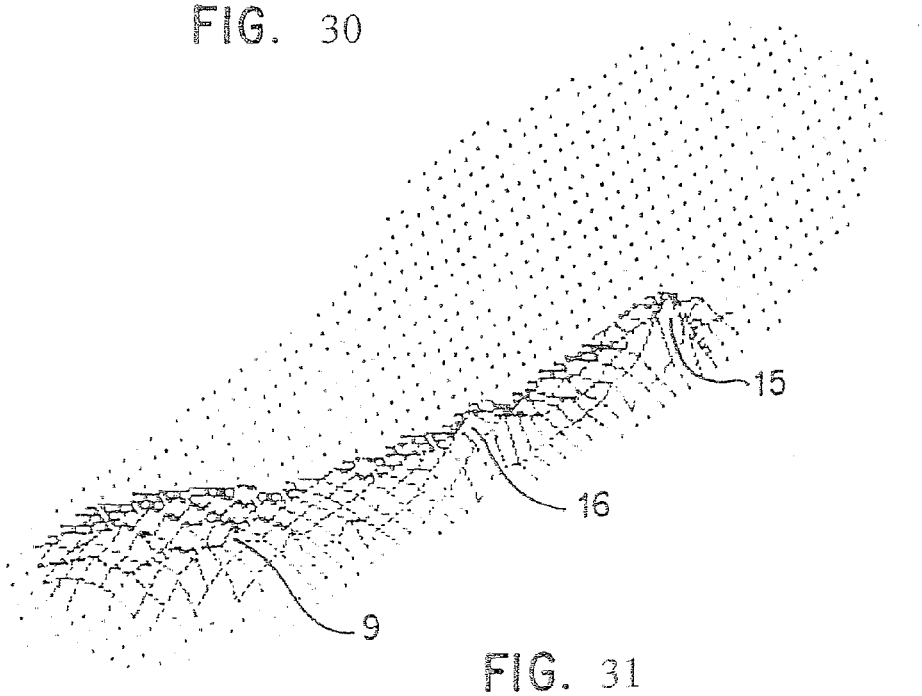
FIG. 31 shows an electronic image of the relative forces present at the different areas of the bare foot sole when at the maximum supination position shown as 37*a* in FIGS. 28A and 30; the forces were measured during a standing simulation of the most common ankle spraining position.

FIG. 31 shows an electronic image of the relative forces present at the different areas of the bare foot sole when at the maximum supination position shown as 37*a* in FIGS. 28A & 30; the forces were measured during a standing simulation of the most common ankle spraining position. The maximum force was focused at the head of the fifth metatarsal and the second highest force was focused at the base of the fifth metatarsal. Forces in the heel area were substantially less overall and less focused at any specific point.

FIG. 31 indicates that, among the essential structural support and propulsion elements previously defined in the '667 application, there are relative degrees of importance. In terms of preventing ankle sprains, the most common athletic injury (about two-thirds occur in the extreme supination position 37*a* shown in FIGS. 28A and 30), FIG. 31 indicates that the head of the fifth metatarsal 15 is the most critical single area that must be supported by a shoe sole in order to maintain barefoot-like lateral stability. FIG. 31 indicates that the base of the fifth metatarsal 16 is very close to being as important. FIG. 28A indicates that both the base and the head of the fifth metatarsal are completely unsupported by a conventional shoe sole.

FIGS. 32A-K show shoe soles with only one or more, but not all, of the essential stability elements defined in the '667 application (the use of all of which is still preferred) but which, based on FIG. 31, still represent major stability improvements over existing footwear. This approach of abbreviating structural support to a few elements has the economic advantage of being capable of construction using conventional flat sheets of shoe sole material, since the individual elements can be bent up to the contour of the wearer's foot with reasonable accuracy and without difficulty. Whereas a continuous naturally contoured side that extends all of, or even a significant portion of, the way around the wearer's foot sole would buckle partially since a flat surface cannot be accurately fitted to a contoured surface; hence, injection molding is required for accuracy.

The FIG. 32A-K designs can be used in combination with the designs shown earlier, particularly in FIGS. 18-21 and FIGS. 26 & 27.

Figure 32B:
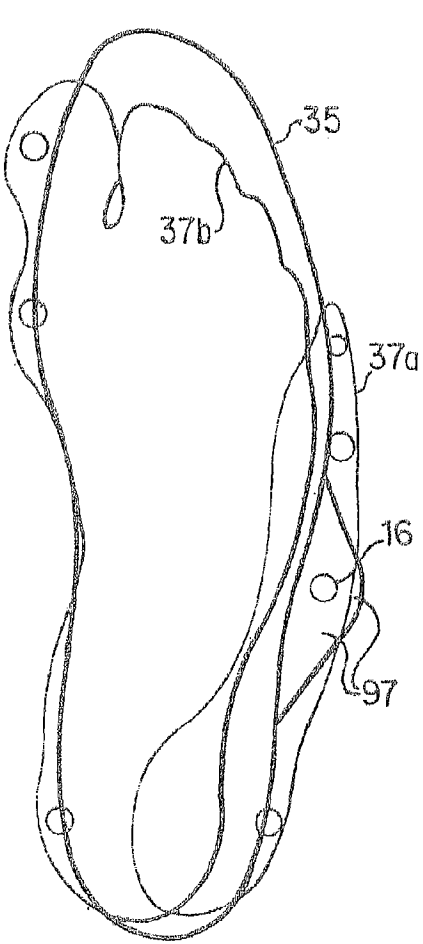
FIGS. 32A-K show shoe soles with only one or more of the essential stability elements defined in the '667 application (the use of all of which is still preferred) but which, based on FIG. 31, still represent major stability improvements over existing footwear. All omit changes in the heel area.
Figure 32A:
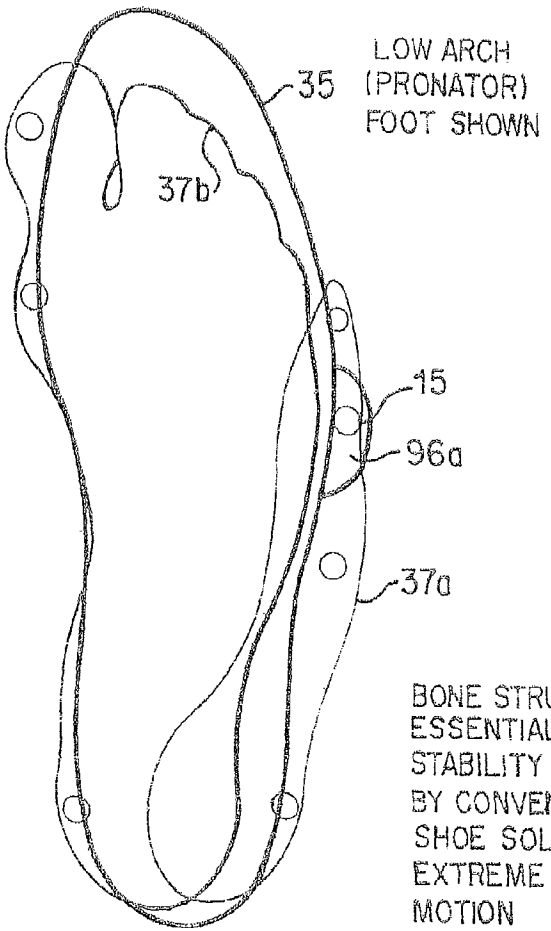

FIG. 32A shows a shoe sole with an otherwise conventional periphery 35 to which has been added the single most critical stability correction 96*a* to support the head of the fifth metatarsal 15. Indeed, as indicated in FIG. 31, the use of this support 96*a* to the head of the fifth metatarsal is mandatory to provide lateral stability similar to that of the barefoot; without support at this point the foot will be unstable in lateral or inversion motion. This additional shoe sole portion, even if used alone, should substantially reduce lateral ankle sprains and greatly improve stability compared to existing shoes. Preferably, the additional shoe sole portion 96*a* would take the form a naturally contoured side according to the applicant's '667 and '478 applications; briefly, conforming to the shape of the wearer's foot sole, deforming in parallel with it, and maintaining a thickness in frontal plane cross sections that is either constant or varying within a range of about 25 percent.

The degree to which the FIG. 32A design, and the subsequent FIG. 32 designs, preserves the naturally firm stability of the wearer's barefoot can be tested in a manner similar to the standing sprain simulation test first introduced in the applicant' U.S. Pat. No. 4,989,349, filed Jul. 15, 1988 and issued Feb. 5, 1991, page 1, lines 31-68, and discussed in more detail in subsequent applications. For the FIG. 32 designs that include only forefoot stability supports (all except FIGS. 32B & 32M), the comparative ankle sprain simulation test can be performed with only the forefoot in load-bearing contact with the ground. For example, the FIG. 32A design maintains stability like the barefoot when tilted out sideways to the extreme limit of its range of motion In summary, the FIG. 32A design shows a shoe construction for a shoe, comprising: a shoe sole including a side that conforms to the shape of the load-bearing portion of the wearer's foot sole, including its sides, at the head of the fifth metatarsal, whether under a load or unloaded; the shoe sole maintaining constant thickness in frontal plane cross sections; the shoe sole deforming under load and flattening just as does the wearer's foot sole under the same load.

FIG. 32B shows a shoe sole similar to FIG. 32A, but with the only additional shoe sole portion being a stability correction 97 to support the base of the fifth metatarsal 16. Given the existing practice of indenting the shoe sole in the area of the fifth metatarsal base, adding this correction by itself can have a very substantial impact in improving lateral stability compared to existing shoes, since FIG. 31 shows that the base of the fifth metatarsal is critical in extreme inversion motion.

However, the importance of the base of the fifth metatarsal is limited somewhat by the fact that in some phases of locomotion, such as the toe-off phase during walking and running, the foot is partially plantar-flexed and supinated with only the forefoot in contact with the ground (a situation that would exist even if the foot were bare), so that the base of the fifth metatarsal would not be naturally supported then even by the ground. As the foot becomes more plantar-flexed, its instep area becomes rigid through the functional locking of the subtalar and midtarsal joints; in contrast, those joints are unlocked when the foot is in a neutral load-bearing position on the ground. Consequently, when the foot is artificially plantar-flexed by the conventional shoe heel or lift, especially in the case of women's high heeled shoes, support for the base of the fifth metatarsal becomes less important relatively, so long as the head of the fifth metatarsal is fully supported during lateral motion, as shown in the FIG. 32A design.

Figure 32D:
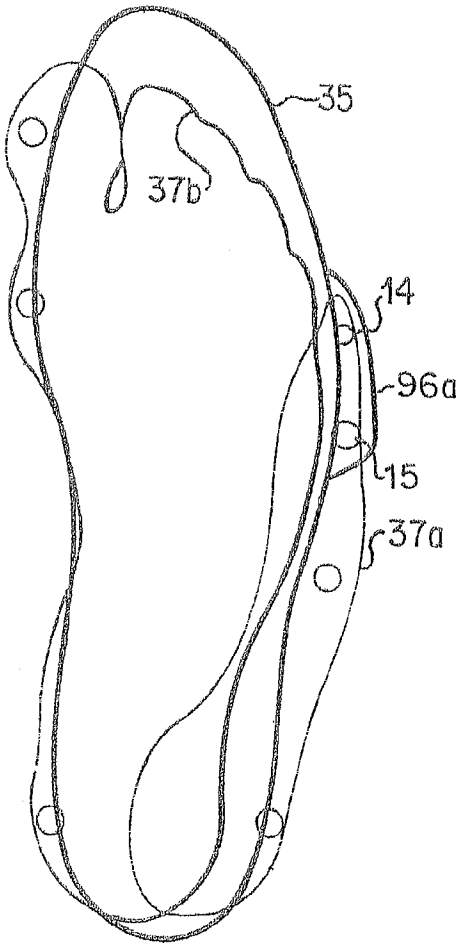
Figure 32C:
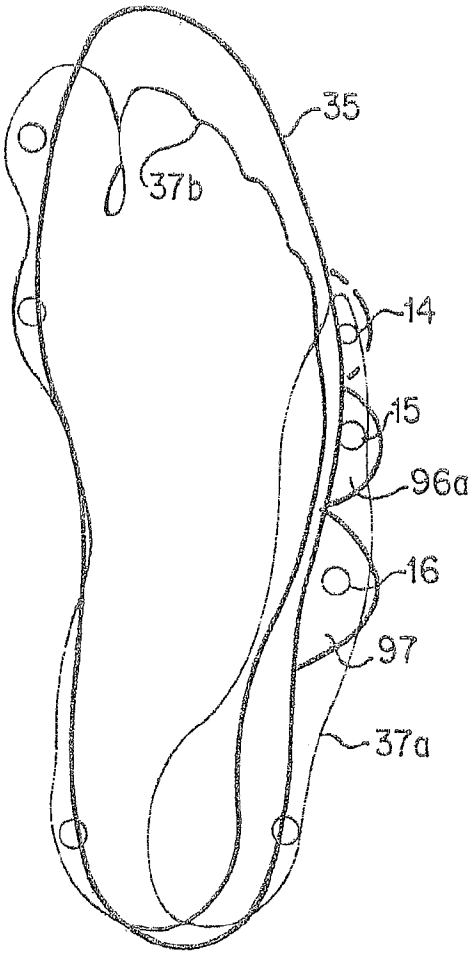

FIG. 32C shows a shoe sole similar to FIGS. 32A-B, but combining both stability corrections 96*a* and 97, with the dashed line surrounding the fifth distal phalange 14 representing an optional additional support.

FIG. 32D shows a shoe sole similar to FIGS. 32A-C, but with a single stability correction 96*a* that supports both the head of the fifth metatarsal 15 and the fifth distal phalange 14.

Figure 32F:
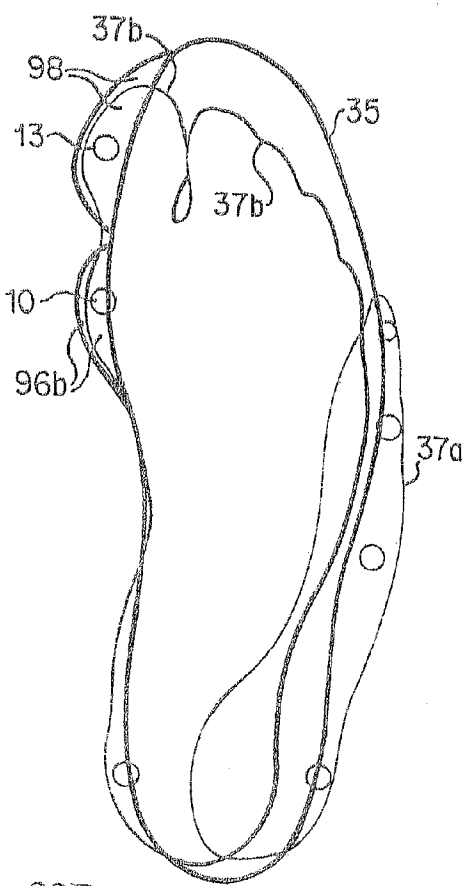
Figure 32E:
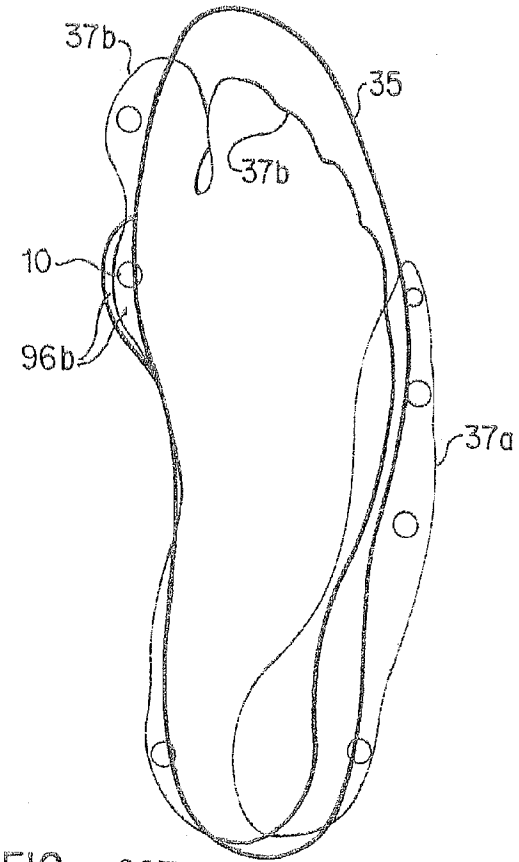

FIG. 32E show the single most important correction on the medial side (or inside) of the shoe sole: a stability correction 96*b* at the head of the first metatarsal 10; FIGS. 32A-D have shown lateral corrections. Just as the FIG. 32A design is mandatory to providing lateral support like that of the barefoot, the FIG. 32E design is mandatory to provide medial support like that of the barefoot: without support at this point the foot will be unstable in medial or eversion motion. Eversion or medial ankle sprains where the foot turns to the inside account for about one third of all that occur, and therefore this single correction will substantially improve the medial stability of the shoe sole.

FIG. 32F shows a show sole similar to FIG. 32E, but with an additional stability correction 98 at the head of the first distal phalange 13.

Figure 32H:
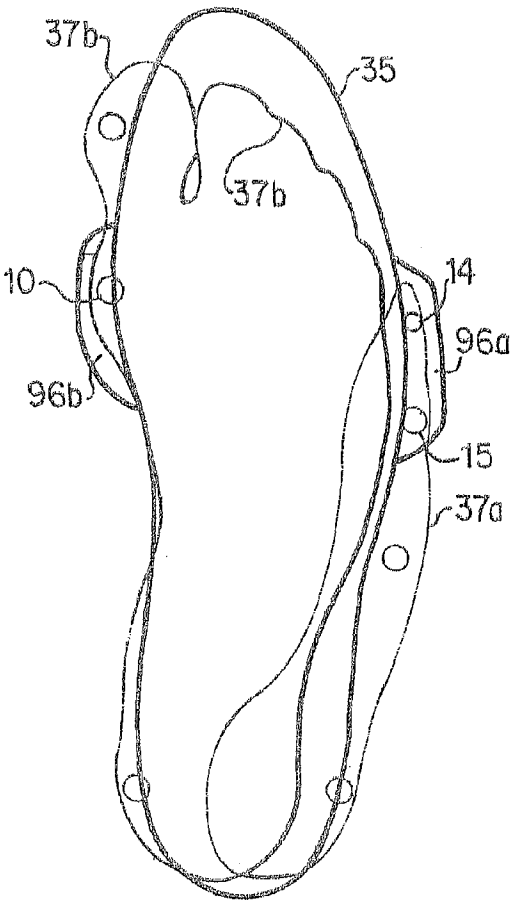
Figure 32G:
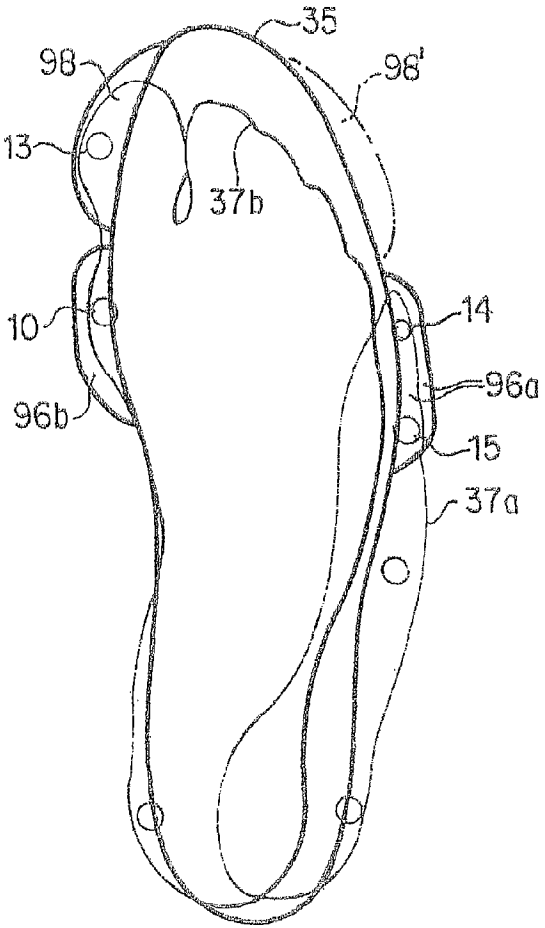

FIG. 32G shows a shoe sole combining the additional stability corrections 96*a*, 96*b*, and 98 shown in FIGS. 32D-F, supporting the first and fifth metatarsal heads and distal phalange heads. The dashed line 98' represents a symmetrical optional stability addition on the lateral side for the heads of the second through fifth distal phalanges, which are less important for stability.

FIG. 32H shows a shoe sole with symmetrical stability additions 96*a* and 96*b*. Besides being a major improvement in stability over existing footwear, this design is aesthetically pleasing and could even be used with high heel type shoes, especially those for women, but also any other form of footwear where there is a desire to retain relatively conventional looks or where the shear height of the heel or heel lift precludes stability side corrections at the heel or the base of the fifth metatarsal because of the required extreme thickness of the sides. This approach can also be used where it is desirable to leave the heel area conventional, since providing both firmness and flexibility in the heel is more difficult that in other areas of the shoe sole since the shoe sole thickness is usually much greater there; consequently, it is easier, less expensive in terms of change, and less of a risk in departing from well understood prior art just to provide additional stability corrections to the forefoot and/or base of the fifth metatarsal area only.

Since the shoe sole thickness of the forefoot can be kept relatively thin, even with very high heels, the additional stability corrections can be kept relatively inconspicuous. They can even be extended beyond the load-bearing range of motion of the wearer's foot sole, even to wrap all the way around the upper portion of the foot in a strictly ornamental way (although they can also play a part in the shoe upper's structure), as a modification of the strap, for example, often seen on conventional loafer's.

Figure 32I:
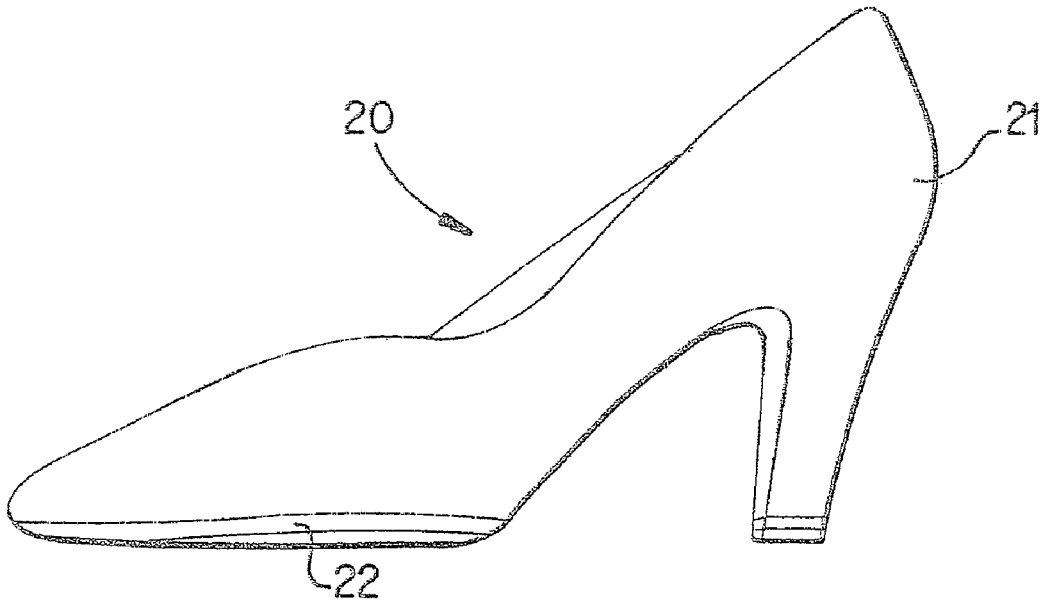
Figure 32J:
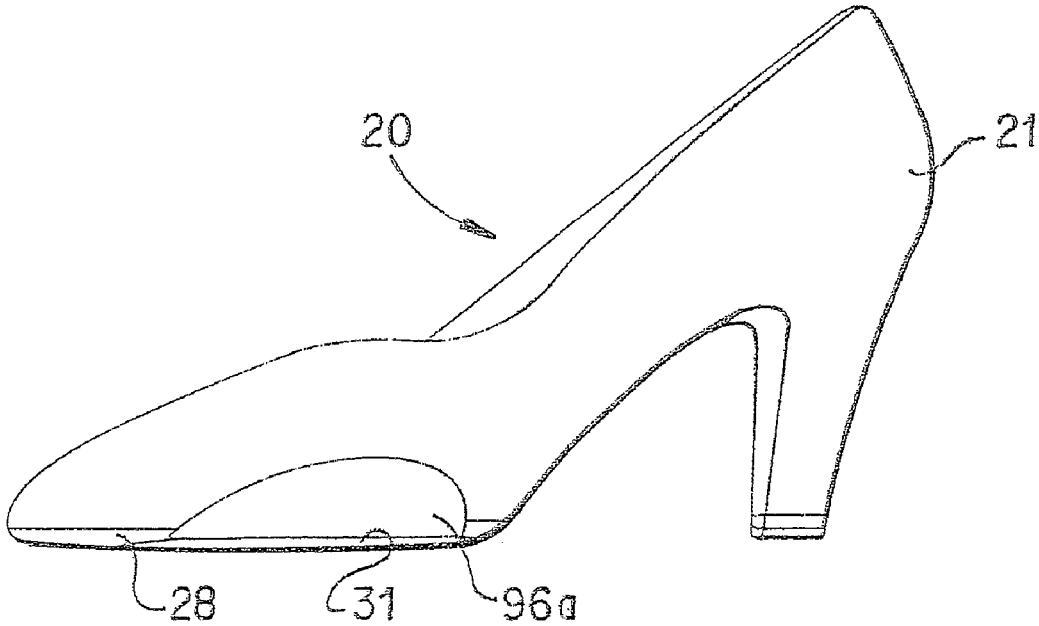

FIGS. 32I-J show perspective views of typical examples of the extreme case, women's high heel pumps. FIG. 32I shows a conventional high heel pump without modification. FIG. 32J shows the sane shoe with an additional stability correction 96*a*. It should be noted that it is preferable for the base of the fifth metatarsal to be structurally supported by a stiff shank-like structure in the instep area of the shoe sole, as is common in well-make women's shoes, so that the base of the fifth metatarsal is well supported even though not in direct structural support of the ground (meaning supporting shoe sole material between the ground and the base of the fifth metatarsal), as would be preferred generally.

The use of additional stability corrections in high heel shoes can be combined with the designs shown in FIGS. 19-26. Thus, even relatively thin forefoot soles can provide excellent protection and comfort, as well as dramatically improved stability.

Figure 32L:
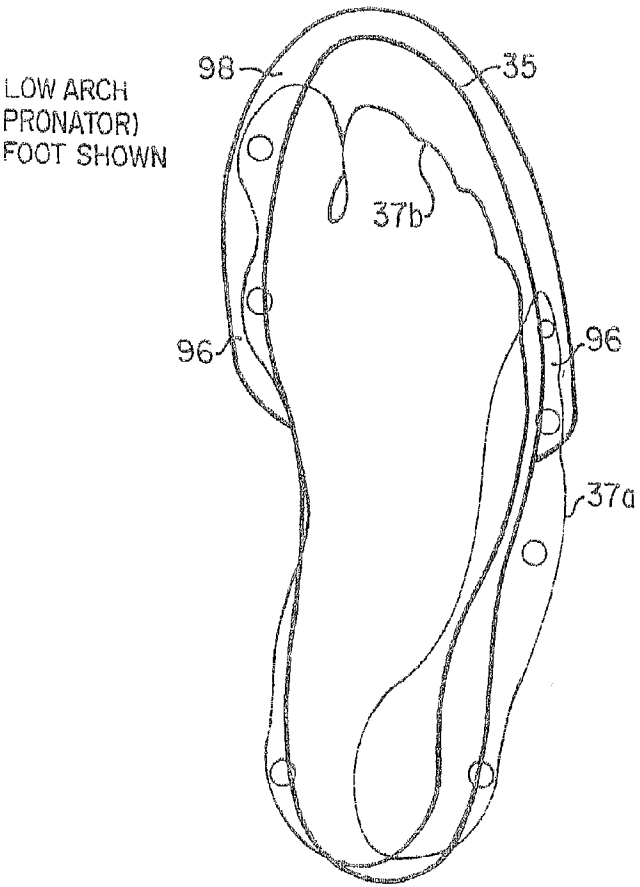
FIG. 32L shows a shoe sole with an additional stability correction in a single continuous band extending all the way around the forefoot area.
Figure 32K:
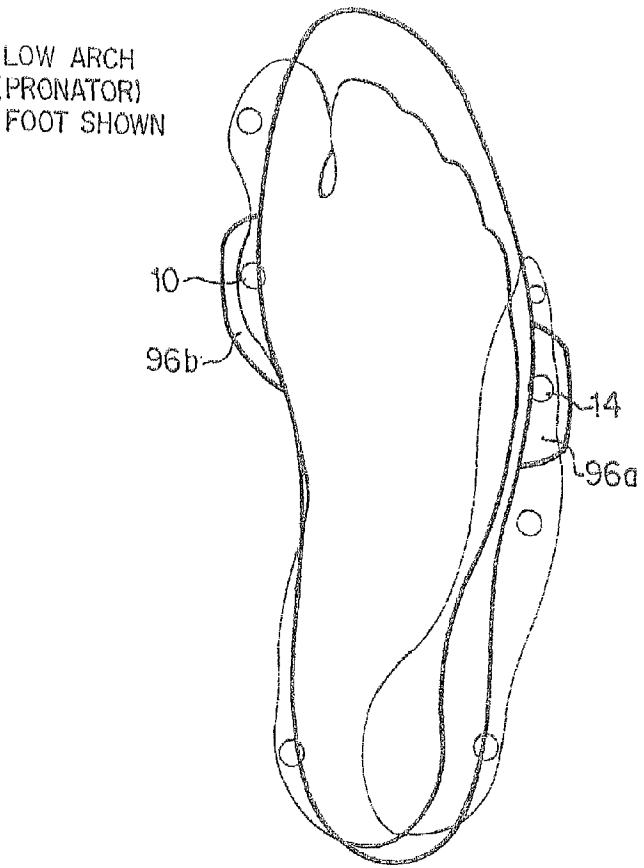

FIG. 32K shows a shoe sole similar to that in FIG. 32H, but with the head of the fifth distal phalange 14 unsupported by the additional stability correction 96*a*.

FIG. 32L shows a shoe sole with an additional stability correction in a single continuous band extending all the way around the forefoot area. This is not preferable, but can be acceptable if the shoe sole is thin in the forefoot area so it can buckle as necessary when the forefoot flexes naturally, as discussed under FIG. 32M following.

Figure 32M:
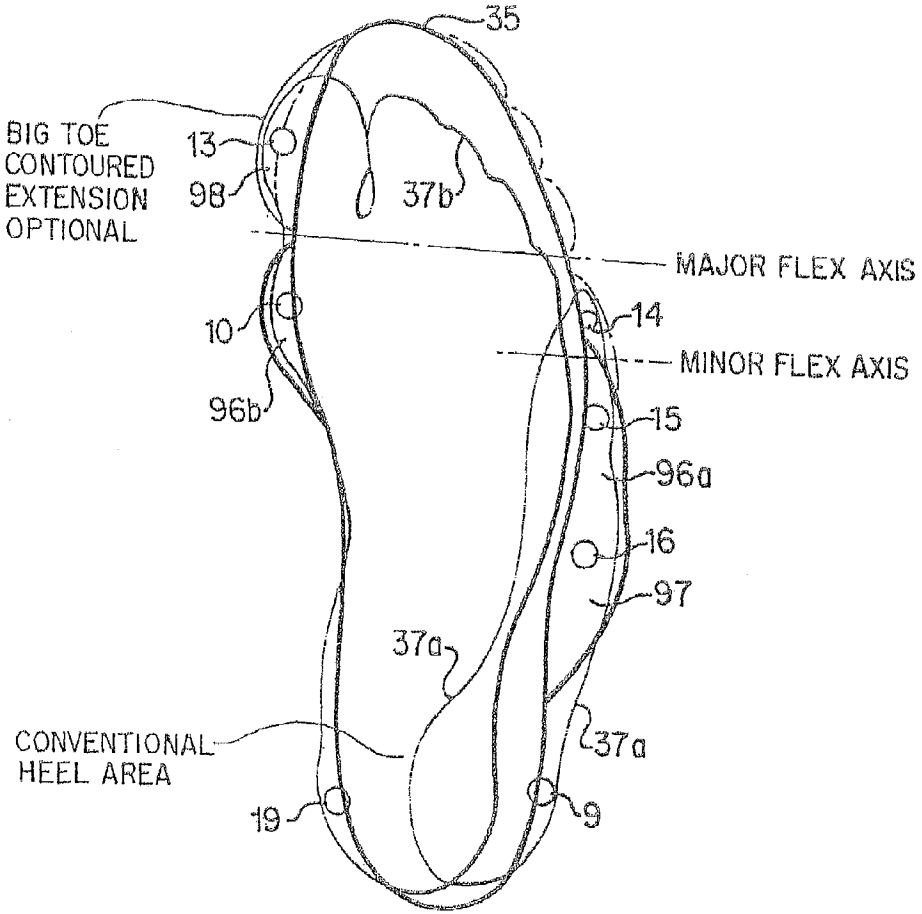
FIG. 32M shows a shoe sole similar to the FIGS. 32A-G and 32K&L, but showing additional stability correction 97, 96*a* and 96*b*, but retaining a conventional heel area.

FIG. 32M shows a shoe sole similar to the FIGS. 32A-G and 32K-L, but showing additional stability correction 97, 96*a* and 96*b*, but retaining a conventional heel area. The dashed line around the big toe 13 indicates that a wider last with a bigger toe box can be used to partially correct the problem solved with the additional stability correction 98 of FIGS. 32F-G.

The major flex axis indicated between the head of the first metatarsal and the head of the first distal phalange makes preferable an abbreviation of the stability side corrections 96*b* and 98 so that the normal flexibility of the wearer's foot can be maintained. This is a critical feature: if the naturally contoured stability correction extends through the indicated major flex axis, the natural motion of the foot will be obstructed. If any naturally contoured sides extended through the major flex axis, they would have to buckle for the shoe sole to flex along the indicated major axis. Natural flexibility is especially important on the medial or inside because the first metatarsal head and distal phalange are among the most critical load-bearing structures of the foot.

Figure 33:
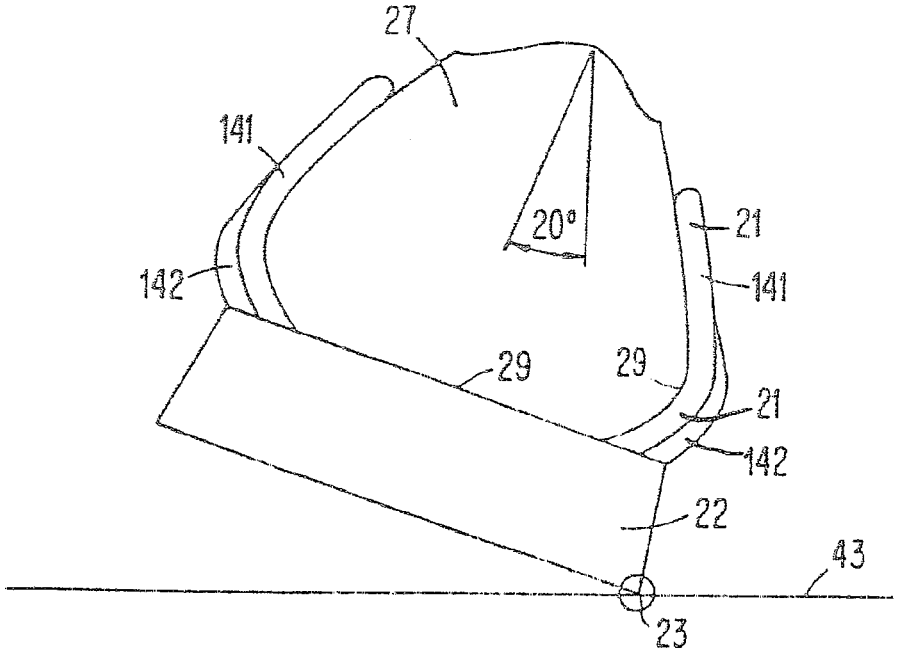

FIG. 33 shows a conventional athletic shoe in cross section at the heel, with a conventional shoe sole 22 having essentially flat upper and lower surfaces and having both a strong heel counter 141 and an additional reinforcement in the form of motion control device 142. FIG. 33 specifically illustrates when that shoe is tilted outward laterally in 20 degrees of inversion motion at the normal natural limit of such motion in the barefoot. FIG. 33 demonstrates that the conventional shoe sole 22 functions as an essentially rigid structure in the frontal plane, maintaining its essentially flat, rectangular shape when tilted and supported only by its outside, lower corner edge 23, about which it moves in rotation on the ground 43 when tilted. Both heel counter 141 and motion control device 142 significantly enhance and increase the rigidity of the shoe sole 22 when tilted. All three structures serve to restrict and resist deformation of the shoe sole 22 under normal loads, including standing, walking and running. Indeed, the structural rigidity of most conventional street shoe materials alone, especially in the critical heel area, is usually enough to effectively prevent deformation.

Figure 34:
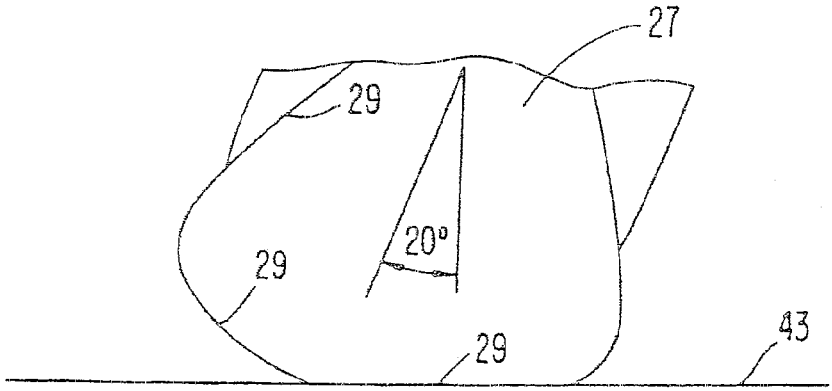

FIG. 34 shows a similar heel cross section of a barefoot tilted outward laterally at the normal 20 degree inversion maximum. In marked contrast to FIG. 33, FIG. 34 demonstrates that such normal tilting motion in the barefoot is accompanied by a very substantial amount of flattening deformation of the human foot sole, which has a pronounced rounded contour when unloaded, as will be seen in foot sole surface 29 later in FIG. 42.

FIG. 34 shows that in the critical heel area the barefoot maintains almost as great a flattened area of contact with the ground when tilted at its 20 degree maximum as when upright, as seen later in FIG. 35. In complete contrast, FIG. 33 indicate clearly that the conventional shoe sole changes in an instant from an area of contact with the ground 43 substantially greater than that of the barefoot, as much as 100 percent more when measuring in roughly the frontal plane, to a very narrow edge only in contact with the ground, an area of contact many times less than the barefoot. The unavoidable consequence of that difference is that the conventional shoe sole is inherently unstable and interrupts natural foot and ankle motion, creating a high and unnatural level of injuries, traumatic ankle sprains in particular and a multitude of chronic overuse injuries.

This critical stability difference between a barefoot and a conventional shoe has been dramatically demonstrated in the applicant's new and original ankle sprain simulation test described in detail in the applicant's earlier U.S. patent application Ser. No. 07/400,714, filed on Aug. 30, 1989 and was referred to also in both of his earlier applications previously noted here.

Figure 35:
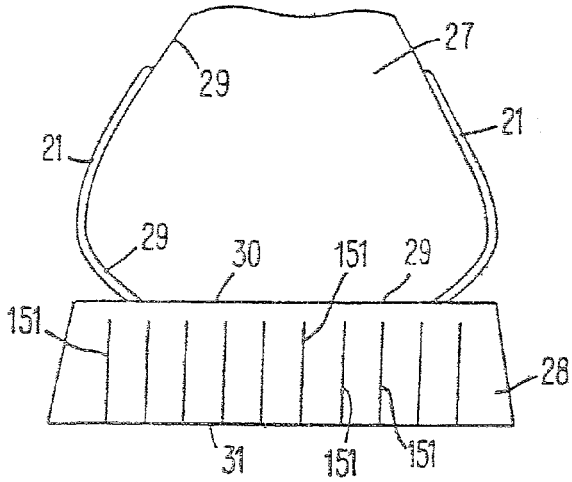

FIG. 35 shows, in frontal plane cross section at the heel, the applicant's prior invention of U.S. application Ser. No. 07/424,509, filed Oct. 20, 1989, the most clearcut benefit of which is to provide inherent stability similar to the barefoot in the ankle sprain simulation test mentioned above.

It does so by providing conventional shoe soles with sufficient flexibility to deform in parallel with the natural deformation of the foot. FIG. 35A indicates a conventional shoe sole into which have been introduced deformation slits 151, also called sipes, which are located optimally in the vertical plane and on the long axis of the shoe sole, or roughly in the sagittal plane, assuming the shoe is oriented straight ahead.

The deformation slits 151 can vary in number beginning with one, since even a single deformation slit offers improvement over an unmodified shoe sole, though obviously the more slits are used, the more closely can the surface of the shoe sole coincide naturally with the surface of the sole of the foot and deform in parallel with it. The space between slits can vary, regularly or irregularly or randomly. The deformation slits 151 can be evenly spaced, as shown, or at uneven intervals or at unsymmetrical intervals. The optimal orientation of the deformation slits 151 is coinciding with the vertical plane, but they can also be located at an angle to that plane.

The depth of the deformation slits 151 can vary. The greater the depth, the more flexibility is provided. Optimally, the slit depth should be deep enough to penetrate most but not all of the shoe sole, starting from the bottom surface 31, as shown in FIG. 35A.

A key element in the applicant's invention is the absence of either a conventional rigid heel counter or conventional rigid motion control devices, both of which significantly reduce flexibility in the frontal plane, as noted earlier in FIG. 33, in direct proportion to their relative size and rigidity. If not too extensive, the applicant's prior sipe invention still provides definite improvement.

Finally, it is another advantage of the invention to provide flexibility to a shoe sole even when the material of which it is composed is relatively firm to provide good support; without the invention, both firmness and flexibility would continue to be mutually exclusive and could not coexist in the sane shoe sole.

Figure 36:
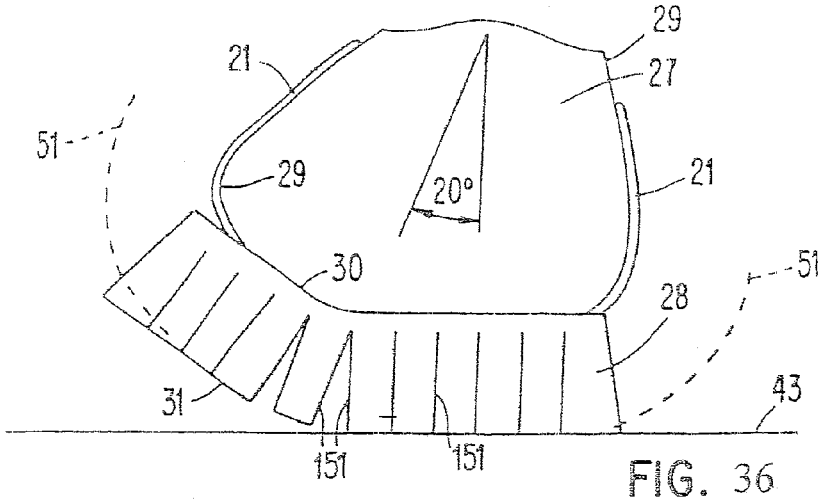

FIG. 36 shows, in frontal plane cross section at the heel, the applicant's prior invention of U.S. application Ser. No. 07/424,509, filed Oct. 20, 1989, showing the clearcut advantage of using the deformation slits 151 introduced in FIG. 35. With the substitution of flexibility for rigidity in the frontal plane, the shoe sole can duplicate virtually identically the natural deformation of the human foot, even when tilted to the limit of its normal range, as shown before in FIG. 34. The natural deformation capability of the shoe sole provided by the applicant's prior invention shown in FIG. 36 is in complete contrast to the conventional rigid shoe sole shown in FIG. 33, which cannot deform naturally and has virtually no flexibility in the frontal plane.

It should be noted that because the deformation sipes shoe sole invention shown in FIGS. 35 and 36, as well as other structures shown in the '509 application and in this application, allows the deformation of a modified conventional shoe sole to parallel closely the natural deformation of the barefoot, it maintains the natural stability and natural, uninterrupted motion of the barefoot throughout its normal range of sideways pronation and supination motion.

Indeed, a key feature of the applicant's prior invention is that it provides a means to modify existing shoe soles to allow them to deform so easily, with so little physical resistance, that the natural motion of the foot is not disrupted as it deforms naturally. This surprising result is possible even though the flat, roughly rectangular shape of the conventional shoe sole is retained and continues to exist except when it is deformed, however easily.

It should be noted that the deformation sipes shoe sole invention shown in FIGS. 35 and 36, as well as other structures shown in the '509 application and in this application, can be incorporated in the shoe sole structures described in the applicant's U.S. application Ser. No. 07/469,313, as well as those in the applicant's earlier applications, except where their use is obviously precluded. Relative specifically to the '313 application, the deformation sipes, can provide a significant benefit on any portion of the shoe sole that is thick and firm enough to resist natural deformation due to rigidity, like in the forefoot of a negative heel shoe sole.

Note also that the principal function of the deformation sipes invention is to provide the otherwise rigid shoe sole with the capability of deforming easily to parallel, rather than obstruct, the natural deformation of the human foot when load-bearing and in motion, especially when in lateral motion and particularly such motion in the critical heel area occurring in the frontal plane or, alternately, perpendicular to the subtalar axis, or such lateral motion in the important base of the fifth metatarsal area occurring in the frontal plane. Other sipes exist in some other shoe sole structures that are in some ways similar to the deformation sipes invention described here, but none provides the critical capability to parallel the natural deformation motion of the foot sole, especially the critical heel and base of the fifth metatarsal, that is the fundamental process by which the lateral stability of the foot is assured during pronation and supination motion. The optimal depth and number of the deformation sipes is that which gives the essential support and propulsion structures of the shoe sole sufficient flexibility to deform easily in parallel with the natural deformation of the human foot.

Finally, note that there is an inherent engineering trade-off between the flexibility of the shoe sole material or materials and the depth of deformation sipes, as well as their shape and number; the more rigid the sole material, the more extensive must be the deformation sipes to provide natural deformation.

Figure 37:
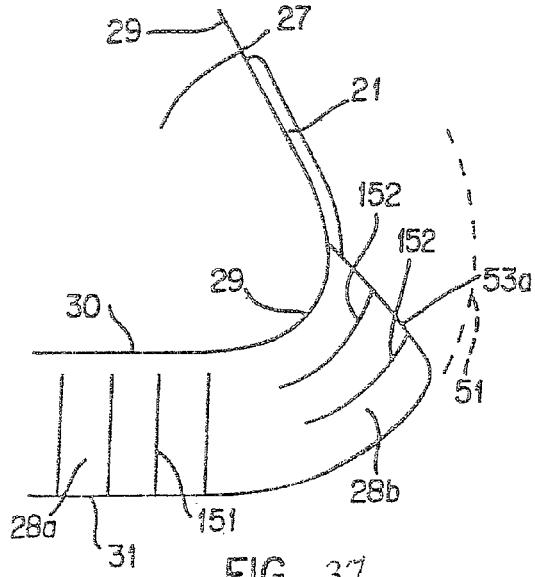

FIG. 37 shows, in a portion of a frontal plane cross section at the heel, FIG. 9B of the applicant's prior invention of U.S. application Ser. No. 07/424,509, filed Oct. 20, 1989, showing the new deformation slit invention applied to the applicant's naturally contoured side invention, in U.S. application Ser. No. 07/239,667. The applicant's deformation slit design is applied to the sole portion 28*b* in FIGS. 4B, 4C, and 4D of the earlier application, to which are added a portion of a naturally contoured side 28*a*, the outer surface of which lies along a theoretically ideal stability plane 51.

FIG. 37 also illustrates the use of deformation slits 152 aligned, roughly speaking, in the horizontal plane, though these planes are bent up, paralleling the sides of the foot and paralleling the theoretically ideal stability plane 51. The purpose of the deformation slits 152 is to facilitate the flattening of the naturally contoured side portion 28*b*, so that it can more easily follow the natural deformation of the wearer's foot in natural pronation and supination, no matter how extreme. The deformation slits 152, as shown in FIG. 37 would, in effect, coincide with the lamination boundaries of an evenly spaced, three layer shoe sole, even though that point is only conceptual and they would preferably be of injection molding shoe sole construction in order to hold the contour better.

The function of deformation slits 152 is to allow the layers to slide horizontally relative to each other, to ease deformation, rather than to open up an angular gap as deformation slits or channels 151 do functionally. Consequently, deformation slits 152 would not be glued together, just as deformation slits 152 are not, though, in contrast, deformation slits 152 could be glued loosely together with a very elastic, flexible glue that allows sufficient relative sliding motion, whereas it is not anticipated, though possible, that a glue or other deforming material of satisfactory consistency could be used to join deformation slits 151.

Optimally, deformation slits 152 would parallel the theoretically ideal stability plane 51, but could be at an angle thereto or irregular rather than a curved plane or flat to reduce construction difficulty and therefore cost of cutting when the sides have already been cast.

The deformation slits 152 approach can be used by themselves or in conjunction with the shoe sole construction and natural deformation outlined in FIG. 9 of U.S. application Ser. No. 07/400,714.

The number of deformation slits 152 can vary like deformation slits 151 from one to any practical number and their depth can vary throughout the contoured side portion 28*b*. It is also possible, though not shown, for the deformation slits 152 to originate from an inner gap between shoe sole sections 28*a* and 28*b*, and end somewhat before the outside edge 53*a* of the contoured side 28*b*.

Figure 38A:
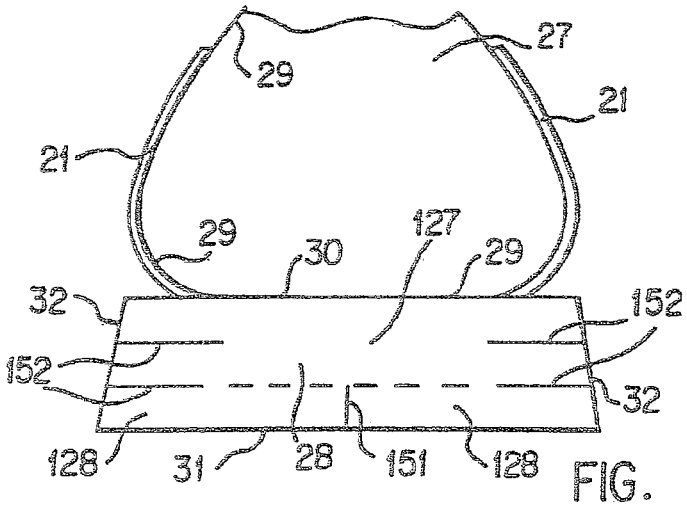
FIG. 38A is a frontal plane cross section at the heel of a conventional shoe with a sole that utilizes both horizontal and sagittal plane slits.

FIG. 38A shows, in a frontal plane cross section at the heel, a shoe sole with a combination like FIG. 37 of both sagittal plane deformation slits 151 and horizontal plane deformation slits 152. It shows deformation slits 152 in the horizontal plane applied to a conventional shoe having a sole structure with moderate side flare and without either reinforced heel counter or other motion control devices that would obstruct the natural deformation of the shoe sole. The deformation slits 152 can extend all the way around the periphery of the shoe sole, or can be limited to one or more anatomical areas like the heel, where the typically greater thickness of the shoe sole otherwise would make deformation difficult; for the same reason, a negative heel shoe sole would need deformation enhancement of the thicker forefoot.

Also shown in FIG. 38A is a single deformation slit 151 in the sagittal plane extending only through the bottom sole 128; even as a minimalist structure, such a single deformation sipe, by itself alone, has considerable effect in facilitating natural deformation, but it can enlarged or supplemented by other sipes. The lowest horizontal slit 152 is shown located between the bottom sole 128 and the midsole 127.

Figure 38B:
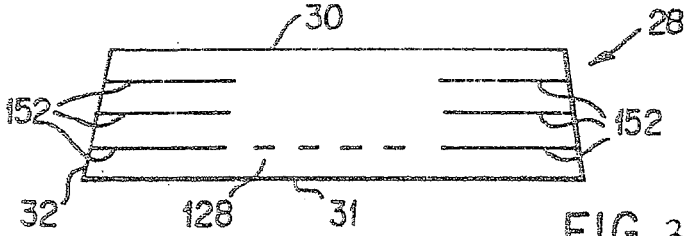
FIG. 38B show other conventional shoe soles with other variations of horizontal plane deformation slit originating from the sides of the shoe sole.

FIG. 38B shows, in frontal plane cross section at the heel, a similar conventional shoe sole structure with more and deeper deformation slits 152, which can be used without any deformation slits 151.

The advantage of horizontal plane deformation slits 152, compared to sagittal plane deformation slits 151, is that the normal weight-bearing load of the wearer acts to force together the sections separated by the horizontal slits so that those sections are stabilized by the natural compression, as if they were glued together into a single unit, so that the entire structure of the shoe sole reacts under compression much like one without deformation slits in terms of providing a roughly equivalent amount of cushioning and protection. In other words, under compression those localized sections become relatively rigidly supporting while flattened out directly under the flattened load-bearing portion of the foot sole, even though the deformation slits 152 allow flexibility like that of the foot sole, so that the shoe sole does not act as a single lever as discussed in FIG. 33.

In contrast, deformation sipes 151 are parallel to the force of the load-bearing weight of the wearer and therefore the shoe sole sections between those sipes 151 are not forced together directly by that weight and stabilized inherently, like slits 152. Compensation for this problem in the form of firmer shoe sole material than are used conventionally may provide equivalently rigid support, particularly at the sides of the shoe sole, or deformation slits 152 may be preferable at the sides.

Figure 39:
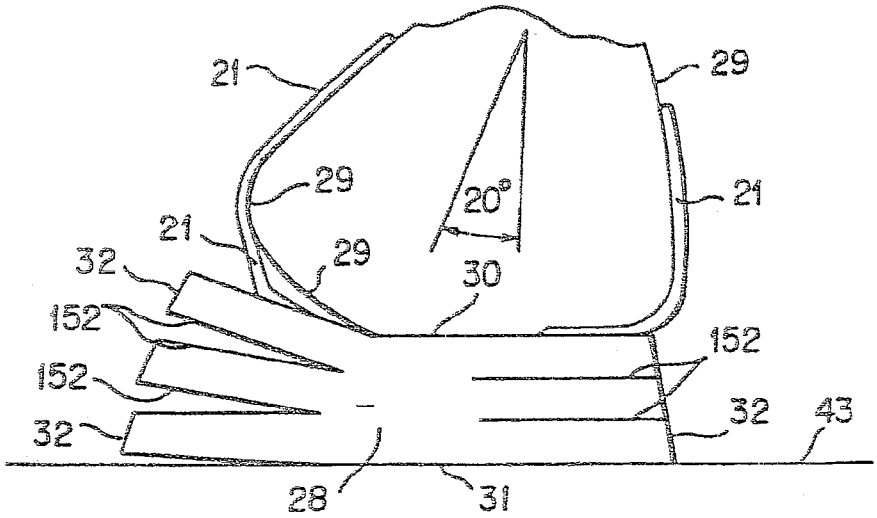

FIG. 39 shows, in frontal plane cross section at the heel, a conventional shoe with horizontal plane deformation slits 152 with the wearer's right foot inverted 20 degrees to the outside at about its normal limit of motion. FIG. 39 shows how the use of horizontal plane deformation slits 152 allows the natural motion of the foot to occur without obstruction. The attachments of the shoe upper are shown conventionally, but it should be noted that such attachments are a major cause of the accordion-like effect of the inside edge of the shoe sole. If the attachments on both sides were move inward closer to the center of the shoe sole, then the slit areas would not be pulled up, leaving the shoe sole with horizontal plane deformation slits laying roughly flat on the ground with a convention, un-accordion-like appearance.

FIG. 40 shows, again in frontal plane cross section at the heel, a conventional shoe sole structure with deformation slits 152 enlarged to horizontal plane channels, broadening the definition to horizontal plane deformation sipes 152, like the very broad definition given to sagittal plane deformations sipes 151 in both earlier applications, Nos. '509 and '579. In contrast to sagittal plane deformation sipes 151, however, the voids created by horizontal plane deformation sipes 152 must be filled by a material that is sufficiently elastic to allow the shoe sole to deform naturally like the foot while at the same time providing structural support.

Certainly, as defined most simply in terms of horizontal plane channels, the voids created must be filled to provide direct structural support or the areas with deformation sipes 152 would sag. However, just as in the case of sagittal plane deformation sipes 151, which were geometrically defined as broadly as possibly in the prior applications, the horizontal plane deformation sipes 152 are intended to include any conceivable shape and certainly to include any already conceived in the form of existing sipes in either shoe soles or automobile tire. For example, deformation sipes in the form of hollow cylindrical aligned parallel in the horizontal plane and sufficiently closely spaced would provide a degree of both flexibility and structural support sufficient to provide shoe sole deformation much closer to that of the foot than conventional shoe soles. Similarly, such cylinders, whether hollow or filled with elastic material, could also be used with sagittal plane deformation sipes, as could any other shape.

It should be emphasized that the broadest possible geometric definition is intended for deformation sipes in the horizontal plane, as has already been established for deformation sipes in the sagittal plane. There can be the same very wide variations with regard to deformation sipe depth, frequency, shape of channels or other structures (regular or otherwise), orientation within a plane or obliqueness to it, consistency of pattern or randomness, relative or absolute size, and symmetry or lack thereof.

Figure 40:
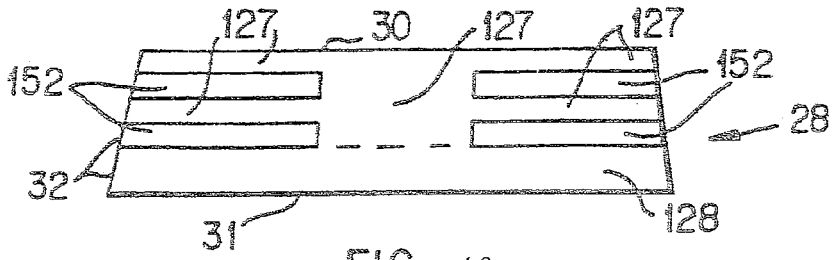

The FIG. 40 design applies also to the applicant's earlier naturally contoured sides and fully contoured inventions, including those with greater or lesser side thickness; although not shown, the FIG. 40 design, as well as those in FIGS. 38 and 39, could use a shoe sole density variation like that in the applicant's U.S. application Ser. No. 07/416,478, filed on Oct. 3, 1989, as shown in FIG. 7 of the No. '579 application.

Figure 41:
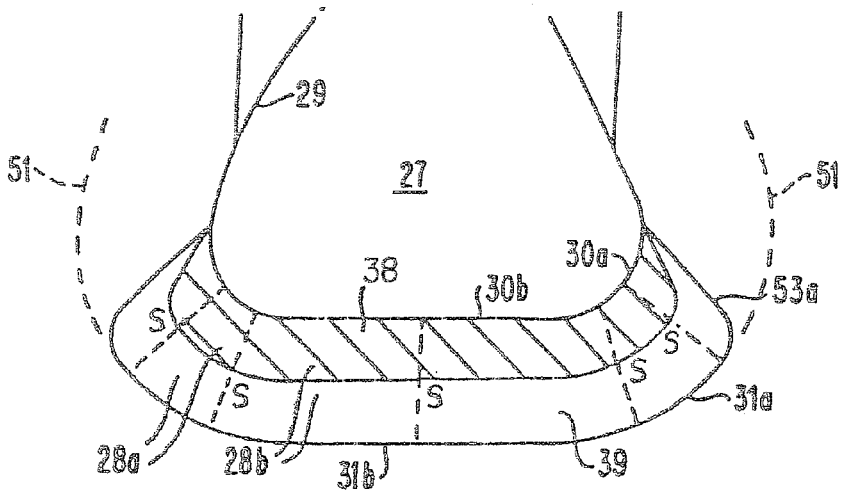
Figure 42:
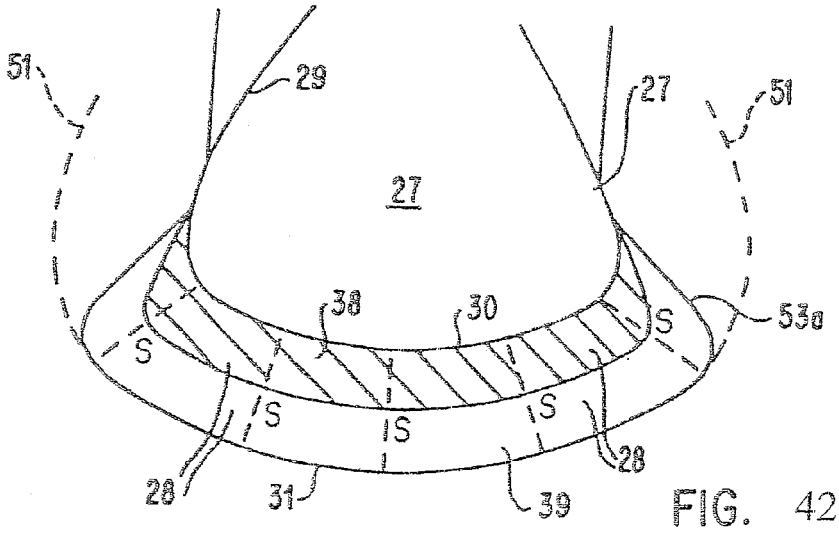

FIGS. 41 and 42 show frontal plane cross sectional views of a shoe sole according to the applicant's prior inventions based on the theoretically ideal stability plane, taken at about the ankle joint to show the heel section of the shoe. In the figures, a foot 27 is positioned in a naturally contoured shoe having an upper 21 and a sole 28. The shoe sole normally contacts the ground 43 at about the lower central heel portion thereof. The concept of the theoretically ideal stability plane, as developed in the prior applications as noted, defines the plane 51 in terms of a locus of points determined by the thickness (s) of the sole. The reference numerals are like those used in the prior applications of the applicant mentioned above and which are incorporated by reference for the sake of completeness of disclosure, if necessary.

FIG. 41 shows, in a rear cross sectional view, the application of the prior invention showing the inner surface of the shoe sole conforming to the natural contour of the foot and the thickness of the shoe sole remaining constant in the frontal plane, so that the outer surface coincides with the theoretically ideal stability plane.

FIG. 42 shows a fully contoured shoe sole design of the applicant's prior invention that follows the natural contour of all of the foot, the bottom as well as the sides, while retaining a constant shoe sole thickness in the frontal plane.

The fully contoured shoe sole assumes that the resulting slightly rounded bottom when unloaded will deform under load and flatten just as the human foot bottom is slightly rounded unloaded but flattens under load; therefore, shoe sole material must be of such composition as to allow the natural deformation following that of the foot. The design applies particularly to the heel, but to the rest of the shoe sole as well. By providing the closest match to the natural shape of the foot, the fully contoured design allows the foot to function as naturally as possible. Under load, FIG. 42 would deform by flattening to look essentially like FIG. 41. Seen in this light, the naturally contoured side design in FIG. 41 is a more conventional, conservative design that is a special case of the more general fully contoured design in FIG. 42, which is the closest to the natural form of the foot, but the least conventional. The amount of deformation flattening used in the FIG. 41 design, which obviously varies under different loads, is not an essential element of the applicant's invention.

FIGS. 41 and 42 both show in frontal plane cross sections the essential concept underlying this invention, the theoretically ideal stability plane, which is also theoretically ideal for efficient natural motion of all kinds, including running, jogging or walking. FIG. 42 shows the most general case of the invention, the fully contoured design, which conforms to the natural shape of the unloaded foot. For any given individual, the theoretically ideal stability plane 51 is determined, first, by the desired shoe sole thickness (s) in a frontal plane cross section, and, second, by the natural shape of the individual's foot surface 29.

For the special case shown in FIG. 41, the theoretically ideal stability plane for any particular individual (or size average of individuals) is determined, first, by the given frontal plane cross section shoe sole thickness (s); second, by the natural shape of the individual's foot; and, third, by the frontal plane cross section width of the individual's load-bearing footprint 30*b*, which is defined as the upper surface of the shoe sole that is in physical contact with and supports the human foot sole.

The theoretically ideal stability plane for the special case is composed conceptually of two parts. Shown in FIG. 41, the first part is a line segment 31*b* of equal length and parallel to line 30*b* at a constant distance (s) equal to shoe sole thickness. This corresponds to a conventional shoe sole directly underneath the human foot, and also corresponds to the flattened portion of the bottom of the load-bearing foot sole 28*b*. The second part is the naturally contoured stability side outer edge 31*a* located at each side of the first part, line segment 31*b*. Each point on the contoured side outer edge 31*a* is located at a distance, which is exactly shoe sole thickness (s) from the closest point on the contoured side inner edge 30*a*.

In summary, the theoretically ideal stability plane is the essence of this invention because it is used to determine a geometrically precise bottom contour of the shoe sole based on a top contour that conforms to the contour of the foot. This invention specifically claims the exactly determined geometric relationship just described.

It can be stated unequivocally that any shoe sole contour, even of similar contour, that exceeds the theoretically ideal stability plane will restrict natural foot motion, while any less than that plane will degrade natural stability; in direct proportion to the amount of the deviation. The theoretical ideal was taken to be that which is closest to natural.

Central midsole section 188 and upper section 187 in FIG. 16 must fulfill a cushioning function, which frequently calls for relatively soft midsole material. Unlike the shoe sole structure shown in FIG. 9 of prior application No. '302, the shoe sole thickness effectively decreases in the FIG. 16 invention shown in this application when the soft central section is deformed under weight-bearing pressure to a greater extent than the relatively firmer sides.

In order to control this effect, it is necessary to measure it. What is required is a methodology of measuring a portion of a static shoe sole at rest that will indicate the resultant thickness under deformation. A simple approach is to take the actual least distance thickness at any point and multiply it times a factor for deformation or "give", which is typically measured in durometers (on Shore A scale), to get a resulting thickness under a standard deformation load. Assuming a linear relationship (which can be adjusted empirically in practice), this method would mean that a shoe sole midsection of 1 inch thickness and a fairly soft 30 durometer would be roughly functionally equivalent under equivalent load-bearing deformation to a shoe midsole section of ½ inch and a relatively hard 60 durometer; they would both equal a factor of 30 inch-durometers. The exact methodology can be changed or improved empirically, but the basic point is that static shoe sole thickness needs to have a dynamic equivalent under equivalent loads, depending on the density of the shoe sole material.

Since the Theoretically Ideal Stability Plane 51 has already been generally defined in part as having a constant frontal plane thickness and preferring a uniform material density to avoid arbitrarily altering natural foot motion, it is logical to develop a non-static definition that includes compensation for shoe sole material density. The Theoretically Ideal Stability Plane defined in dynamic terms would alter constant thickness to a constant multiplication product of thickness times density.

Using this restated definition of the Theoretically Ideal Stability Plane presents an interesting design possibility: the somewhat extended width of shoe sole sides that are required under the static definition of the Theoretically Ideal Stability Plane could be reduced by using a higher density midsole material in the naturally contoured sides.

Figure 43:
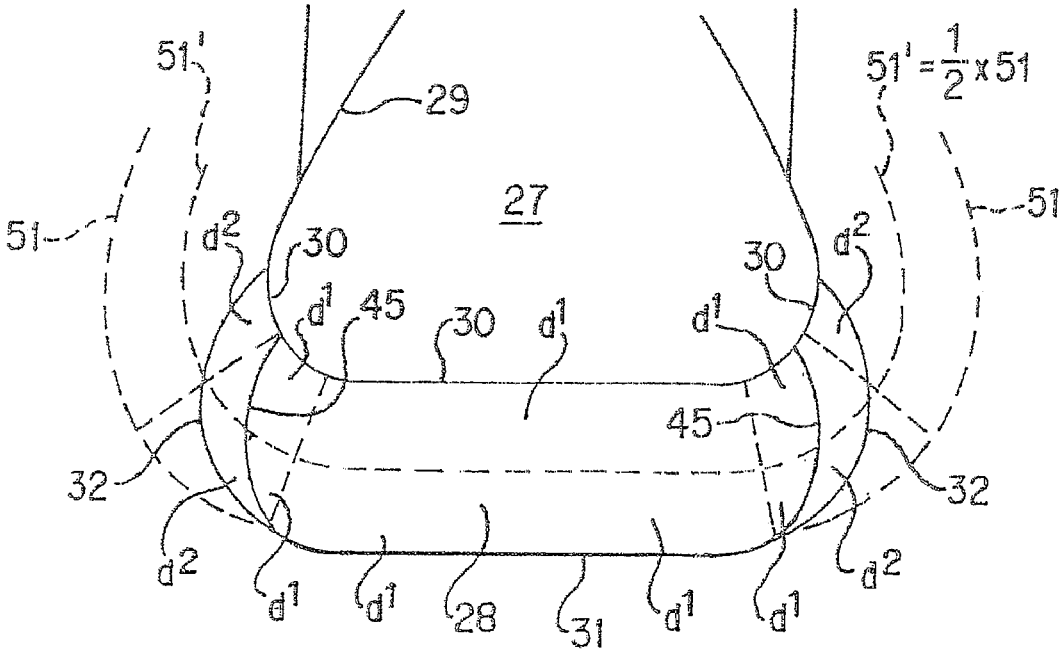

FIG. 43 shows, in frontal plane cross section at the heel, the use of a high density (d') midsole material on the naturally contoured sides and a low density (d) midsole material everywhere else to reduce side width. To illustrate the principle, it was assumed in FIG. 43 that density (d') is twice that of density (d), so the effect is somewhat exaggerated, but the basic point is that shoe sole width can be reduced significantly by using the Theoretically Ideal Stability Plane with a definition of thickness that compensates for dynamic force loads. In the FIG. 43 example, about one fourth of an inch in width on each side is saved under the revised definition, for a total width reduction of one half inch, while rough functional equivalency should be maintained, as if the frontal plane thickness and density were each unchanging.

As shown in FIG. 43, the boundary between sections of different density is indicated by the line 45 and the line 51' parallel 51 at half the distance from the outer surface of the foot 29.

Note that the design in FIG. 43 uses low density midsole material, which is effective for cushioning, throughout that portion of the shoe sole that would be directly load-bearing from roughly 10 degrees of inversion to roughly 10 degrees, the normal range of maximum motion during running; the higher density midsole material is tapered in from roughly 10 degrees to 30 degrees on both sides, at which ranges cushioning is less critical than providing stabilizing support.

The foregoing shoe designs meet the objectives of this invention as stated above. However, it will clearly be understood by those skilled in the art that the foregoing description has been made in terms of the preferred embodiments and various changes and modifications may be made without departing from the scope of the present invention which is to be defined by the appended claims.

What is claimed is:

1. A shoe sole suitable for an athletic shoe, comprising:

a sole inner surface and a sole outer surface;

a sole lateral side, a sole medial side, and a sole middle portion located between the sole lateral side and the sole medial side;

a bottom sole;

the shoe sole comprising at least one convexly rounded portion of the sole inner surface, as viewed in a frontal plane cross-section when the shoe sole is upright and in an unloaded condition, said convexity being determined relative to a section of the shoe sole directly adjacent to the convexly rounded portion of the sole outer surface;

the shoe sole comprising at least one concavely rounded portion of the sole outer surface, as viewed in a frontal plane cross-section when the shoe sole is upright and in an unloaded condition, said concavity being determined relative to an inner section of the shoe sole directly adjacent to the concavely rounded portion of the sole outer surface;

each said concavely rounded portion of the sole outer surface being located on a side of the shoe sole at a location corresponding to the location of at least one convexly rounded portion of the sole inner surface; and at least one compartment defined by an outer surface, containing a pressure-transmitting material and located at a location selected from the group consisting of the heel portion of the shoe sole and portions of the shoe sole located at locations substantially corresponding to the location of each of the following support elements of the intended wearer's foot when inside the shoe: a base of the fifth metatarsal, a head of one of the metatarsals, and a first distal phalange; and wherein at least a portion of said outer surface of said at least one compartment is separated from an opposing portion of an interior surface of said shoe sole by an internal sipe; and said portion of said compartment outer surface is movable relative to said opposing portion of said interior surface of said shoe sole; and at least a part of said opposing portions of said movable surfaces are in contact with each other in an unloaded condition, and wherein a portion of the shoe sole located between said convexly rounded portion of the sole inner surface and said concavely rounded portion of the sole outer surface has a substantially uniform thickness extending from a location proximate to a sidemost extent of the at least one of said shoe sole lateral and medial sides to a location proximate to a lowest point on said at least one of said shoe sole lateral and medial sides, as viewed in a frontal plane cross-section when the shoe sole is upright and in an unloaded condition.

2. A shoe sole as claimed in claim 1, wherein said pressure-transmitting material is midsole material.

3. A shoe sole as claimed in claim 2, further comprising at least one layer of fiber strands embedded within said shoe sole.

4. A shoe sole as claimed in claim 1, further comprising at least one layer of fiber strands embedded within said shoe sole.

5. A shoe sole as claimed in claim 1, wherein a portion of the shoe sole located between said convexly rounded portion of the sole inner surface and said concavely rounded portion of the sole outer surface has a substantially uniform thickness extending from a location proximate to a sidemost extent of both of the shoe sole lateral and medial sides to a location proximate to a lowest point of each of the respective shoe sole lateral and medial sides, as viewed in a frontal plane cross-section when the shoe sole is upright and in an unloaded condition.

6. A shoe sole as claimed in claim 5, wherein said pressure-transmitting material is midsole material.

7. A shoe sole as claimed in claim 5, further comprising at least one layer of fiber strands embedded within said shoe sole.

8. A shoe sole suitable for an athletic shoe, comprising:

a sole inner surface and a sole outer surface;

a sole lateral side, a sole medial side, and a sole middle portion located between the sole lateral side and the sole medial side;

a bottom sole;

the shoe sole comprising at least one convexly rounded portion of the sole inner surface, as viewed in a frontal plane cross-section when the shoe sole is upright and in an unloaded condition, said convexity being determined relative to a section of the shoe sole directly adjacent to the convexly rounded portion of the sole outer surface;

the shoe sole comprising at least one concavely rounded portion of the sole outer surface, as viewed in a frontal plane cross-section when the shoe sole is upright and in an unloaded condition, said concavity being determined relative to an inner section of the shoe sole directly adjacent to the concavely rounded portion of the sole outer surface;

each said concavely rounded portion of the sole outer surface being located on a side of the shoe sole at a location corresponding to the location of at least one convexly rounded portion of the sole inner surface; and at least one compartment defined by an outer surface, containing a pressure-transmitting material and located at a location selected from the group consisting of the heel portion of the shoe sole and portions of the shoe sole located at locations substantially corresponding to the location of each of the following support elements of the intended wearer's foot when inside the shoe: a base of the fifth metatarsal, a head of one of the metatarsals, and a first distal phalange; and wherein said outer surface of said at least one compartment is separated from an opposing interior surface of said shoe sole by an internal sipe and said compartment outer surface is movable relative to said opposing interior surface of said shoe sole; and at least a part of said opposing portions of said movable surfaces are in contact with each other in an unloaded condition, and wherein a portion of the shoe sole located between said convexly rounded portion of the sole inner surface and said concavely rounded portion of the sole outer surface has a substantially uniform thickness extending from a location proximate to a sidemost extent of both of the shoe sole lateral and medial sides to a location proximate to a lowest point of each of the respective shoe sole lateral and medial sides, as viewed in a frontal plane cross-section when the shoe sole is upright and in an unloaded condition.

9. A shoe sole as claimed in claim 8, wherein said pressure-transmitting material is midsole material.

10. A shoe sole as claimed in claim 8, further comprising at least one layer of fiber strands embedded within said shoe sole.

11. A shoe sole as claimed in claim 8, wherein a portion of the shoe sole located between said convexly rounded portion of the sole inner surface and said concavely rounded portion of the sole outer surface has a substantially uniform thickness extending from a location proximate to a sidemost extent of the shoe sole side to a location proximate to a lowest point of the shoe sole side, as viewed in a frontal plane cross-section when the shoe sole is upright and in an unloaded condition.

12. A shoe sole as claimed in claim 11, wherein said pressure-transmitting material is midsole material.

13. A shoe sole as claimed in claim 12, further comprising at least one layer of fiber strands embedded within said shoe sole.

14. A shoe sole suitable for an athletic shoe, comprising:

a sole inner surface and a sole outer surface;

a sole lateral side, a sole medial side, and a sole middle portion located between the sole lateral side and the sole medial side;

a bottom sole;

the shoe sole comprising at least one convexly rounded portion of the sole inner surface, as viewed in a frontal plane cross-section when the shoe sole is upright and in an unloaded condition, said convexity being determined relative to a section of the shoe sole directly adjacent to the convexly rounded portion of the sole outer surface;

the shoe sole comprising at least one concavely rounded portion of the sole outer surface, as viewed in a frontal plane cross-section when the shoe sole is upright and in an unloaded condition, said concavity being determined relative to an inner section of the shoe sole directly adjacent to the concavely rounded portion of the sole outer surface;

the shoe sole comprising a lateral sidemost section and a medial sidemost section, each said sidemost section being located outside of a straight vertical line extending through the sole at a respective sidemost extent of said inner surface of the shoe sole, as viewed in said shoe sole frontal plane cross-section when the shoe sole is upright and in an unloaded condition;

each said concavely rounded portion of the sole outer surface being located at a location corresponding to the location of at least one convexly rounded portion of the sole inner surface;

wherein a portion of the shoe sole located between said convexly rounded portion of the sole inner surface and said concavely rounded portion of the sole outer surface has a substantially uniform thickness extending from within a sidemost section of the medial side of the shoe sole to within a sidemost section of the lateral side of the shoe sole, as viewed in a frontal plane cross-section when the shoe sole is upright and in an unloaded condition; and at least one compartment defined by an outer surface, containing a pressure-transmitting material and located at a location selected from the group consisting of the heel portion of the shoe sole and portions of the shoe sole located at locations substantially corresponding to the location of each of the following support elements of the intended wearer's foot when inside the shoe: a base of the fifth metatarsal, a head of one of the metatarsals, and a first distal phalange; and wherein at least a portion of said outer surface of said at least one compartment is separated from an opposing portion of an interior surface of said shoe sole by an internal sipe; and said portion of said compartment outer surface is movable relative to said opposing portion of said interior surface of said shoe sole; and at least a part of said opposing portions of said movable surfaces are in contact with each other in an unloaded condition.

15. A shoe sole as claimed in claim 14, wherein said pressure-transmitting material is midsole material.

16. A shoe sole as claimed in claim 15, further comprising at least one layer of fiber strands embedded within said shoe sole.

17. A shoe sole as claimed in claim 14, further comprising at least one layer of fiber strands embedded within said shoe sole.

18. A shoe sole as claimed in claim 14, wherein a portion of the shoe sole located between said convexly rounded portion of the sole inner surface and said concavely rounded portion of the sole outer surface has a substantially uniform thickness extending from a sidemost extent of the medial side of the shoe sole to a sidemost extent of the lateral side of the shoe sole, as viewed in a frontal plane cross-section when the shoe sole is upright and in an unloaded condition.

19. A shoe sole as claimed in claim 18, wherein said pressure-transmitting material is midsole material.

20. A shoe sole as claimed in claim 19, further comprising at least one layer of fiber strands embedded within said shoe sole.

21. A shoe sole suitable for an athletic shoe, comprising:

a sole inner surface and a sole outer surface;

a sole lateral side, a sole medial side, and a sole middle portion located between the sole lateral side and the sole medial side;

a bottom sole;

the shoe sole comprising at least one convexly rounded portion of the sole inner surface, as viewed in a frontal plane cross-section when the shoe sole is upright and in an unloaded condition, said convexity being determined relative to a section of the shoe sole directly adjacent to the convexly rounded portion of the sole outer surface;

the shoe sole comprising at least one concavely rounded portion of the sole outer surface, as viewed in a frontal plane cross-section when the shoe sole is upright and in an unloaded condition, said concavity being determined relative to an inner section of the shoe sole directly adjacent to the concavely rounded portion of the sole outer surface;

the shoe sole comprising a lateral sidemost section and a medial sidemost section, each said sidemost section being located outside of a straight vertical line extending through the sole at a respective sidemost extent of said inner surface of the shoe sole, as viewed in said shoe sole frontal plane cross-section when the shoe sole is upright and in an unloaded condition;

each said concavely rounded portion of the sole outer surface being located at a location corresponding to the location of at least one convexly rounded portion of the sole inner surface;

wherein a portion of the shoe sole located between said convexly rounded portion of the sole inner surface and said concavely rounded portion of the sole outer surface has a substantially uniform thickness extending from within a sidemost section of the medial side of the shoe sole to within a sidemost section of the lateral side of the shoe sole, as viewed in a frontal plane cross-section when the shoe sole is upright and in an unloaded condition; and at least one compartment defined by an outer surface, containing a pressure-transmitting material and located at a location selected from the group consisting of the heel portion of the shoe sole and portions of the shoe sole located at locations substantially corresponding to the location of each of the following support elements of the intended wearer's foot when inside the shoe: a base of the fifth metatarsal, a head of one of the metatarsals, and a first distal phalange; and wherein said outer surface of said at least one compartment is separated from an opposing interior surface of said shoe sole by an internal sipe and said compartment outer surface is movable relative to said opposing interior surface of said shoe sole; and at least a part of said opposing portions of said movable surfaces are in contact with each other in an unloaded condition.

22. A shoe sole as claimed in claim 21, wherein said pressure-transmitting material is midsole material.

23. A shoe sole as claimed in claim 21, further comprising at least one layer of fiber strands embedded within said shoe sole.

24. A shoe sole as claimed in claim 21, wherein a portion of the shoe sole located between said convexly rounded portion of the sole inner surface and said concavely rounded portion of the sole outer surface has a substantially uniform thickness extending from a sidemost extent of the medial side of the shoe sole to a sidemost extent of the lateral side of the shoe sole, as viewed in a frontal plane cross-section when the shoe sole is upright and in an unloaded condition.

25. A shoe sole as claimed in claim 24, wherein said pressure-transmitting material is midsole material.

26. A shoe sole as claimed in claim 25, further comprising at least one layer of fiber strands embedded within said shoe sole.

* * * * *